US010131468B2

(12) United States Patent
Ishihara et al.

(10) Patent No.: US 10,131,468 B2
(45) Date of Patent: Nov. 20, 2018

(54) FLEXIBLE CONTAINERS AND METHODS OF FORMING THE SAME

(71) Applicant: The Procter & Gamble Company, Cincinnati, OH (US)

(72) Inventors: Tadayoshi Ishihara, West Chester, OH (US); Joseph Craig Lester, Liberty Township, OH (US); Marc Richard Bourgeois, Liberty Township, OH (US); Kenneth Stephen McGuire, Montgomery, OH (US); Benjamin Jacob Clare, Cincinnati, OH (US); Scott Kendyl Stanley, Mason, OH (US); Lee Mathew Arent, Fairfield, OH (US); Jun You, West Chester, OH (US); Andrew Paul Rapach, Fairfield, OH (US); Charles John Berg, Jr., Wyoming, OH (US); Kory Adam Gunnerson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 453 days.

(21) Appl. No.: 14/534,210

(22) Filed: Nov. 6, 2014

(65) Prior Publication Data

US 2015/0125099 A1 May 7, 2015

Related U.S. Application Data

(60) Provisional application No. 61/900,794, filed on Nov. 6, 2013.

(51) Int. Cl.
*B65D 30/20* (2006.01)
*B65D 75/00* (2006.01)
(Continued)

(52) U.S. Cl.
CPC ..... *B65D 31/10* (2013.01); *B31B 50/26* (2017.08); *B31B 50/81* (2017.08); *B65B 3/02* (2013.01);
(Continued)

(58) Field of Classification Search
CPC ..... B31B 1/26; B31B 1/90; B31B 2219/269; B31B 2219/23; B31B 2237/20;
(Continued)

(56) References Cited

U.S. PATENT DOCUMENTS 2,612,738 A 10/1952 Salfisberg
3,279,330 A * 10/1966 Harding ..... B31B 19/00 493/194
(Continued)

FOREIGN PATENT DOCUMENTS

CN 1640777 7/2005
DE 3721303 1/1989
(Continued)

OTHER PUBLICATIONS

"The Rigidified Standing Pouch—A Concept for Flexible Packaging", Phillip John Campbell, A Thesis Written in Partial Fulfillment of the Requirements for the Degree of Master of Industrial Design, North Carolina State University School of Design Raleigh, 1993, pp. 1-35.
(Continued)

*Primary Examiner* — Sameh Tawfik
(74) *Attorney, Agent, or Firm* — David M Weirich

(57) ABSTRACT

A method of forming a flexible container can include folding a web or sheet to define one or more gussets in one or more regions of the flexible container. The gusset can be a continuous gusset or can be an interrupted gusset, having a seal disposed in the gusset.

15 Claims, 39 Drawing Sheets

(51) Int. Cl.

| | |
|---|---|
| ***B65D 75/20*** | (2006.01) |
| ***B65D 75/52*** | (2006.01) |
| ***B65D 75/54*** | (2006.01) |
| ***B65D 75/56*** | (2006.01) |
| ***B65D 30/10*** | (2006.01) |
| ***B65D 75/58*** | (2006.01) |
| ***B65D 33/00*** | (2006.01) |
| ***B65D 33/02*** | (2006.01) |
| ***B65D 81/03*** | (2006.01) |
| ***B31B 50/26*** | (2017.01) |
| ***B31B 50/81*** | (2017.01) |
| ***B65B 43/30*** | (2006.01) |
| ***B65B 3/02*** | (2006.01) |
| *B31B 155/00* | (2017.01) |
| *B31B 160/30* | (2017.01) |
| *B31B 160/20* | (2017.01) |
| *B31B 70/00* | (2017.01) |
| *B31B 70/26* | (2017.01) |

(52) U.S. Cl.

CPC ..... *B65B 43/30* (2013.01); *B65D 31/16* (2013.01); *B65D 33/004* (2013.01); *B65D 33/02* (2013.01); *B65D 75/008* (2013.01); *B65D 75/20* (2013.01); *B65D 75/525* (2013.01); *B65D 75/54* (2013.01); *B65D 75/566* (2013.01); *B65D 75/5866* (2013.01); *B65D 75/5877* (2013.01); *B65D 75/5883* (2013.01); *B65D 81/03* (2013.01); *B31B 70/008* (2017.08); *B31B 70/266* (2017.08); *B31B 2155/00* (2017.08); *B31B 2155/0014* (2017.08); *B31B 2160/20* (2017.08); *B31B 2160/30* (2017.08); *B65D 2205/02* (2013.01)

(58) Field of Classification Search

CPC ..... B31B 2237/25; B31B 2237/406; B65D 31/10; B65D 31/16; B65D 33/004; B65D 33/02; B65D 75/008; B65D 75/20; B65D 75/525; B65D 75/54

USPC ..... 493/214

See application file for complete search history.

(56) References Cited

U.S. PATENT DOCUMENTS

| | | | | | |
|---|---|---|---|---|---|
| 3,279,331 | A * | 10/1966 | Platt | B65D 33/18 | 383/120 |
| 3,333,523 | A * | 8/1967 | Terzuoli | B31B 19/00 | 383/120 |
| 3,670,954 | A * | 6/1972 | Leventhal | B65D 31/16 | 383/109 |
| 4,044,867 | A | 8/1977 | Fisher | | |
| 4,721,396 | A * | 1/1988 | Sengewald | B65D 33/065 | 383/120 |
| 4,889,523 | A * | 12/1989 | Sengewald | B65D 31/10 | 493/195 |
| 4,949,530 | A | 8/1990 | Pharo | | |
| 5,035,515 | A * | 7/1991 | Crossman | B65D 33/004 | 206/831 |
| 5,059,035 | A * | 10/1991 | Kristensen | B65D 75/5866 | 222/572 |
| 5,137,154 | A | 8/1992 | Cohen | | |
| 5,174,657 | A * | 12/1992 | Peppiatt | B65D 31/04 | 383/109 |
| 5,350,240 | A * | 9/1994 | Billman | B65D 75/008 | 383/104 |
| 5,378,065 | A | 1/1995 | Tobolka | | |
| 5,890,810 | A * | 4/1999 | Barlow | B31B 19/00 | 206/390 |
| 5,960,975 | A | 10/1999 | Lennartsson | | |
| 6,126,315 | A | 10/2000 | Ichikawa et al. | | |
| 6,244,466 | B1 | 6/2001 | Naslund | | |
| 6,520,491 | B2 | 2/2003 | Timlick | | |
| 6,539,666 | B2 * | 4/2003 | Weder | B65D 85/52 | 47/72 |
| 7,147,145 | B2 * | 12/2006 | Kortsmit | B65D 5/061 | 229/137 |
| 7,207,717 | B2 | 7/2007 | Steele | | |
| 7,585,528 | B2 | 9/2009 | Ferri | | |
| 7,775,717 | B2 * | 8/2010 | DeLuca | B65D 83/0894 | 206/389 |
| 8,104,669 | B2 * | 1/2012 | Christensen | B42F 7/06 | 229/67.1 |
| 8,181,428 | B2 | 5/2012 | Gustafsson | | |
| 8,413,846 | B2 | 4/2013 | Kasa | | |
| 8,640,920 | B2 | 2/2014 | Sharp et al. | | |
| 8,661,772 | B2 | 3/2014 | Yasuhira | | |
| 8,662,751 | B2 | 3/2014 | Forss | | |
| 8,790,229 | B2 | 7/2014 | Jordi | | |
| 9,327,867 | B2 | 5/2016 | Stanley et al. | | |
| 9,469,088 | B2 | 10/2016 | Stanley et al. | | |
| 9,586,744 | B2 | 3/2017 | Arent et al. | | |
| 2003/0094394 | A1 | 5/2003 | Anderson et al. | | |
| 2004/0035865 | A1 | 2/2004 | Rosen | | |
| 2004/0149618 | A1 | 8/2004 | Otaki | | |
| 2005/0126941 | A1 | 6/2005 | Ferri | | |
| 2007/0092164 | A1 | 4/2007 | Yasuhira | | |
| 2008/0205801 | A1 | 8/2008 | Alaux | | |
| 2008/0264970 | A1 | 10/2008 | Kasai | | |
| 2010/0290722 | A1 * | 11/2010 | DeSmedt | B31B 19/00 | 383/120 |
| 2010/0308062 | A1 | 12/2010 | Helou | | |
| 2012/0097634 | A1 | 4/2012 | Riedl | | |
| 2013/0248540 | A1 * | 9/2013 | Darby | B65D 37/00 | 220/635 |
| 2013/0292287 | A1 | 11/2013 | Stanley et al. | | |
| 2013/0292353 | A1 | 11/2013 | Stanley et al. | | |
| 2013/0292395 | A1 | 11/2013 | Stanley et al. | | |
| 2013/0292413 | A1 | 11/2013 | Stanley et al. | | |
| 2013/0292415 | A1 | 11/2013 | Stanley et al. | | |
| 2013/0294711 | A1 | 11/2013 | Stanley et al. | | |
| 2013/0337244 | A1 | 12/2013 | Stanley et al. | | |
| 2014/0033654 | A1 | 2/2014 | Stanley et al. | | |
| 2014/0033655 | A1 | 2/2014 | Stanley et al. | | |
| 2014/0187401 | A1 | 7/2014 | Totani | | |
| 2014/0250834 | A1 | 9/2014 | Yoshikane et al. | | |
| 2015/0028057 | A1 | 1/2015 | Arent et al. | | |
| 2015/0033671 | A1 | 2/2015 | Stanley et al. | | |
| 2015/0034670 | A1 | 2/2015 | Stanley et al. | | |
| 2015/0036950 | A1 | 2/2015 | Stanley et al. | | |
| 2015/0121810 | A1 | 5/2015 | Bourgeois et al. | | |
| 2015/0122373 | A1 | 5/2015 | Bourgeois et al. | | |
| 2015/0122840 | A1 | 5/2015 | Cox et al. | | |
| 2015/0122841 | A1 | 5/2015 | McGuire et al. | | |
| 2015/0122842 | A1 | 5/2015 | Berg et al. | | |
| 2015/0122846 | A1 | 5/2015 | Stanley et al. | | |
| 2015/0125099 | A1 | 5/2015 | Ishihara et al. | | |
| 2015/0125574 | A1 | 5/2015 | Arent et al. | | |
| 2015/0126349 | A1 | 5/2015 | Ishihara et al. | | |
| 2016/0176578 | A1 | 6/2016 | Stanley et al. | | |
| 2016/0176582 | A1 | 6/2016 | McGuire et al. | | |
| 2016/0176583 | A1 | 6/2016 | Ishihara et al. | | |
| 2016/0176584 | A1 | 6/2016 | Ishihara et al. | | |
| 2016/0176597 | A1 | 6/2016 | Ishihara et al. | | |
| 2016/0221727 | A1 | 8/2016 | Stanley et al. | | |
| 2016/0297569 | A1 | 10/2016 | Berg et al. | | |
| 2016/0297589 | A1 | 10/2016 | You et al. | | |
| 2016/0297590 | A1 | 10/2016 | You et al. | | |
| 2016/0297591 | A1 | 10/2016 | You et al. | | |
| 2016/0325518 | A1 | 11/2016 | Ishihara et al. | | |
| 2016/0362228 | A1 | 12/2016 | McGuire et al. | | |
| 2017/0001782 | A1 | 1/2017 | Arent et al. | | |

FOREIGN PATENT DOCUMENTS

| | | |
|---|---|---|
| DE | 102005002301 | 7/2006 |
| JP | A-H107159 | 1/1998 |
| JP | 2005343492 | 12/2005 |

(56) References Cited

FOREIGN PATENT DOCUMENTS

| | | |
|---|---|---|
| JP | 2006027697 | 2/2006 |
| JP | 2006240651 | 9/2006 |
| JP | 2009184690 | 8/2009 |
| JP | 4639677 | 2/2011 |
| JP | 2012025394 | 2/2012 |
| RU | 2038815 | 7/1995 |
| WO | WO1996001775 | 1/1996 |
| WO | WO2005063589 | 7/2005 |
| WO | WO2008064508 | 6/2008 |
| WO | WO2012073004 | 6/2012 |
| WO | WO2013124201 | 8/2013 |

OTHER PUBLICATIONS

All Office Actions, U.S. Appl. No. 13/957,158, filed Aug. 1, 2013.
All Office Actions, U.S. Appl. No. 13/957,187, filed Aug. 1, 2013.
All Office Actions, U.S. Appl. No. 14/534,197, filed Nov. 6, 2014.
All Office Actions, U.S. Appl. No. 14/534,213, filed Nov. 6, 2014.
All Office Actions, U.S. Appl. No. 14/534,214, filed Nov. 6, 2014.
All Office Actions, U.S. Appl. No. 15/148,395, filed May 6, 2016.
All Office Actions, U.S. Appl. No. 15/198,472, filed Jun. 30, 2016.
International Search Report and Written Opinion, PCT/US2014/064285, dated Mar. 10, 2015.
U.S. Appl. No. 29/526,409, filed May 8, 2015, McGuire et al.
U.S. Appl. No. 15/094,118, filed Apr. 8, 2016, Stanley et al.
U.S. Appl. No. 15/466,898, filed Mar. 27, 2017, Arent et al.
U.S. Appl. No. 15/466,901, filed Mar. 27, 2017, McGuire et al.

* cited by examiner

FLEXIBLE CONTAINERS AND METHODS OF FORMING THE SAME

FIELD

The present disclosure relates in general to containers, and in particular, to containers made from flexible material and methods of forming such containers.

BACKGROUND

Fluent products include liquid products and/or pourable solid products. In various embodiments, a container can be used to receive, contain, and dispense one or more fluent products. And, in various embodiments, a container can be used to receive, contain, and/or dispense individual articles or separately packaged portions of a product. A container can include one or more product volumes. A product volume can be configured to be filled with one or more fluent products. A container receives a fluent product when its product volume is filled. Once filled to a desired volume, a container can be configured to contain the fluent product in its product volume, until the fluent product is dispensed. A container contains a fluent product by providing a barrier around the fluent product. The barrier prevents the fluent product from escaping the product volume. The barrier can also protect the fluent product from the environment outside of the container. A filled product volume is typically closed off by a cap or a seal. A container can be configured to dispense one or more fluent products contained in its product volume(s). Once dispensed, an end user can consume, apply, or otherwise use the fluent product(s), as appropriate. In various embodiments, a container may be configured to be refilled and reused or a container may be configured to be disposed of after a single fill or even after a single use. A container should be configured with sufficient structural integrity, such that it can receive, contain, and dispense its fluent product(s), as intended, without failure.

A container for fluent product(s) can be handled, displayed for sale, and put into use. A container can be handled in many different ways as it is made, filled, decorated, packaged, shipped, and unpacked. A container can experience a wide range of external forces and environmental conditions as it is handled by machines and people, moved by equipment and vehicles, and contacted by other containers and various packaging materials. A container for fluent product(s) should be configured with sufficient structural integrity, such that it can be handled in any of these ways, or in any other way known in the art, as intended, without failure.

A container can also be displayed for sale in many different ways as it is offered for purchase. A container can be offered for sale as an individual article of commerce or packaged with one or more other containers or products, which together form an article of commerce. A container can be offered for sale as a primary package with or without a secondary package. A container can be decorated to display characters, graphics, branding, and/or other visual elements when the container is displayed for sale. A container can be configured to be displayed for sale while laying down or standing up on a store shelf, while presented in a merchandising display, while hanging on a display hanger, or while loaded into a display rack or a vending machine. A container for fluent product(s) should be configured with a structure that allows it to be displayed in any of these ways, or in any other way known in the art, as intended, without failure.

A container can also be put into use in many different ways, by its end user. A container can be configured to be held and/or gripped by an end user, so a container should be appropriately sized and shaped for human hands; and for this purpose, a container can include useful structural features such as a handle and/or a gripping surface. A container can be stored while laying down or standing up on a support surface, while hanging on or from a projection such as a hook or a clip, or while supported by a product holder, or (for refillable or rechargeable containers) positioned in a refilling or recharging station. A container can be configured to dispense fluent product(s) while in any of these storage positions or while being held by the user. A container can be configured to dispense fluent product(s) through the use of gravity, and/or pressure, and/or a dispensing mechanism, such as a pump, or a straw, or through the use of other kinds of dispensers known in the art. Some containers can be configured to be filled and/or refilled by a seller (e.g. a merchant or retailer) or by an end user. A container for fluent product(s) should be configured with a structure that allows it to be put to use in any of these ways, or in any other way known in the art, as intended, without failure. A container can also be configured to be disposed of by the end user, as waste and/or recyclable material, in various ways.

One conventional type of container for fluent products is a rigid container made from solid material(s). Examples of conventional rigid containers include molded plastic bottles, glass jars, metal cans, cardboard boxes, etc. These conventional rigid containers are well-known and generally useful; however their designs do present several notable difficulties.

First, some conventional rigid containers for fluent products can be expensive to make. Some rigid containers are made by a process shaping one or more solid materials. Other rigid containers are made with a phase change process, where container materials are heated (to soften/melt), then shaped, then cooled (to harden/solidify). Both kinds of making are energy intensive processes, which can require complex equipment.

Second, some conventional rigid containers for fluent products can require significant amounts of material. Rigid containers that are designed to stand up on a support surface require solid walls that are thick enough to support the containers when they are filled. This can require significant amounts of material, which adds to the cost of the containers and can contribute to difficulties with their disposal.

Third, some conventional rigid containers for fluent products can be difficult to decorate. The sizes, shapes, (e.g. curved surfaces) and/or materials of some rigid containers, make it difficult to print directly on their outside surfaces. Labeling requires additional materials and processing, and limits the size and shape of the decoration. Overwrapping provides larger decoration areas, but also requires additional materials and processing, often at significant expense.

Fourth, some conventional rigid containers for fluent products can be prone to certain kinds of damage. If a rigid container is pushed against a rough surface, then the container can become scuffed, which may obscure printing on the container. If a rigid container is pressed against a hard object, then the container can become dented, which may look unsightly. And if a rigid container is dropped, then the container can rupture, which may cause its fluent product to be lost.

Fifth, some fluent products in conventional rigid containers can be difficult to dispense. When an end user squeezes a rigid container to dispense its fluent product, the end user must overcome the resistance of the rigid sides, to deform the container. Some users may lack the hand strength to easily overcome that resistance; these users may dispense less than their desired amount of fluent product. Other users may need to apply so much of their hand strength, that they cannot easily control how much they deform the container; these users may dispense more than their desired amount of fluent product.

SUMMARY

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to print and/or decorate, because they are made from flexible materials, and flexible materials can be printed and/or decorated as conformable webs, before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands. Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed and put into use, as intended, without failure.

DETAILED DESCRIPTION

Figure 1A:
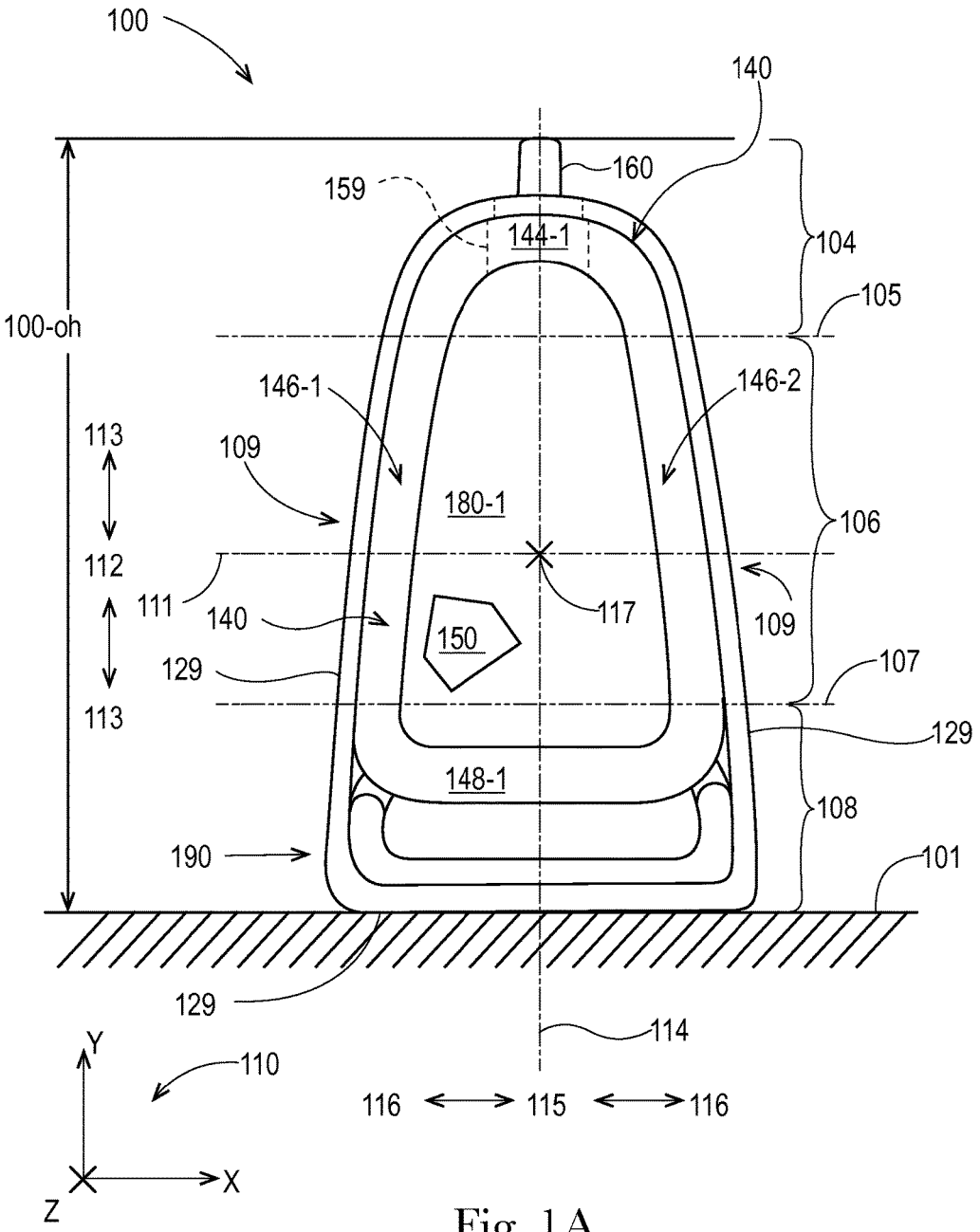
FIG. 1A illustrates a front view of an embodiment of a stand up flexible container.

The present disclosure describes various embodiments of containers made from flexible material. Because these containers are made from flexible material, these containers can be less expensive to make, can use less material, and can be easier to decorate, when compared with conventional rigid containers. First, these containers can be less expensive to make, because the conversion of flexible materials (from sheet form to finished goods) generally requires less energy and complexity, than formation of rigid materials (from bulk form to finished goods). Second, these containers can use less material, because they are configured with novel support structures that do not require the use of the thick solid walls used in conventional rigid containers. Third, these flexible containers can be easier to decorate, because their flexible materials can be easily printed before they are formed into containers. Fourth, these flexible containers can be less prone to scuffing, denting, and rupture, because flexible materials allow their outer surfaces to deform when contacting surfaces and objects, and then to bounce back. Fifth, fluent products in these flexible containers can be more readily and carefully dispensed, because the sides of flexible containers can be more easily and controllably squeezed by human hands. Alternatively, any embodiment of flexible containers, as described herein, can be configured to dispense fluent products by pouring the fluent products out of its product volume.

Even though the containers of the present disclosure are made from flexible material, they can be configured with sufficient structural integrity, such that they can receive, contain, and dispense fluent product(s), as intended, without failure. Also, these containers can be configured with sufficient structural integrity, such that they can withstand external forces and environmental conditions from handling, without failure. Further, these containers can be configured with structures that allow them to be displayed for sale and put into use, as intended, without failure.

As used herein, the term "about" modifies a particular value, by referring to a range equal to the particular value, plus or minus twenty percent (+/−20%). For any of the embodiments of flexible containers, disclosed herein, any disclosure of a particular value, can, in various alternate embodiments, also be understood as a disclosure of a range equal to about that particular value (i.e. +/−20%).

As used herein, the term "ambient conditions" refers to a temperature within the range of 15-35 degrees Celsius and a relative humidity within the range of 35-75%.

As used herein, the term "approximately" modifies a particular value, by referring to a range equal to the particular value, plus or minus fifteen percent (+/−15%). For any of the embodiments of flexible containers, disclosed herein, any disclosure of a particular value, can, in various alternate embodiments, also be understood as a disclosure of a range equal to approximately that particular value (i.e. +/−15%).

As used herein, when referring to a sheet of material, the term "basis weight" refers to a measure of mass per area, in units of grams per square meter (gsm). For any of the embodiments of flexible containers, disclosed herein, in various embodiments, any of the flexible materials can be configured to have a basis weight of 10-1000 gsm, or any integer value for gsm from 10-1000, or within any range formed by any of these values, such as 20-800 gsm, 30-600 gsm, 40-400 gsm, or 50-200, etc.

As used herein, when referring to a flexible container, the term "bottom" refers to the portion of the container that is located in the lowermost 30% of the overall height of the container, that is, from 0-30% of the overall height of the container. As used herein, the term bottom can be further limited by modifying the term bottom with a particular percentage value, which is less than 30%. For any of the embodiments of flexible containers, disclosed herein, a reference to the bottom of the container can, in various alternate embodiments, refer to the bottom 25% (i.e. from 0-25% of the overall height), the bottom 20% (i.e. from 0-20% of the overall height), the bottom 15% (i.e. from 0-15% of the overall height), the bottom 10% (i.e. from 0-10% of the overall height), or the bottom 5% (i.e. from 0-5% of the overall height), or any integer value for percentage between 0% and 30%.

As used herein, the term "branding" refers to a visual element intended to distinguish a product from other products. Examples of branding include one of more of any of the following: trademarks, trade dress, logos, icons, and the like. For any of the embodiments of flexible containers, disclosed herein, in various embodiments, any surface of the flexible container can include one or more brandings of any size, shape, or configuration, disclosed herein or known in the art, in any combination.

As used herein, the term "character" refers to a visual element intended to convey information. Examples of characters include one or more of any of the following: letters, numbers, symbols, and the like. For any of the embodiments of flexible containers, disclosed herein, in various embodiments, any surface of the flexible container can include one or more characters of any size, shape, or configuration, disclosed herein or known in the art, in any combination.

As used herein, the term "closed" refers to a state of a product volume, wherein fluent products within the product volume are prevented from escaping the product volume (e.g. by one or more materials that form a barrier, and by a cap), but the product volume is not necessarily hermetically sealed. A closed product volume may or may not be sealed. For example, a closed container can include a vent, which allows a head space in the container to be in (one way or two way) fluid communication with air in the environment outside of the container.

As used herein, the term "deflation feature" refers to one or more structural features provided with a flexible container and configured for use in deflating some or all of the expanded structural support volume(s) of the flexible container, by allowing expansion material(s) inside of the structural support volume to escape into the environment, so that the structural support volume is no longer expanded. A deflation feature can be used when the flexible container is ready to be disposed of (i.e. as waste, compost, and/or recyclable material). Any of the flexible containers disclosed herein can be configured with any number of any kind of deflation feature, configured in any way disclosed herein or known in the art.

One kind of deflation feature is a cutting device, which is a rigid element that includes a point or edge configured to cut and/or pierce through flexible material(s) that form at least part of a structural support volume. As an example, a cutting device can be included with a flexible container by attaching the device to any portion of the outside (e.g. top, middle, side, bottom, etc.) of the container with adhesive, or under a label, or any other way known in the art, for externally attaching rigid elements to a container. As another example, a cutting device can be included with a flexible container by including the device with other packaging material, such as attached to an outer carton, inside of an overwrap layer, in between containers provided together, etc. As still another example, a cutting device can be included with a flexible container by including the device inside of any portion of the container, such as in a product volume, in a structural support volume, in a mixing chamber, in a dedicated space for the device, in a base structure, or any other way known in the art, for internally including rigid elements within a container. As yet another example, a cutting device can be included with a flexible container, by making the cutting device integral with or detachable from another rigid element that is part of the container, such as a rigid base structure, cap, dispenser, fitment, connecting element, reinforcing element, or any other rigid element for containers disclosed herein or known in the art. A cutting device can be configured to be any convenient size and any workable shape and can be used manually or through use of a tool. In addition to rigid elements, flexible materials that can be turned into a rigid cutting device through rolling up or folding flexible materials are also envisioned.

Another kind of deflation feature is an exit channel, which can be configured to be opened in material(s) that border or define at least a portion of the fillable space of a structural support volume. An exit channel can be an existing connection (e.g. seam, seal, or joint) in the container, which is configured to fail (e.g. separate and at least partially open) when exposed to opening forces. An exit channel can also be formed with one or more points, lines, and/or areas of weakness (e.g. thinned, scored, perforated, frangible seal, etc.), which are configured to fail or to otherwise be breached, when exposed to opening forces. An exit channel can be protected by another material, such as an adhesive label, to ensure the exit channel remains closed until the user wishes to deflate. An exit channel can further be formed by configuring the container with one or more tear initiation sites (such as a notch in an edge, a pull-tab, etc.) such that a tear propagating from the site(s) can open the flexible material. An exit channel can be configured to be any convenient size and any workable shape and can be opened manually (by grasping and pulling, by poking with a finger or fingernail, or any other way) or through use of a tool or by overpressurizing a structural support volume (through application of compressive force or controlled environmental conditions) such that the structural support volume fails when its expansion material(s) burst out.

Still another kind of deflation feature is a valve, connected to the fillable space of a structural support volume, wherein the valve can be opened to the container's environment. Embodiments of the present disclosure can use as a deflation feature, any and all embodiments of valves (including materials, structures, and/or features for valves, as well as any and all methods of making and/or using such valves), as disclosed in the following patent documents: U.S. nonprovisional patent application Ser. No. 13/379,655 filed Jun. 21, 2010, entitled "Collapsible Bottle, Method Of Manufacturing a Blank For Such Bottle and Beverage-Filled Bottle Dispensing System" in the name of Reidl, published as US2012/0097634; U.S. nonprovisional patent application Ser. No. 10/246,893 filed Sep. 19, 2002, entitled "Bubble-Seal Apparatus for Easily Opening a Sealed Package" in the name of Perell, et al., published as 20040057638; and U.S. Pat. No. 7,585,528 filed Dec. 16, 2002, entitled "Package having an inflated frame" in the name of Ferri, et al., granted on Sep. 8, 2009; each of which is hereby incorporated by reference.

As used herein, the term "directly connected" refers to a configuration wherein elements are attached to each other without any intermediate elements therebetween, except for any means of attachment (e.g. adhesive, or heat seal).

As used herein, when referring to a flexible container, the term "dispenser" refers to a structure configured to dispense fluent product(s) from a product volume and/or from a mixing volume to the environment outside of the container. For any of the flexible containers disclosed herein, any dispenser can be configured in any way disclosed herein or known in the art, including any suitable size, shape, and flow rate. For example, a dispenser can be a push-pull type dispenser, a dispenser with a flip-top cap, a dispenser with a screw-on cap, a rotatable type dispenser, dispenser with a cap, a pump type dispenser, a pump spray type dispenser, a trigger spray type dispenser, a straw dispenser, a flip up straw dispenser, a straw dispenser with bite valve, a dosing dispenser, etc. A dispenser can be a parallel dispenser, providing multiple flow channels in fluid communication with multiple product volumes, wherein those flow channels remain separate until the point of dispensing, thus allowing fluent products from multiple product volumes to be dispensed as separate fluent products, dispensed together at the same time. A dispenser can be a mixing dispenser, providing one or more flow channels in fluid communication with multiple product volumes, with multiple flow channels combined before the point of dispensing, thus allowing fluent products from multiple product volumes to be dispensed as the fluent products mixed together. As another example, a dispenser can be formed by a frangible opening. As further examples, a dispenser can utilize one or more valves and/or dispensing mechanisms disclosed in the art, such as those disclosed in: published US patent application 2003/0096068, entitled "One-way valve for inflatable package"; U.S. Pat. No. 4,988,016 entitled "Self-sealing container"; and U.S. Pat. No. 7,207,717, entitled "Package having a fluid actuated closure"; each of which is hereby incorporated by reference. Still further, any of the dispensers disclosed herein, may be incorporated into a flexible container either directly, or in combination with one or more other materials or structures (such as a fitment), or in any way known in the art. In some alternate embodiments, dispensers disclosed herein can be configured for both dispensing and filling, to allow filling of product volume(s) through one or more dispensers. In other alternate embodiments, a product volume can include one or more filling structure(s) (e.g. for adding water to a mixing volume) in addition to or instead of one or more dispenser(s). Any location for a dispenser, disclosed herein can alternatively be used as a location for a filling structure. In some embodiments, a product volume can include one or more filling structures in addition to any dispenser(s). And, any location for a dispenser, disclosed herein can alternatively be used as a location for an opening, through which product can be filled and/or dispensed, wherein the opening may be reclosable or non-reclosable, and can be configured in any way known in the art of packaging. For example, an opening can be: a line of weakness, which can be torn open; a zipper seal, which can be pulled open and pressed closed (e.g. a press seal), or opened and closed with a slider; openings with adhesive-based closures; openings with cohesive-based closures; openings with closures having fasteners (e.g. snaps, tin tie, etc.), openings with closures having micro-sized fasteners (e.g. with opposing arrays of interlocking fastening elements, such as hook, loops, and/or other mating elements, etc.), and any other kind of opening for packages or containers, with or without a closure, known in the art.

As used herein, when referring to a flexible container, the term "disposable" refers to a container which, after dispensing a product to an end user, is not configured to be refilled with an additional amount of the product, but is configured to be disposed of (i.e. as waste, compost, and/or recyclable material). Part, parts, or all of any of the embodiments of flexible containers, disclosed herein, can be configured to be disposable.

As used herein, when referring to a flexible container, the term "durable" refers to a container that is reusable more than non-durable containers.

As used herein, when referring to a flexible container, the term "effective base contact area" refers to a particular area defined by a portion of the bottom of the container, when the container (with all of its product volume(s) filled 100% with water) is standing upright and its bottom is resting on a horizontal support surface. The effective base contact area lies in a plane defined by the horizontal support surface. The effective base contact area is a continuous area bounded on all sides by an outer periphery.

The outer periphery is formed from an actual contact area and from a series of projected areas from defined cross-sections taken at the bottom of the container. The actual contact area is the one or more portions of the bottom of the container that contact the horizontal support surface, when the effective base contact area is defined. The effective base contact area includes all of the actual contact area. However, in some embodiments, the effective base contact area may extend beyond the actual contact area.

The series of projected area are formed from five horizontal cross-sections, taken at the bottom of the flexible container. These cross-sections are taken at 1%, 2%, 3%, 4%, and 5% of the overall height. The outer extent of each of these cross-sections is projected vertically downward onto the horizontal support surface to form five (overlapping) projected areas, which, together with the actual contact area, form a single combined area. This is not a summing up of the values for these areas, but is the formation of a single combined area that includes all of these (projected and actual) areas, overlapping each other, wherein any overlapping portion makes only one contribution to the single combined area.

The outer periphery of the effective base contact area is formed as described below. In the following description, the terms convex, protruding, concave, and recessed are understood from the perspective of points outside of the combined area. The outer periphery is formed by a combination of the outer extent of the combined area and any chords, which are straight line segments constructed as described below.

For each continuous portion of the combined area that has an outer perimeter with a shape that is concave or recessed, a chord is constructed across that portion. This chord is the shortest straight line segment that can be drawn tangent to the combined area on both sides of the concave/recessed portion.

For a combined area that is discontinuous (formed by two or more separate portions), one or more chords are constructed around the outer perimeter of the combined area, across the one or more discontinuities (open spaces disposed between the portions). These chords are straight lines segments drawn tangent to the outermost separate portions of the combined area. These chords are drawn to create the largest possible effective base contact area.

Thus, the outer periphery is formed by a combination of the outer extent of the combined area and any chords, constructed as described above, which all together enclose the effective base area. Any chords that are bounded by the combined area and/or one or more other chords, are not part of the outer periphery and should be ignored.

Any of the embodiments of flexible containers, disclosed herein, can be configured to have an effective base contact area from 1 to 50,000 square centimeters ($cm^2$), or any integer value for $cm^2$ between 1 and 50,000 $cm^2$, or within any range formed by any of the preceding values, such as: from 2 to 25,000 $cm^2$, 3 to 10,000 $cm^2$, 4 to 5,000 $cm^2$, 5 to 2,500 $cm^2$, from 10 to 1,000 $cm^2$, from 20 to 500 $cm^2$, from 30 to 300 $cm^2$, from 40 to 200 $cm^2$, or from 50 to 100 $cm^2$, etc.

As used herein, when referring to a flexible container, the term "expanded" refers to the state of one or more flexible materials that are configured to be formed into a structural support volume, after the structural support volume is made rigid by one or more expansion materials. An expanded structural support volume has an overall width that is significantly greater than the combined thickness of its one or more flexible materials, before the structural support volume is filled with the one or more expansion materials. Examples of expansion materials include liquids (e.g. water), gases (e.g. compressed air), fluent products, foams (that can expand after being added into a structural support volume), co-reactive materials (that produce gas), or phase change materials (that can be added in solid or liquid form, but which turn into a gas; for example, liquid nitrogen or dry ice), or other suitable materials known in the art, or combinations of any of these (e.g. fluent product and liquid nitrogen). In various embodiments, expansion materials can be added at atmospheric pressure, or added under pressure greater than atmospheric pressure, or added to provide a material change that will increase pressure to something above atmospheric pressure. For any of the embodiments of flexible containers, disclosed herein, its one or more flexible materials can be expanded at various points in time, with respect to its manufacture, sale, and use, including, for example: before or after its product volume(s) are filled with fluent product(s), before or after the flexible container is shipped to a seller, and before or after the flexible container is purchased by an end user.

As used herein, when referring to a product volume of a flexible container, the term "filled" refers to the state when the product volume contains an amount of fluent product(s) that is equal to a full capacity for the product volume, with an allowance for head space, under ambient conditions. As used herein, the term filled can be modified by using the term filled with a particular percentage value, wherein 100% filled represents the maximum capacity of the product volume.

As used herein, the term "flat" refers to a surface that is without significant projections or depressions.

As used herein, the term "flexible container" refers to a container configured to have a product volume, wherein one or more flexible materials form 50-100% of the overall surface area of the one or more materials that define the three-dimensional space of the product volume. For any of the embodiments of flexible containers, disclosed herein, in various embodiments, the flexible container can be configured to have a product volume, wherein one or more flexible materials form a particular percentage of the overall area of the one or more materials that define the three-dimensional space, and the particular percentage is any integer value for percentage between 50% and 100%, or within any range formed by any of these values, such as: 60-100%, or 70-100%, or 80-100%, or 90-100%, etc. One kind of flexible container is a film-based container, which is a flexible container made from one or more flexible materials, which include a film.

For any of the embodiments of flexible containers, disclosed herein, in various embodiments, the middle of the flexible container (apart from any fluent product) can be configured to have an overall middle mass, wherein one or more flexible materials form a particular percentage of the overall middle mass, and the particular percentage is any integer value for percentage between 50% and 100%, or within any range formed by any of the preceding values, such as: 60-100%, or 70-100%, or 80-100%, or 90-100%, etc.

For any of the embodiments of flexible containers, disclosed herein, in various embodiments, the entire flexible container (apart from any fluent product) can be configured to have an overall mass, wherein one or more flexible materials form a particular percentage of the overall mass, and the particular percentage is any integer value for percentage between 50% and 100%, or within any range formed by any of the preceding values, such as: 60-100%, or 70-100%, or 80-100%, or 90-100%, etc.

As used herein, when referring to a flexible container, the term "flexible material" refers to a thin, easily deformable, sheet-like material, having a flexibility factor within the range of 1,000-2,500,000 N/m. For any of the embodiments of flexible containers, disclosed herein, in various embodiments, any of the flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", "web" and "sheet-like material" are used interchangeably and are intended to have the same meaning. Examples of materials that can be flexible materials include one or more of any of the following: films (such as plastic film(s) comprised of polymer(s) and/or thermoplastic polymer(s)), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art.

As examples, flexible materials such as films and nonwovens, can be made from one or more thermoplastic polymers, as described herein and/or as known in the art. Thermoplastic polymers can include polyolefins such as polyethylene and/or copolymers thereof, including low density, high density, linear low density, or ultra low density polyethylenes. Polypropylene and/or polypropylene copolymers, including atactic polypropylene; isotactic polypropylene, syndiotactic polypropylene, and/or combinations thereof can also be used. Polybutylene is also a useful polyolefin.

Other suitable polymers include polyamides or copolymers thereof, such as Nylon 6, Nylon 11, Nylon 12, Nylon 46, Nylon 66; polyesters and/or copolymers thereof, such as maleic anhydride polypropylene copolymer, polyethylene terephthalate; olefin carboxylic acid copolymers such as ethylene/acrylic acid copolymer, ethylene/maleic acid copolymer, ethylene/methacrylic acid copolymer, ethylene/vinyl acetate copolymers or combinations thereof; polyacrylates, polymethacrylates, and/or their copolymers such as poly (methyl methacrylates).

Other nonlimiting examples of polymers include polyesters, polycarbonates, polyvinyl acetates, poly(oxymethylene), styrene copolymers, polyacrylates, polymethacrylates, poly(methyl methacrylates), polystyrene/methyl methacrylate copolymers, polyetherimides, polysulfones, and/or combinations thereof. In some embodiments, thermoplastic polymers can include polypropylene, polyethylene, polyamides, polyvinyl alcohol, ethylene acrylic acid, polyolefin carboxylic acid copolymers, polyesters, and/or combinations thereof.

Biodegradable thermoplastic polymers also are contemplated for use herein. Biodegradable materials are susceptible to being assimilated by microorganisms, such as molds, fungi, and bacteria when the biodegradable material is buried in the ground or otherwise contacts the microorganisms Suitable biodegradable polymers also include those biodegradable materials which are environmentally-degradable using aerobic or anaerobic digestion procedures, or by virtue of being exposed to environmental elements such as sunlight, rain, moisture, wind, temperature, and the like. The biodegradable thermoplastic polymers can be used individually or as a combination of biodegradable or non-biodegradable polymers. Biodegradable polymers include polyesters containing aliphatic components. Among the polyesters are ester polycondensates containing aliphatic constituents and poly(hydroxycarboxylic) acid. The ester polycondensates include diacids/diol aliphatic polyesters such as polybutylene succinate, polybutylene succinate co-adipate, aliphatic/aromatic polyesters such as terpolymers made of butylenes diol, adipic acid and terephthalic acid. The poly(hydroxycarboxylic) acids include lactic acid based homopolymers and copolymers, polyhydroxybutyrate (PHB), or other polyhydroxyalkanoate homopolymers and copolymers. Such polyhydroxyalkanoates include copolymers of PHB with higher chain length monomers, such as C6-C12, and higher, polyhydroxyalkanaotes, such as those disclosed in U.S. Pat. Nos. RE 36,548 and 5,990,271, polyglycolic acid, and polycaprolactone.

Non-limiting examples of suitable commercially available polymers include Basell Profax PH-835 (a 35 melt flow rate Ziegler-Natta isotactic polypropylene from Lyondell-Basell), Basell Metocene MF-650W (a 500 melt flow rate metallocene isotactic polypropylene from Lyondell-Basell), Polybond 3200 (a 250 melt flow rate maleic anhydride polypropylene copolymer from Crompton), Exxon Achieve 3854 (a 25 melt flow rate metallocene isotactic polypropylene from Exxon-Mobil Chemical), Mosten NB425 (a 25 melt flow rate Ziegler-Natta isotactic polypropylene from Unipetrol), Danimer 27510 (a polyhydroxyalkanoate polypropylene from Danimer Scientific LLC), Dow Aspun 6811A (a 27 melt index polyethylene polypropylene copolymer from Dow Chemical), and Eastman 9921 (a polyester terephthalic homopolymer with a nominally 0.81 intrinsic viscosity from Eastman Chemical), any biosourced materials for example, from Braskem, and acrylonitrile-methyl acrylate polymers, such as Barex.

A thermoplastic polymer component of a flexible material can be a single polymer species as described above or a blend of two or more thermoplastic polymers as described above.

Also as examples, flexible materials can further include one or more additives, as described herein and/or as known in the art. Non-limiting examples of classes of such additives include perfumes, dyes, pigments, nanoparticles, antistatic agents, fillers, photoactives, and other classes of additives known in the art, and combinations. The films disclosed herein can contain a single additive or a mixture of any number of additives.

Contemplated fillers include, but are not limited to inorganic fillers such as, for example, the oxides of magnesium, aluminum, silicon, and titanium. These materials can be added as inexpensive fillers or processing aides. Other inorganic materials that can function as fillers include hydrous magnesium silicate, titanium dioxide, calcium carbonate, clay, chalk, boron nitride, limestone, diatomaceous earth, mica glass quartz, and ceramics. Additionally, inorganic salts, including alkali metal salts, alkaline earth metal salts, phosphate salts, can be used. Additionally, alkyd resins can also be added as fillers. Alkyd resins can comprise a polyol, a polyacid or anhydride, and/or a fatty acid.

Additional contemplated additives include nucleating and clarifying agents for the thermoplastic polymer. Specific examples, suitable for polypropylene, for example, are benzoic acid and derivatives (e.g. sodium benzoate and lithium benzoate), as well as kaolin, talc and zinc glycerolate. Dibenzlidene sorbitol (DBS) is an example of a clarifying agent that can be used. Other nucleating agents that can be used are organocarboxylic acid salts, sodium phosphate and metal salts (for example aluminum dibenzoate).

Contemplated nanoparticles include metals, metal oxides, allotropes of carbon, clays, organically modified clays, sulfates, nitrides, hydroxides, oxy/hydroxides, particulate water-insoluble polymers, silicates, phosphates, and carbonates. Examples include silicon dioxide, carbon black, graphite, graphene, fullerenes, expanded graphite, carbon nanotubes, talc, calcium carbonate, bentonite, montmorillonite, kaolin, zinc glycerolate, silica, aluminosilicates, boron nitride, aluminum nitride, barium sulfate, calcium sulfate, antimony oxide, feldspar, mica, nickel, copper, iron, cobalt, steel, gold, silver, platinum, aluminum, wollastonite, aluminum oxide, zirconium oxide, titanium dioxide, cerium oxide, zinc oxide, magnesium oxide, tin oxide, iron oxides ($Fe_2O_3$, $Fe_3O_4$) and mixtures thereof.

Thermoplastic polymers, and their variations, as disclosed herein can be formed into a film and can comprise many different configurations, depending on the film properties desired. The properties of the film can be manipulated by varying, for example, the thickness, or in the case of multilayered films, the number of layers, the chemistry of the layers, i.e., hydrophobic or hydrophilic, and the types of polymers used to form the polymeric layers. The films disclosed herein can be multi-layer films. The film can have at least two layers (e.g., a first film layer and a second film layer). The first film layer and the second film layer can be layered adjacent to each other to form the multi-layer film, such as in partial co-facial arrangement where the first film overlies in part the second film, or a completely co-facial arrangement where the first film overlies in part the second film. A multi-layer film can have at least three layers (e.g., a first film layer, a second film layer and a third film layer). The second film layer can at least partially overlie in partial co-facial arrangement at least one of an upper surface or a lower surface of the first film layer. The third film layer can at least partially overlie in partial co-facial arrangement the second film layer such that the second film layer forms a core layer. It is contemplated that multi-layer films can include additional layers (e.g., binding layers, non-permeable layers, etc.). It will be appreciated that multi-layer films can comprise from about 2 layers to about 1000 layers; in certain embodiments from about 3 layers to about 200 layers; and in certain embodiments from about 5 layers to about 100 layers, or any integer value for number of layers, in any of these ranges. For multi-layer films, each respective layer can be made from any material disclosed herein or known in the art, in any manner disclosed herein or known in the art.

A multi-layer film can include a 3-layer arrangement wherein a first film layer and a third film layer form the skin layers and a second film layer is formed between the first film layer and the third film layer to form a core layer. The third film layer can be the same or different from the first film layer, such that the third film layer can comprise a composition as described herein. It will be appreciated that similar film layers could be used to form multi-layer films having more than 3 layers. One embodiment for using multi-layer films is to control the location of the oil. For example, in a 3 layer film, the core layer may contain the oil while the outer layer do not. Alternatively, the inner layer may not contain oil and the outer layers do contain oil.

If incompatible layers are to be adjacent in a multi-layer film, a tie layer can be positioned between them. The purpose of the tie layer is to provide a transition and adequate adhesion between incompatible materials. An adhesive or tie layer is typically used between layers of layers that exhibit delamination when stretched, distorted, or deformed. The delamination can be either microscopic separation or macroscopic separation. In either event, the performance of the film may be compromised by this delamination. Consequently, a tie layer that exhibits adequate adhesion between the layers is used to limit or eliminate this delamination.

A tie layer is generally useful between incompatible materials. For instance, when a polyolefin and a copoly (ester-ether) are the adjacent layers, a tie layer is generally useful.

The tie layer is chosen according to the nature of the adjacent materials, and is compatible with and/or identical to one material (e.g. nonpolar and hydrophobic layer) and a reactive group which is compatible or interacts with the second material (e.g. polar and hydrophilic layer).

Suitable backbones for the tie layer include polyethylene (low density—LDPE, linear low density—LLDPE, high density—HDPE, and very low density—VLDPE) and polypropylene. The reactive group may be a grafting monomer that is grafted to this backbone, and is or contains at least one alpha- or beta-ethylenically unsaturated carboxylic acid or anhydrides, or a derivative thereof. Examples of such carboxylic acids and anhydrides, which maybe mono-, di-, or polycarboxylic acids, are acrylic acid, methacrylic acid, maleic acid, fumaric acid, itaconic acid, crotonic acid, itaconic anhydride, maleic anhydride, and substituted malic anhydride, e.g. dimethyl maleic anhydride. Examples of derivatives of the unsaturated acids are salts, amides, imides and esters e.g. mono- and disodium maleate, acrylamide, maleimide, and diethyl fumarate.

A particularly tie layer is a low molecular weight polymer of ethylene with about 0.1 to about 30 weight percent of one or more unsaturated monomers which can be copolymerized with ethylene, e.g., maleic acid, fumaric acid, acrylic acid, methacrylic acid, vinyl acetate, acrylonitrile, methacrylonitrile, butadiene, carbon monoxide, etc. Exemplary embodiments are acrylic esters, maleic anhydride, vinyl acetate, and methyacrylic acid. Anhydrides can be used as grafting monomers, for example maleic anhydride can be used.

An exemplary class of materials suitable for use as a tie layer is a class of materials known as anhydride modified ethylene vinyl acetate sold by DuPont under the tradename Bynel®, e.g., Bynel® 3860. Another material suitable for use as a tie layer is an anhydride modified ethylene methyl acrylate also sold by DuPont under the tradename Bynel®, e.g., Bynel® 2169. Maleic anhydride graft polyolefin polymers suitable for use as tie layers are also available from Elf Atochem North America, Functional Polymers Division, of Philadelphia, Pa. as Orevac™.

Alternatively, a polymer suitable for use as a tie layer material can be incorporated into the composition of one or more of the layers of the films as disclosed herein. By such incorporation, the properties of the various layers are modified so as to improve their compatibility and reduce the risk of delamination.

Other intermediate layers besides tie layers can be used in the multi-layer film disclosed herein. For example, a layer of a polyolefin composition can be used between two outer layers of a hydrophilic resin to provide additional mechanical strength to the extruded web. Any number of intermediate layers may be used.

Examples of suitable thermoplastic materials for use in forming intermediate layers include polyethylene resins such as low density polyethylene (LDPE), linear low density polyethylene (LLDPE), ethylene vinyl acetate (EVA), ethylene methyl acrylate (EMA), polypropylene, and poly (vinyl chloride). Polymeric layers of this type can have mechanical properties that are substantially equivalent to those described above for the hydrophobic layer.

In addition to being formed from the compositions described herein, the films can further include additional additives. For example, opacifying agents can be added to one or more of the film layers. Such opacifying agents can include iron oxides, carbon black, aluminum, aluminum oxide, titanium dioxide, talc and combinations thereof. These opacifying agents can comprise about 0.1% to about 5% by weight of the film; and in certain embodiments, the opacifying agents can comprise about 0.3% to about 3% of the film. It will be appreciated that other suitable opacifying agents can be employed and in various concentrations. Examples of opacifying agents are described in U.S. Pat. No. 6,653,523.

Furthermore, the films can comprise other additives, such as other polymers materials (e.g., a polypropylene, a polyethylene, a ethylene vinyl acetate, a polymethylpentene any combination thereof, or the like), a filler (e.g., glass, talc, calcium carbonate, or the like), a mold release agent, a flame retardant, an electrically conductive agent, an anti-static agent, a pigment, an antioxidant, an impact modifier, a stabilizer (e.g., a UV absorber), wetting agents, dyes, a film anti-static agent or any combination thereof. Film antistatic agents include cationic, anionic, and/or, nonionic agents. Cationic agents include ammonium, phosphonium and sulphonium cations, with alkyl group substitutions and an associated anion such as chloride, methosulphate, or nitrate. Anionic agents contemplated include alkylsulphonates. Nonionic agents include polyethylene glycols, organic stearates, organic amides, glycerol monostearate (GMS), alkyl di-ethanolamides, and ethoxylated amines. Other filler materials can comprise fibers, structural reinforcing agents, and all types of biosourced materials such as oils (hydrogenated soy bean oil), fats, starch, etc.

For any of the flexible materials, materials that are safe/approved for food contact may be selected. Additionally, materials that are approved for medical usage, or materials that can be sterilized through retort, autoclave, or radiation treatment, or other sterilization processes known in the art, may be used.

In various embodiments, part, parts, or all of a flexible material can be coated or uncoated, treated or untreated, processed or unprocessed, in any manner known in the art. In various embodiments, parts, parts, or about all, or approximately all, or substantially all, or nearly all, or all of a flexible material can made of sustainable, bio-sourced, recycled, recyclable, and/or biodegradable material. Part, parts, or about all, or approximately all, or substantially all, or nearly all, or all of any of the flexible materials described herein can be partially or completely translucent, partially or completely transparent, or partially or completely opaque.

With regard to films and elastomers for use as flexible materials, these can be formed in any manner known in the art, such as casting, extruding (blown or flat; singly or with coextrusion), calendering, depositing solution(s), skiving, etc. then slitting, cutting, and/or converting the films and/or elastomers into the desired sizes or shapes, as sheets or webs, as will be understood by one skilled in the art. With regard to blown films, multiple processes can be used including: collapsed bubble to create a blocked film, and double and or triple bubble processes. Flexible materials may further be subjected to any number or orienting, tenter frame, tenter hook, stretching, or activation processes. With regard to foamed sheets for use as flexible materials, these can be formed in any manner known in the art, by mixing base ingredients, adding the foaming mixture to a mold or shaping apparatus, then curing, cutting, and/or converting the foam into the desired sizes or shapes, as sheets or webs. With regard to nonwoven fabrics, these can be formed in any manner known in the art using spunbonded fibers and/or meltblown fibers, staple-length and/or continuous fibers, with any layering, mixing, or other combination known in the art. Other materials listed herein for use as flexible materials can be made in any manner known in the art.

The flexible materials used to make the containers disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these.

As used herein, when referring to a flexible container, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, when referring to a flexible container, the term "fluent product" refers to one or more liquids and/or pourable solids, and combinations thereof. Examples of fluent products include one or more of any of the following: bites, bits, creams, chips, chunks, crumbs, crystals, emulsions, flakes, gels, grains, granules, jellies, kibbles, liquid solutions, liquid suspensions, lotions, nuggets, ointments, particles, particulates, pastes, pieces, pills, powders, salves, shreds, sprinkles, and the like, either individually or in any combination. Throughout the present disclosure the terms "fluent product" and "flowable product" are used interchangeably and are intended to have the same meaning. Any of the product volumes disclosed herein can be configured to include one or more of any fluent product disclosed herein, or known in the art, in any combination.

As used herein, when referring to a flexible container, the term "formed" refers to the state of one or more materials that are configured to be formed into a product volume, after the product volume is provided with its defined three-dimensional space.

As used herein, the term "graphic" refers to a visual element intended to provide a decoration or to communicate information. Examples of graphics include one or more of any of the following: colors, patterns, designs, images, and the like. For any of the embodiments of flexible containers, disclosed herein, in various embodiments, any surface of the flexible container can include one or more graphics of any size, shape, or configuration, disclosed herein or known in the art, in any combination.

As used herein, the term "gusset" refers to a flexible container that includes at least three folds in the flexible material defining one or more a central folds that extend inwardly toward the interior of the product volume and two folds disposed on opposite sides of the central fold, the two folds extending outwardly away from the central fold. Gussets are also variously known as tucks, pleats, joints, couplings, and gatherings. Gussets can be arranged to provide stability in a flexible container, for example, by creating a face for the flexible container to rest on. Gussets can also be used to increase the volume of the flexible container, for example by creating a more 3D shape rather than a 2D shape from a flexible material. A flexible container can include one or more gussets disposed at any portion of the container, such as the bottom, top, and/or one or more sides of the container. A gusset can be formed from a continuous portion of the flexible material defining the package. Such a gusset is referred to herein as "continuous gusset." Continuous gussets can be formed by tucking and/or folding a web or sheet such that the flexible material flows uninterrupted throughout the gusset. A gusset can also be formed from non-continuous portions of the flexible material defining the package. Such a gusset is referred to herein as an "interrupted gusset" and includes one or more seals disposed in the gusset. The seal can be disposed in any portion of the interrupted gusset, including, for example, along any portion of an outward extension or an inward extension. The seal formed in the interrupted gusset can be any type of seal, including for example a fin seal, or a non-fin seal such as a lap seal, a cut seal, and/or a bead seal.

In various embodiments, a flexible container gusset can remain intact and serviceable during its expected lifetime including its manufacture, distribution, retail, shipment, and end use. In various embodiments, a gusset can be non-frangible, with the gusset not comprising any element or feature for opening, closing, or sealing the flexible container.

As used herein, when referring to a flexible container, the term "height area ratio" refers to a ratio for the container, with units of per centimeter ($cm^{-1}$), which is equal to the value for the overall height of the container (with all of its product volume(s) filled 100% with water, and with overall height measured in centimeters) divided by the value for the effective base contact area of the container (with all of its product volume(s) filled 100% with water, and with effective base contact area measured in square centimeters). For any of the embodiments of flexible containers, disclosed herein, in various embodiments, any of the flexible containers, can be configured to have a height area ratio from 0.3 to 3.0 per centimeter, or any value in increments of 0.05 $cm^{-1}$ between 0.3 and 3.0 per centimeter, or within any range formed by any of the preceding values, such as: from 0.35 to 2.0 $cm^{-1}$, from 0.4 to 1.5 $cm^{-1}$, from 0.4 to 1.2 $cm^{-1}$, or from 0.45 to 0.9 $cm^{-1}$, etc.

As used herein, the term "indicia" refers to one or more of characters, graphics, branding, or other visual elements, in any combination. For any of the embodiments of flexible containers, disclosed herein, in various embodiments, any surface of the flexible container can include one or more indicia of any size, shape, or configuration, disclosed herein or known in the art, in any combination.

As used herein, the term "indirectly connected" refers to a configuration wherein elements are attached to each other with one or more intermediate elements therebetween.

As used herein, the term "joined" refers to a configuration wherein elements are either directly connected or indirectly connected.

As used herein, the term "lateral" refers to a direction, orientation, or measurement that is parallel to a lateral centerline of a container, when the container is standing upright on a horizontal support surface, as described herein. A lateral orientation may also be referred to a "horizontal" orientation, and a lateral measurement may also be referred to as a "width."

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with a differing first digit, wherein that first digit matches the number for its figure; as an example, an element of FIG. 3 labeled 320 and an element of FIG. 4 labeled 420 are like-numbered. Like-numbered elements can have labels with a suffix (i.e. the portion of the label following the dash symbol) that is the same or possibly different (e.g. corresponding with a particular embodiment); for example, a first embodiment of an element in FIG. 3A labeled 320-*a* and a second embodiment of an element in FIG. 3B labeled 320-*b*, are like numbered.

As used herein, the term "longitudinal" refers to a direction, orientation, or measurement that is parallel to a longitudinal centerline of a container, when the container is standing upright on a horizontal support surface, as described herein. A longitudinal orientation may also be referred to a "vertical" orientation. When expressed in relation to a horizontal support surface for a container, a longitudinal measurement may also be referred to as a "height", measured above the horizontal support surface.

As used herein, when referring to a flexible container, the term "middle" refers to the portion of the container that is located in between the top of the container and the bottom of the container. As used herein, the term middle can be modified by describing the term middle with reference to a particular percentage value for the top and/or a particular percentage value for the bottom. For any of the embodiments of flexible containers, disclosed herein, a reference to the middle of the container can, in various alternate embodiments, refer to the portion of the container that is located between any particular percentage value for the top, disclosed herein, and/or any particular percentage value for the bottom, disclosed herein, in any combination.

As used herein, the term "mixing volume" refers to a type product volume that is configured to receive one or more fluent product(s) from one or more product volumes and/or from the environment outside of the container.

As used herein, when referring to a product volume, the term "multiple dose" refers to a product volume that is sized to contain a particular amount of product that is about equal to two or more units of typical consumption, application, or use by an end user. Any of the embodiments of flexible containers, disclosed herein, can be configured to have one or more multiple dose product volumes. A container with only one product volume, which is a multiple dose product volume, is referred to herein as a "multiple dose container."

As used herein, the term "nearly" modifies a particular value, by referring to a range equal to the particular value, plus or minus five percent (+/−5%). For any of the embodiments of flexible containers, disclosed herein, any disclosure of a particular value, can, in various alternate embodiments, also be understood as a disclosure of a range equal to approximately that particular value (i.e. +/−5%).

As used herein, when referring to a flexible container, the term "non-durable" refers to a container that is temporarily reusable, or disposable, or single use.

As used herein, when referring to a flexible container, the term "non-fluent product" refers to materials, products, and/or articles that are not liquids, pourable solids, or combinations or liquids and pourable solids. Any of the flexible containers disclosed herein can be configured for packaging one or more of any non-fluent product disclosed herein, or known in the art, in any combination. When used for non-fluent products, flexible containers, as disclosed herein, can provide benefits associated with partly or fully supporting and/or enclosing the non-fluent product with primary and/or secondary packaging that includes one or more structural support volumes, one or more structural support members, and/or one or more structural support frames; for example, so the non-fluent product can be supported and/or enclosed by packaging that is self-supporting and/or standing upright, as will be understood by one skilled in the art.

As used herein, when referring to a flexible container, the term "nonstructural panel" refers to a layer of one or more adjacent sheets of flexible material, the layer having an outermost major surface that faces outward, toward the environment outside of the flexible container, and an innermost major surface that faces inward, toward product volume(s) disposed within the flexible container; a nonstructural panel is configured such that, the layer, does not independently provide substantial support in making the container self-supporting and/or standing upright.

As used herein, when referring to a flexible container, the term "overall height" refers to a distance that is measured while the container is standing upright on a horizontal support surface, the distance measured vertically from the upper side of the support surface to a point on the top of the container, which is farthest away from the upper side of the support surface. Any of the embodiments of flexible containers, disclosed herein, can be configured to have an overall height from 2.0 cm to 100.0 cm, or any value in increments of 0.1 cm between 2.0 and 100.0 cm, or within any range formed by any of the preceding values, such as: from 4.0 to 90.0 cm, from 5.0 to 80.0 cm, from 6.0 to 70.0 cm, from 7.0 to 60.0 cm, from 8.0 to 50.0 cm, from 9.0 to 40.0 cm, or from 10.0 to 30.0, etc.

As used herein, when referring to a sheet of flexible material, the term "overall thickness" refers to a linear dimension measured perpendicular to the outer major surfaces of the sheet, when the sheet is lying flat. For any of the embodiments of flexible containers, disclosed herein, in various embodiments, any of the flexible materials can be configured to have an overall thickness 5-500 micrometers (μm), or any integer value for micrometers from 5-500, or within any range formed by any of these values, such as 10-500 μm, 20-400 μm, 30-300 μm, 40-200 μm, 50-100 μm, or 50-150 μm, etc.

As used herein, the term "product volume" refers to an enclosable three-dimensional space that is configured to receive and directly contain one or more fluent product(s), wherein that space is defined by one or more materials that form a barrier that prevents the fluent product(s) from escaping the product volume. By directly containing the one or more fluent products, the fluent products come into contact with the materials that form the enclosable three-dimensional space; there is no intermediate material or container, which prevents such contact. Throughout the present disclosure the terms "product volume" and "product receiving volume" are used interchangeably and are intended to have the same meaning. Any of the embodiments of flexible containers, disclosed herein, can be configured to have any number of product volumes including one product volume, two product volumes, three product volumes, four product volumes, five product volumes, six product volumes, or even more product volumes. In some embodiments, one or more product volumes can be enclosed within another product volume. Any of the product volumes disclosed herein can have a product volume of any size, including from 0.001 liters to 100.0 liters, or any value in increments of 0.001 liters between 0.001 liters and 3.0 liters, or any value in increments of 0.01 liters between 3.0 liters and 10.0 liters, or any value in increments of 1.0 liters between 10.0 liters and 100.0 liters, or within any range formed by any of the preceding values, such as: from 0.001 to 2.2 liters, 0.01 to 2.0 liters, 0.05 to 1.8 liters, 0.1 to 1.6 liters, 0.15 to 1.4 liters, 0.2 to 1.2 liters, 0.25 to 1.0 liters, etc. A product volume can have any shape in any orientation. A product volume can be included in a container that has a structural support frame, and a product volume can be included in a container that does not have a structural support frame.

As used herein, when referring to a flexible container, the term "resting on a horizontal support surface" refers to the container resting directly on the horizontal support surface, without other support.

As used herein, the term "sealed," when referring to a product volume, refers to a state of the product volume wherein fluent products within the product volume are prevented from escaping the product volume (e.g. by one or more materials that form a barrier, and by a seal), and the product volume is hermetically sealed.

As used herein, when referring to a flexible container, the term "self-supporting" refers to a container that includes a product volume and a structural support frame, wherein, when the container is resting on a horizontal support surface, in at least one orientation, the structural support frame is configured to prevent the container from collapsing and to give the container an overall height that is significantly greater than the combined thickness of the materials that form the container, even when the product volume is unfilled. Any of the embodiments of flexible containers, disclosed herein, can be configured to be self-supporting. As examples, self-supporting flexible containers of the present disclosure can be used to form pillow packs, pouches, doy packs, sachets, tubes, boxes, tubs, cartons, flow wraps, gusseted packs, jugs, bottles, jars, bags in boxes, trays, hanging packs, blister packs, or any other forms known in the art.

As used herein, when referring to a flexible container, the term "single use" refers to a closed container which, after being opened by an end user, is not configured to be reclosed. Any of the embodiments of flexible containers, disclosed herein, can be configured to be single use.

As used herein, when referring to a product volume, the term "single dose" refers to a product volume that is sized to contain a particular amount of product that is about equal to one unit of typical consumption, application, or use by an end user. Any of the embodiments of flexible containers, disclosed herein, can be configured to have one or more single dose product volumes. A container with only one product volume, which is a single dose product volume, is referred to herein as a "single dose container."

As used herein, when referring to a flexible container, the terms "stand up," "stands up," "standing up", "stand upright", "stands upright", and "standing upright" refer to a particular orientation of a self-supporting flexible container, when the container is resting on a horizontal support surface. This standing upright orientation can be determined from the structural features of the container and/or indicia on the container. In a first determining test, if the flexible container has a clearly defined base structure that is configured to be used on the bottom of the container, then the container is determined to be standing upright when this base structure is resting on the horizontal support surface. If the first test cannot determine the standing upright orientation, then, in a second determining test, the container is determined to be standing upright when the container is oriented to rest on the horizontal support surface such that the indicia on the flexible container are best positioned in an upright orientation. If the second test cannot determine the standing upright orientation, then, in a third determining test, the container is determined to be standing upright when the container is oriented to rest on the horizontal support surface such that the container has the largest overall height. If the third test cannot determine the standing upright orientation, then, in a fourth determining test, the container is determined to be standing upright when the container is oriented to rest on the horizontal support surface such that the container has the largest height area ratio. If the fourth test cannot determine the standing upright orientation, then, any orientation used in the fourth determining test can be considered to be a standing upright orientation.

As used herein, when referring to a flexible container, the term "stand up container" refers to a self-supporting container, wherein, when the container (with all of its product volume(s) filled 100% with water) is standing up, the container has a height area ratio from 0.4 to 1.5 $cm^{-1}$. Any of the embodiments of flexible containers, disclosed herein, can be configured to be stand up containers.

As used herein, when referring to a flexible container, the term "structural support frame" refers to a rigid structure formed of one or more structural support members, joined together, around one or more sizable empty spaces and/or one or more nonstructural panels, and generally used as a major support for the product volume(s) in the flexible container and in making the container self-supporting and/or standing upright. In each of the embodiments disclosed herein, when a flexible container includes a structural support frame and one or more product volumes, the structural support frame is considered to be supporting the product volumes of the container, unless otherwise indicated.

As used herein, when referring to a flexible container, the term "structural support member" refers to a rigid, physical structure, which includes one or more expanded structural support volumes, and which is configured to be used in a structural support frame, to carry one or more loads (from the flexible container) across a span. A structure that does not include at least one expanded structural support volume, is not considered to be a structural support member, as used herein.

A structural support member has two defined ends, a middle between the two ends, and an overall length from its one end to its other end. A structural support member can have one or more cross-sectional areas, each of which has an overall width that is less than its overall length.

A structural support member can be configured in various forms. A structural support member can include one, two, three, four, five, six or more structural support volumes, arranged in various ways. For example, a structural support member can be formed by a single structural support volume. As another example, a structural support member can be formed by a plurality of structural support volumes, disposed end to end, in series, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other. As a further example, a structural support member can be formed by a plurality of support volumes disposed side by side, in parallel, wherein, in various embodiments, part, parts, or about all, or approximately all, or substantially all, or nearly all, or all of some or all of the structural support volumes can be partly or fully in contact with each other, partly or fully directly connected to each other, and/or partly or fully joined to each other.

In some embodiments, a structural support member can include a number of different kinds of elements. For example, a structural support member can include one or more structural support volumes along with one or more mechanical reinforcing elements (e.g. braces, collars, connectors, joints, ribs, etc.), which can be made from one or more rigid (e.g. solid) materials.

Structural support members can have various shapes and sizes. Part, parts, or about all, or approximately all, or substantially all, or nearly all, or all of a structural support member can be straight, curved, angled, segmented, or other shapes, or combinations of any of these shapes. Part, parts, or about all, or approximately all, or substantially all, or nearly all, or all of a structural support member can have any suitable cross-sectional shape, such as circular, oval, square, triangular, star-shaped, or modified versions of these shapes, or other shapes, or combinations of any of these shapes. A structural support member can have an overall shape that is tubular, or convex, or concave, along part, parts, or about all, or approximately all, or substantially all, or nearly all, or all of a length. A structural support member can have any suitable cross-sectional area, any suitable overall width, and any suitable overall length. A structural support member can be substantially uniform along part, parts, or about all, or approximately all, or substantially all, or nearly all, or all of its length, or can vary, in any way described herein, along part, parts, or about all, or approximately all, or substantially all, or nearly all, or all of its length. For example, a cross-sectional area of a structural support member can increase or decrease along part, parts, or all of its length. Part, parts, or all of any of the embodiments of structural support members of the present disclosure, can be configured according to any embodiment disclosed herein, including any workable combination of structures, features, materials, and/or connections from any number of any of the embodiments disclosed herein.

As used herein, when referring to a flexible container, the term "structural support volume" refers to a fillable space made from one or more flexible materials, wherein the space is configured to be at least partially filled with one or more expansion materials, which create tension in the one or more flexible materials, and form an expanded structural support volume. One or more expanded structural support volumes can be configured to be included in a structural support member. A structural support volume is distinct from structures configured in other ways, such as: structures without a fillable space (e.g. an open space), structures made from inflexible (e.g. solid) materials, structures with spaces that are not configured to be filled with an expansion material (e.g. an unattached area between adjacent layers in a multilayer panel), and structures with flexible materials that are not configured to be expanded by an expansion material (e.g. a space in a structure that is configured to be a non-structural panel). Notably, in various embodiments, any spaces defined by the unattached area between adjacent layers in a multi-layer panel may contain any gas or vapor composition of single or multiple chemistries including air, nitrogen or a gas composition comprising, as examples, greater than 80% nitrogen, greater than 20% carbon dioxide, greater than 10% of a noble gas, less than 15% oxygen; the gas or vapor contained in such spaces may include water vapor at a relative humidity of 0-100%, or any integer percentage value in this range. Throughout the present disclosure the terms "structural support volume" and "expandable chamber" are used interchangeably and are intended to have the same meaning.

In some embodiments, a structural support frame can include a plurality of structural support volumes, wherein some of or all of the structural support volumes are in fluid communication with each other. In other embodiments, a structural support frame can include a plurality of structural support volumes, wherein some of or none of the structural support volumes are in fluid communication with each other. Any of the structural support frames of the present disclosure can be configured to have any kind of fluid communication disclosed herein.

As used herein, the term "substantially" modifies a particular value, by referring to a range equal to the particular value, plus or minus ten percent (+/−10%). For any of the embodiments of flexible containers, disclosed herein, any disclosure of a particular value, can, in various alternate embodiments, also be understood as a disclosure of a range equal to approximately that particular value (i.e. +/−10%).

As used herein, when referring to a flexible container, the term "temporarily reusable" refers to a container which, after dispensing a product to an end user, is configured to be refilled with an additional amount of a product, up to ten times, before the container experiences a failure that renders it unsuitable for receiving, containing, or dispensing the product. As used herein, the term temporarily reusable can be further limited by modifying the number of times that the container can be refilled before the container experiences such a failure. For any of the embodiments of flexible containers, disclosed herein, a reference to temporarily reusable can, in various alternate embodiments, refer to temporarily reusable by refilling up to eight times before failure, by refilling up to six times before failure, by refilling up to four times before failure, or by refilling up to two times before failure, or any integer value for refills between one and ten times before failure. Any of the embodiments of flexible containers, disclosed herein, can be configured to be temporarily reusable, for the number of refills disclosed herein.

As used herein, the term "thickness" refers to a measurement that is parallel to a third centerline of a container, when the container is standing upright on a horizontal support surface, as described herein. A thickness may also be referred to as a "depth."

As used herein, when referring to a flexible container, the term "top" refers to the portion of the container that is located in the uppermost 20% of the overall height of the container, that is, from 80-100% of the overall height of the container. As used herein, the term top can be further limited by modifying the term top with a particular percentage value, which is less than 20%. For any of the embodiments of flexible containers, disclosed herein, a reference to the top of the container can, in various alternate embodiments, refer to the top 15% (i.e. from 85-100% of the overall height), the top 10% (i.e. from 90-100% of the overall height), or the top 5% (i.e. from 95-100% of the overall height), or any integer value for percentage between 0% and 20%.

As used herein, when referring to a flexible container, the term "unexpanded" refers to the state of one or more materials that are configured to be formed into a structural support volume, before the structural support volume is made rigid by an expansion material.

As used herein, when referring to a product volume of a flexible container, the term "unfilled" refers to the state of the product volume when it does not contain a fluent product.

As used herein, when referring to a flexible container, the term "unformed" refers to the state of one or more materials that are configured to be formed into a product volume, before the product volume is provided with its defined three-dimensional space. For example, an article of manufacture could be a container blank with an unformed product volume, wherein sheets of flexible material, with portions joined together, are laying flat against each other.

Flexible containers, as described herein, may be used across a variety of industries for a variety of products. For example, any embodiment of flexible containers, as described herein, may be used across the consumer products industry, including any of the following products, any of which can take any workable fluent product form described herein or known in the art: baby care products (e.g. soaps, shampoos, and lotions); beauty care products for cleaning, treating, beautifying, and/or decorating human or animal hair (e.g. hair shampoos, hair conditioners, hair dyes, hair colorants, hair repair products, hair growth products, hair removal products, hair minimization products, etc.); beauty care products for cleaning, treating, beautifying, and/or decorating human or animal skin (e.g. soaps, body washes, body scrubs, facial cleansers, astringents, sunscreens, sun block lotions, lip balms, cosmetics, skin conditioners, cold creams, skin moisturizers, antiperspirants, deodorants, etc.); beauty care products for cleaning, treating, beautifying, and/or decorating human or animal nails (e.g. nail polishes, nail polish removers, etc.); grooming products for cleaning, treating, beautifying, and/or decorating human facial hair (e.g. shaving products, pre-shaving products, after shaving products, etc.); health care products for cleaning, treating, beautifying, and/or decorating human or animal oral cavities (e.g. toothpaste, mouthwash, breath freshening products, anti-plaque products, tooth whitening products, etc.); health care products for treating human and/or animal health conditions (e.g. medicines, medicaments, pharmaceuticals, vitamins, nutraceuticals, nutrient supplements (for calcium, fiber, etc.), cough treatment products, cold remedies, lozenges, treatments for respiratory and/or allergy conditions, pain relievers, sleep aids, gastrointestinal treatment products (for heartburn, upset stomach, diarrhea, irritable bowel syndrome, etc.), purified water, treated water, etc.); pet care products for feeding and/or caring for animals (e.g. pet food, pet vitamins, pet medicines, pet chews, pet treats, etc.); fabric care products for cleaning, conditioning, refreshing and/or treating fabrics, clothes and/or laundry (e.g. laundry detergents, fabric conditioners, fabric dyes, fabric bleaches, etc.); dish care products for home, commercial, and/or industrial use (e.g. dish soaps and rinse aids for hand-washing and/or machine washing); cleaning and/or deodorizing products for home, commercial, and/or industrial use (e.g. soft surface cleaners, hard surface cleaners, glass cleaners, ceramic tile cleaners, carpet cleaner, wood cleaners, multi-surface cleaners, surface disinfectants, kitchen cleaners, bath cleaners (e.g. sink, toilet, tub, and/or shower cleaners), appliance cleaning products, appliance treatment products, car cleaning products, car deodorizing products, air cleaners, air deodorizers, air disinfectants, etc.), and the like.

As further examples, any embodiment of flexible containers, as described herein, may be used across additional areas of home, commercial, and/or industrial, building and/or grounds, construction and/or maintenance, including any of the following products, any of which can take any workable fluent product form (e.g. liquid, granular, powdered, etc.) described herein or known in the art: products for establishing, maintaining, modifying, treating, and/or improving lawns, gardens, and/or grounds (e.g. grass seeds, vegetable seeds, plant seeds, birdseed, other kinds of seeds, plant food, fertilizer, soil nutrients and/or soil conditions (e.g. nitrogen, phosphate, potash, lime, etc.), soil sterilants, herbicides, weed preventers, pesticides, pest repellents, insecticides, insect repellents, etc.); products for landscaping use (e.g. topsoils, potting soils, general use soils, mulches, wood chips, tree bark nuggets, sands, natural stones and/or rocks (e.g. decorative stones, pea gravel, gravel, etc.) of all kinds, man-made compositions based on stones and rocks (e.g. paver bases, etc.)); products for starting and/or fueling fires in grills, fire pits, fireplaces, etc. (e.g. fire logs, fire starting nuggets, charcoal, lighter fluid, matches, etc.); lighting products (e.g. light bulbs and light tubes or all kinds including: incandescents, compact fluorescents, fluorescents, halogens, light emitting diodes, of all sizes, shapes, and uses); chemical products for construction, maintenance, remodeling, and/or decorating (e.g. concretes, cements, mortars, mix colorants, concrete curers/sealants, concrete protectants, grouts, blacktop sealants, crack filler/repair products, spackles, joint compounds, primers, paints, stains, topcoats, sealants, caulks, adhesives, epoxies, drain cleaning/declogging products, septic treatment products, etc.); chemical products (e.g. thinners, solvents, and strippers/removers including alcohols, mineral spirits, turpentines, linseed oils, etc.); water treatment products (e.g. water softening products such as salts, bacteriostats, fungicides, etc.); fasteners of all kinds (e.g. screws, bolts, nuts, washers, nails, staples, tacks, hangers, pins, pegs, rivets, clips, rings, and the like, for use with/in/on wood, metal, plastic, concrete, concrete, etc.); and the like.

As further examples, any embodiment of flexible containers, as described herein, may be used across the food and beverage industry, including any of the following products, any of which can take any workable fluent product form described herein or known in the art: foods such as basic ingredients (e.g. grains such as rice, wheat, corn, beans, and derivative ingredients made from any of these, as well as nuts, seeds, and legumes, etc.), cooking ingredients (e.g. sugar, spices such as salt and pepper, cooking oils, vinegars, tomato pastes, natural and artificial sweeteners, flavorings, seasonings, etc.), baking ingredients (e.g. baking powders, starches, shortenings, syrups, food colorings, fillings, gelatins, chocolate chips and other kinds of chips, frostings, sprinkles, toppings, etc.), dairy foods (e.g. creams, yogurts, sour creams, wheys, caseins, etc.), spreads (e.g. jams, jellies, etc.), sauces (e.g. barbecue sauces, salad dressings, tomato sauces, etc.), condiments (e.g. ketchups, mustards, relishes, mayonnaises, etc.), processed foods (noodles and pastas, dry cereals, cereal mixes, premade mixes, snack chips and snacks and snack mixes of all kinds, pretzels, crackers, cookies, candies, chocolates of all kinds, marshmallows, puddings, etc.); beverages such as water, milks, juices, flavored and/or carbonated beverages (e.g. soda), sports drinks, coffees, teas, spirits, alcoholic beverages (e.g. beer, wine, etc.), etc.; and ingredients for making or mixing into beverages (e.g. coffee beans, ground coffees, cocoas, tea leaves, dehydrated beverages, powders for making beverages, natural and artificial sweeteners, flavorings, etc.). Further, prepared foods, fruits, vegetables, soups, meats, pastas, microwavable and or frozen foods as well as produce, eggs, milk, and other fresh foods. Any of the embodiments of flexible containers disclosed herein can also be sterilized (e.g. by treatment with ultraviolet light or peroxide-based compositions), to make the containers safe for use in storing food and/or beverage. In any embodiment, the containers can be configured to be suitable for retort processes.

As still further examples, any embodiment of flexible containers, as described herein, may be used across the medical industry, in the areas of medicines, medical devices, and medical treatment, including uses for receiving, containing, storing and/or dispensing, any of the following fluent products, in any form known in the art: bodily fluids from humans and/or animals (e.g. amniotic fluid, aqueous humour, vitreous humour, bile, blood, blood plasma, blood serum, breast milk, cerebrospinal fluid, cerumen (earwax), chyle, chime, endolymph (and perilymph), ejaculate, runny feces, gastric acid, gastric juice, lymph, mucus (including nasal drainage and phlegm), pericardial fluid, peritoneal fluid, pleural fluid, pus, rheum, saliva, sebum (skin oil), semen, sputum, synovial fluid, tears, sweat, vaginal secretion, vomit, urine, etc.); fluids for intravenous therapy to human or animal bodies (e.g. volume expanders (e.g. crystalloids and colloids), blood-based products including blood substitutes, buffer solutions, liquid-based medications (which can include pharmaceuticals), parenteral nutritional formulas (e.g. for intravenous feeding, wherein such formulas can include salts, glucose, amino acids, lipids, supplements, nutrients, and/or vitamins); other medicinal fluids for administering to human or animal bodies (e.g. medicines, medicaments, nutrients, nutraceuticals, pharmaceuticals, etc.) by any suitable method of administration (e.g. orally (in solid, liquid, or pill form), topically, intranasally, by inhalation, or rectally. Any of the embodiments of flexible containers disclosed herein can also be sterilized (e.g. by treatment with ultraviolet light or peroxide-based compositions or through an autoclave or retort process), to make the containers safe for use in sterile medical environments.

As even further examples, any embodiment of flexible containers, as described herein, may be used across any and all industries that use internal combustion engines (such as the transportation industry, the power equipment industry, the power generation industry, etc.), including products for vehicles such as cars, trucks, automobiles, boats, aircraft, etc., with such containers useful for receiving, containing, storing, and/or dispensing, any of the following fluent products, in any form known in the art: engine oil, engine oil additives, fuel additives, brake fluids, transmission fluids, engine coolants, power steering fluids, windshield wiper fluids, products for vehicle care (e.g. for body, tires, wheels, windows, trims, upholsteries, etc.), as well as other fluids configured to clean, penetrate, degrease, lubricate, and/or protect one or more parts of any and all kinds of engines, power equipment, and/or transportation vehicles.

Any embodiment of flexible containers, as described herein, can also be used for receiving, containing, storing, and/or dispensing, non-fluent products, in any of the following categories: Baby Care products, including disposable wearable absorbent articles, diapers, training pants, infant and toddler care wipes, etc. and the like; Beauty Care products including applicators for applying compositions to human or animal hair, skin, and/or nails, etc. and the like;

Home Care products including wipes and scrubbers for all kinds of cleaning applications and the like; Family Care products including wet or dry bath tissue, facial tissue, disposable handkerchiefs, disposable towels, wipes, etc. and the like; Feminine Care products including catamenial pads, incontinence pads, interlabial pads, panty liners, pessaries, sanitary napkins, tampons, tampon applicators, wipes, etc. and the like; Health Care products including oral care products such as oral cleaning devices, dental floss, flossing devices, toothbrushes, etc. and the like; Pet Care products including grooming aids, pet training aids, pet devices, pet toys, etc. and the like; Portable Power products including electrochemical cells, batteries, battery current interrupters, battery testers, battery chargers, battery charge monitoring equipment, battery charge/discharge rate controlling equipment, "smart" battery electronics, flashlights, etc. and the like; Small Appliance Products including hair removal appliances (including, e.g. electric foil shavers for men and women, charging and/or cleaning stations, electric hair trimmers, electric beard trimmers, electric epilator devices, cleaning fluid cartridges, shaving conditioner cartridges, shaving foils, and cutter blocks); oral care appliances (including, e.g., electric toothbrushes with accumulator or battery, refill brushheads, interdental cleaners, tongue cleaners, charging stations, electric oral irrigators, and irrigator clip on jets); small electric household appliances (including, e.g., coffee makers, water kettles, handblenders, handmixers, food processors, steam cookers, juicers, citrus presses, toasters, coffee or meat grinders, vacuum pumps, irons, steam pressure stations for irons and in general non electric attachments therefore, hair care appliances (including, e.g., electric hair driers, hairstylers, hair curlers, hair straighteners, cordless gas heated styler/irons and gas cartridges therefore, and air filter attachments); personal diagnostic appliances (including, e.g., blood pressure monitors, ear thermometers, and lensfilters therefore); clock appliances and watch appliances (including, e.g., alarm clocks, travel alarm clocks combined with radios, wall clocks, wristwatches, and pocket calculators), etc. and the like.

FIGS. 1A-1D illustrates various views of an embodiment of a stand up flexible container 100. FIG. 1A illustrates a front view of the container 100. The container 100 is standing upright on a horizontal support surface 101.

In FIG. 1A, a coordinate system 110, provides lines of reference for referring to directions in the figure. The coordinate system 110 is a three-dimensional Cartesian coordinate system with an X-axis, a Y-axis, and a Z-axis, wherein each axis is perpendicular to the other axes, and any two of the axes define a plane. The X-axis and the Z-axis are parallel with the horizontal support surface 101 and the Y-axis is perpendicular to the horizontal support surface 101.

FIG. 1A also includes other lines of reference, for referring to directions and locations with respect to the container 100. A lateral centerline 111 runs parallel to the X-axis. An XY plane at the lateral centerline 111 separates the container 100 into a front half and a back half. An XZ plane at the lateral centerline 111 separates the container 100 into an upper half and a lower half. A longitudinal centerline 114 runs parallel to the Y-axis. A YZ plane at the longitudinal centerline 114 separates the container 100 into a left half and a right half. A third centerline 117 runs parallel to the Z-axis. The lateral centerline 111, the longitudinal centerline 114, and the third centerline 117 all intersect at a center of the container 100.

A disposition with respect to the lateral centerline 111 defines what is longitudinally inboard 112 and longitudinally outboard 113. When a first location is nearer to the lateral centerline 111 than a second location, the first location is considered to be disposed longitudinally inboard 112 to the second location. And, the second location is considered to be disposed longitudinally outboard 113 from the first location. The term lateral refers to a direction, orientation, or measurement that is parallel to the lateral centerline 111. A lateral orientation may also be referred to a horizontal orientation, and a lateral measurement may also be referred to as a width.

A disposition with respect to the longitudinal centerline 114 defines what is laterally inboard 115 and laterally outboard 116. When a first location is nearer to the longitudinal centerline 114 than a second location, the first location is considered to be disposed laterally inboard 115 to the second location. And, the second location is considered to be disposed laterally outboard 116 from the first location. The term longitudinal refers to a direction, orientation, or measurement that is parallel to the longitudinal centerline 114. A longitudinal orientation may also be referred to a vertical orientation.

A longitudinal direction, orientation, or measurement may also be expressed in relation to a horizontal support surface for the container 100. When a first location is nearer to the support surface than a second location, the first location can be considered to be disposed lower than, below, beneath, or under the second location. And, the second location can be considered to be disposed higher than, above, or upward from the first location. A longitudinal measurement may also be referred to as a height, measured above the horizontal support surface 100.

A measurement that is made parallel to the third centerline 117 is referred to a thickness or depth. A disposition in the direction of the third centerline 117 and toward a front 102-1 of the container is referred to as forward 118 or in front of. A disposition in the direction of the third centerline 117 and toward a back 102-2 of the container is referred to as backward 119 or behind.

These terms for direction, orientation, measurement, and disposition, as described above, are used for all of the embodiments of the present disclosure, whether or not a support surface, reference line, or coordinate system is shown in a figure.

The container 100 includes a top 104, a middle 106, and a bottom 108, the front 102-1, the back 102-2, and left and right sides 109. The top 104 is separated from the middle 106 by a reference plane 105, which is parallel to the XZ plane. The middle 106 is separated from the bottom 108 by a reference plane 107, which is also parallel to the XZ plane. The container 100 has an overall height of 100-oh. In the embodiment of FIG. 1A, the front 102-1 and the back 102-2 of the container are joined together at a seal 129, which extends around the outer periphery of the container 100, across the top 104, down the side 109, and then, at the bottom of each side 109, splits outward to follow the front and back portions of the base 190, around their outer extents.

The container 100 includes a structural support frame 140, a product volume 150, a dispenser 160, panels 180-1 and 180-2, and a base structure 190. A portion of panel 180-1 is illustrated as broken away, in order to show the product volume 150. The product volume 150 is configured to contain one or more fluent products. The dispenser 160 allows the container 100 to dispense these fluent product(s) from the product volume 150 through a flow channel 159 then through the dispenser 160, to the environment outside of the container 100. In the embodiment of FIGS. 1A-1D, the dispenser 160 is disposed in the center of the uppermost part of the top 104, however, in various alternate embodiments, the dispenser 160 can be disposed anywhere else on the top 140, middle 106, or bottom 108, including anywhere on either of the sides 109, on either of the panels 180-1 and 180-2, and on any part of the base 190 of the container 100. The structural support frame 140 supports the mass of fluent product(s) in the product volume 150, and makes the container 100 stand upright. The panels 180-1 and 180-2 are relatively flat surfaces, overlaying the product volume 150, and are suitable for displaying any kind of indicia. However, in various embodiments, part, parts, or about all, or approximately all, or substantially all, or nearly all, or all of either or both of the panels 180-1 and 180-2 can include one or more curved surfaces. The base structure 190 supports the structural support frame 140 and provides stability to the container 100 as it stands upright.

The structural support frame 140 is formed by a plurality of structural support members. The structural support frame 140 includes top structural support members 144-1 and 144-2, middle structural support members 146-1, 146-2, 146-3, and 146-4, as well as bottom structural support members 148-1 and 148-2.

The top structural support members 144-1 and 144-2 are disposed on the upper part of the top 104 of the container 100, with the top structural support member 144-1 disposed in the front 102-1 and the top structural support member 144-2 disposed in the back 102-2, behind the top structural support member 144-1. The top structural support members 144-1 and 144-2 are adjacent to each other and can be in contact with each other along the laterally outboard portions of their lengths. In various embodiments, the top structural support members 144-1 and 144-2 can be in contact with each other at one or more relatively smaller locations and/or at one or more relatively larger locations, along part, or parts, or about all, or approximately all, or substantially all, or nearly all, or all of their overall lengths, so long as there is a flow channel 159 between the top structural support members 144-1 and 144-2, which allows the container 100 to dispense fluent product(s) from the product volume 150 through the flow channel 159 then through the dispenser 160. The top structural support members 144-1 and 144-2 are not directly connected to each other. However, in various alternate embodiments, the top structural support members 144-1 and 144-2 can be directly connected and/or joined together along part, or parts, or about all, or approximately all, or substantially all, or nearly all, or all of their overall lengths.

The top structural support members 144-1 and 144-2 are disposed substantially above the product volume 150. Overall, each of the top structural support members 144-1 and 144-2 is oriented about horizontally, but with its ends curved slightly downward. And, overall each of the top structural support members 144-1 and 144-2 has a cross-sectional area that is substantially uniform along its length; however the cross-sectional area at their ends are slightly larger than the cross-sectional area in their middles.

The middle structural support members 146-1, 146-2, 146-3, and 146-4 are disposed on the left and right sides 109, from the top 104, through the middle 106, to the bottom 108. The middle structural support member 146-1 is disposed in the front 102-1, on the left side 109; the middle structural support member 146-4 is disposed in the back 102-2, on the left side 109, behind the middle structural support member 146-1. The middle structural support members 146-1 and 146-4 are adjacent to each other and can be in contact with each other along substantially all of their lengths. In various embodiments, the middle structural support members 146-1 and 146-4 can be in contact with each other at one or more relatively smaller locations and/or at one or more relatively larger locations, along part, or parts, or about all, or approximately all, or substantially all, or nearly all, or all of their overall lengths. The middle structural support members 146-1 and 146-4 are not directly connected to each other. However, in various alternate embodiments, the middle structural support members 146-1 and 146-4 can be directly connected and/or joined together along part, or parts, or about all, or approximately all, or substantially all, or nearly all, or all of their overall lengths.

The middle structural support member 146-2 is disposed in the front 102-1, on the right side 109; the middle structural support member 146-3 is disposed in the back 102-2, on the right side 109, behind the middle structural support member 146-2. The middle structural support members 146-2 and 146-3 are adjacent to each other and can be in contact with each other along substantially all of their lengths. In various embodiments, the middle structural support members 146-2 and 146-3 can be in contact with each other at one or more relatively smaller locations and/or at one or more relatively larger locations, along part, or parts, or about all, or approximately all, or substantially all, or nearly all, or all of their overall lengths. The middle structural support members 146-2 and 146-3 are not directly connected to each other. However, in various alternate embodiments, the middle structural support members 146-2 and 146-3 can be directly connected and/or joined together along part, or parts, or about all, or approximately all, or substantially all, or nearly all, or all of their overall lengths.

The middle structural support members 146-1, 146-2, 146-3, and 146-4 are disposed substantially laterally outboard from the product volume 150. Overall, each of the middle structural support members 146-1, 146-2, 146-3, and 146-4 is oriented about vertically, but angled slightly, with its upper end laterally inboard to its lower end. And, overall each of the middle structural support members 146-1, 146-2, 146-3, and 146-4 has a cross-sectional area that changes along its length, increasing in size from its upper end to its lower end.

The bottom structural support members 148-1 and 148-2 are disposed on the bottom 108 of the container 100, with the bottom structural support member 148-1 disposed in the front 102-1 and the bottom structural support member 148-2 disposed in the back 102-2, behind the top structural support member 148-1. The bottom structural support members 148-1 and 148-2 are adjacent to each other and can be in contact with each other along substantially all of their lengths. In various embodiments, the bottom structural support members 148-1 and 148-2 can be in contact with each other at one or more relatively smaller locations and/or at one or more relatively larger locations, along part, or parts, or about all, or approximately all, or substantially all, or nearly all, or all of their overall lengths. The bottom structural support members 148-1 and 148-2 are not directly connected to each other. However, in various alternate embodiments, the bottom structural support members 148-1 and 148-2 can be directly connected and/or joined together along part, or parts, or about all, or approximately all, or substantially all, or nearly all, or all of their overall lengths.

The bottom structural support members 148-1 and 148-2 are disposed substantially below the product volume 150, but substantially above the base structure 190. Overall, each of the bottom structural support members 148-1 and 148-2 is oriented about horizontally, but with its ends curved slightly upward. And, overall each of the bottom structural support members 148-1 and 148-2 has a cross-sectional area that is substantially uniform along its length.

In the front portion of the structural support frame 140, the left end of the top structural support member 144-1 is joined to the upper end of the middle structural support member 146-1; the lower end of the middle structural support member 146-1 is joined to the left end of the bottom structural support member 148-1; the right end of the bottom structural support member 148-1 is joined to the lower end of the middle structural support member 146-2; and the upper end of the middle structural support member 146-2 is joined to the right end of the top structural support member 144-1. Similarly, in the back portion of the structural support frame 140, the left end of the top structural support member 144-2 is joined to the upper end of the middle structural support member 146-4; the lower end of the middle structural support member 146-4 is joined to the left end of the bottom structural support member 148-2; the right end of the bottom structural support member 148-2 is joined to the lower end of the middle structural support member 146-3; and the upper end of the middle structural support member 146-3 is joined to the right end of the top structural support member 144-2. In the structural support frame 140, the ends of the structural support members, which are joined together, are directly connected, all around the periphery of their walls. However, in various alternative embodiments, any of the structural support members 144-1, 144-2, 146-1, 146-2, 146-3, 146-4, 148-1, and 148-2 can be joined together in any way described herein or known in the art.

In alternative embodiments of the structural support frame 140, adjacent structural support members can be combined into a single structural support member, wherein the combined structural support member can effectively substitute for the adjacent structural support members, as their functions and connections are described herein. In other alternative embodiments of the structural support frame 140, one or more additional structural support members can be added to the structural support members in the structural support frame 140, wherein the expanded structural support frame can effectively substitute for the structural support frame 140, as its functions and connections are described herein. Also, in some alternative embodiments, a flexible container may not include a base structure.

Figure 1B:
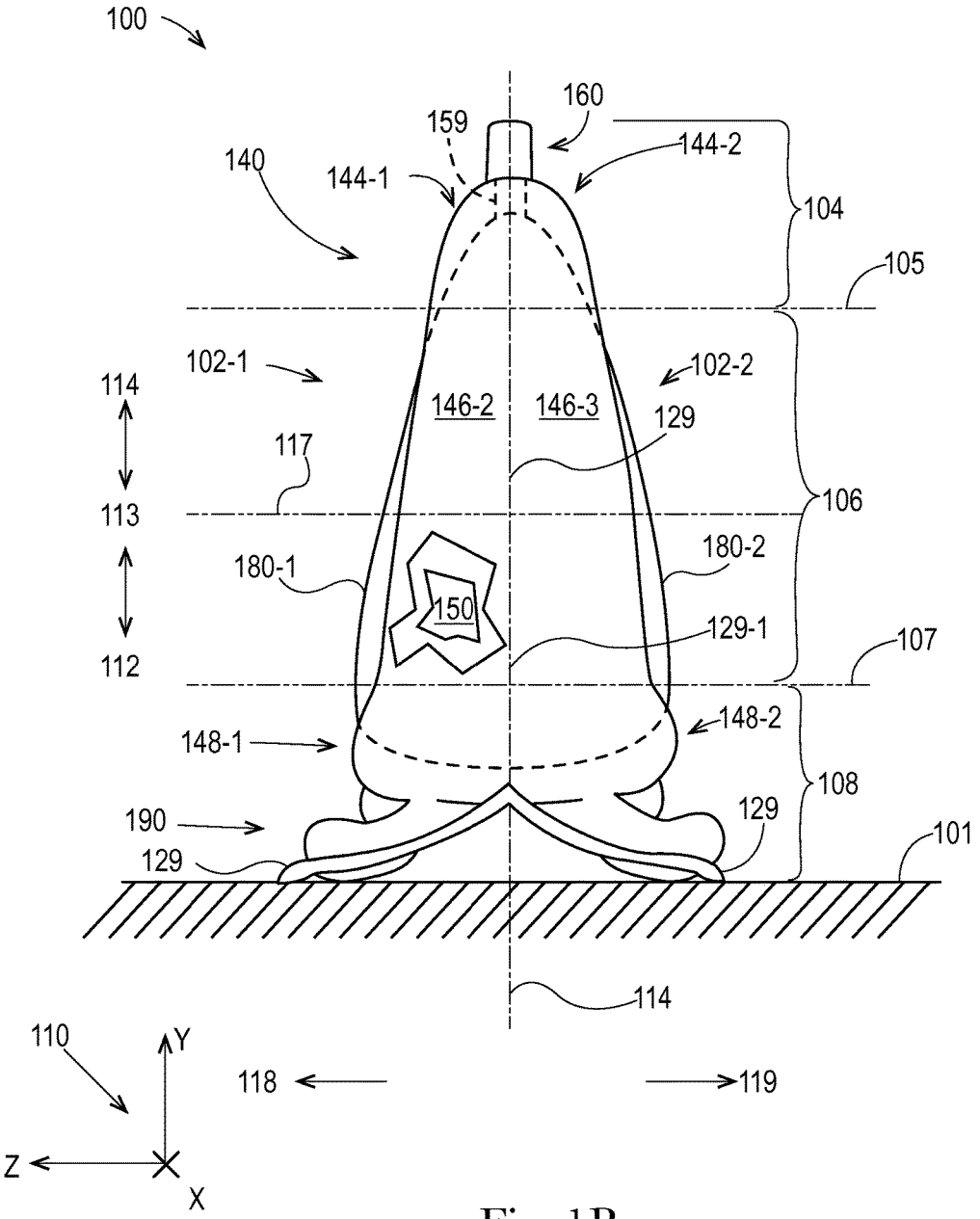
FIG. 1B illustrates a side view of the stand up flexible container of FIG. 1A.

FIG. 1B illustrates a side view of the stand up flexible container 100 of FIG. 1A.

Figure 1C:
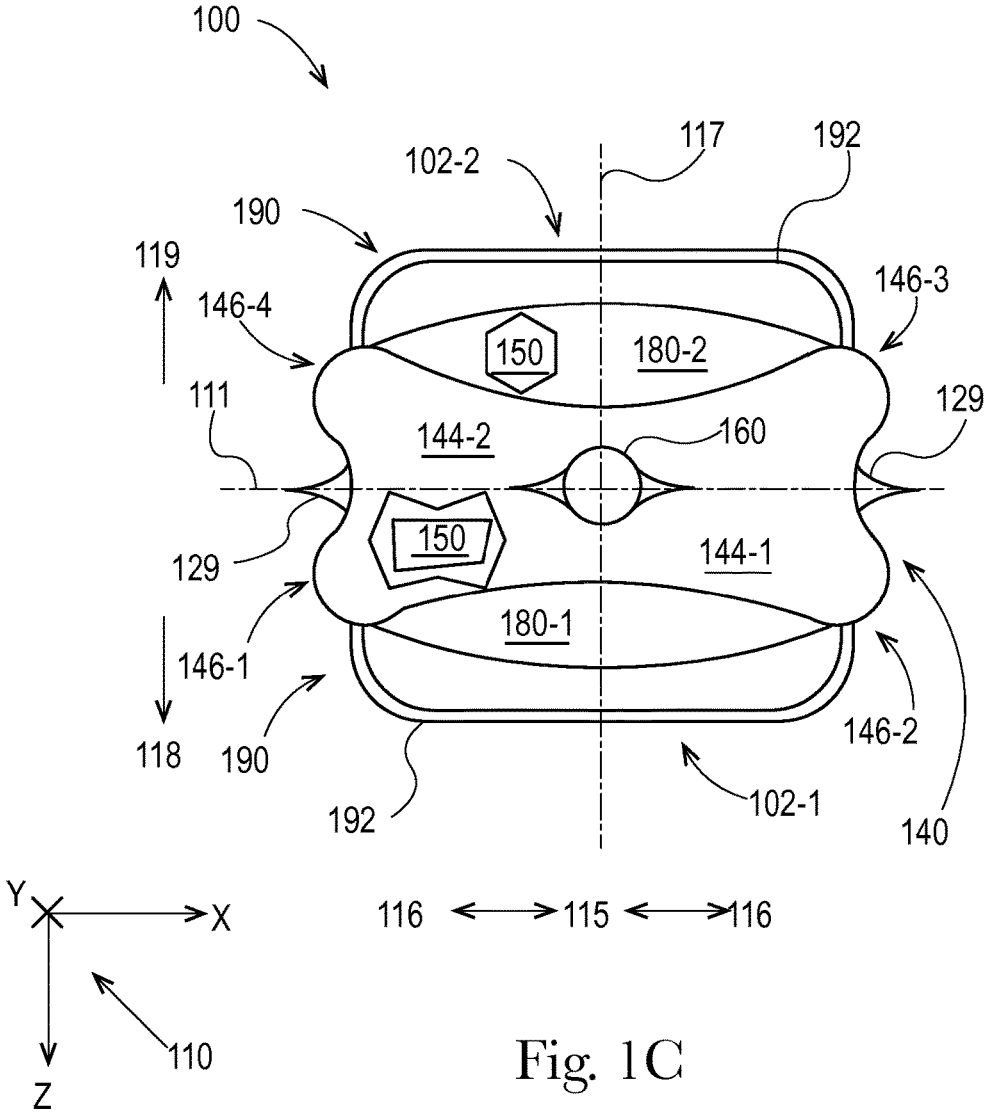
FIG. 1C illustrates a top view of the stand up flexible container of FIG. 1A.

FIG. 1C illustrates a top view of the stand up flexible container 100 of FIG. 1A.

Figure 1D:
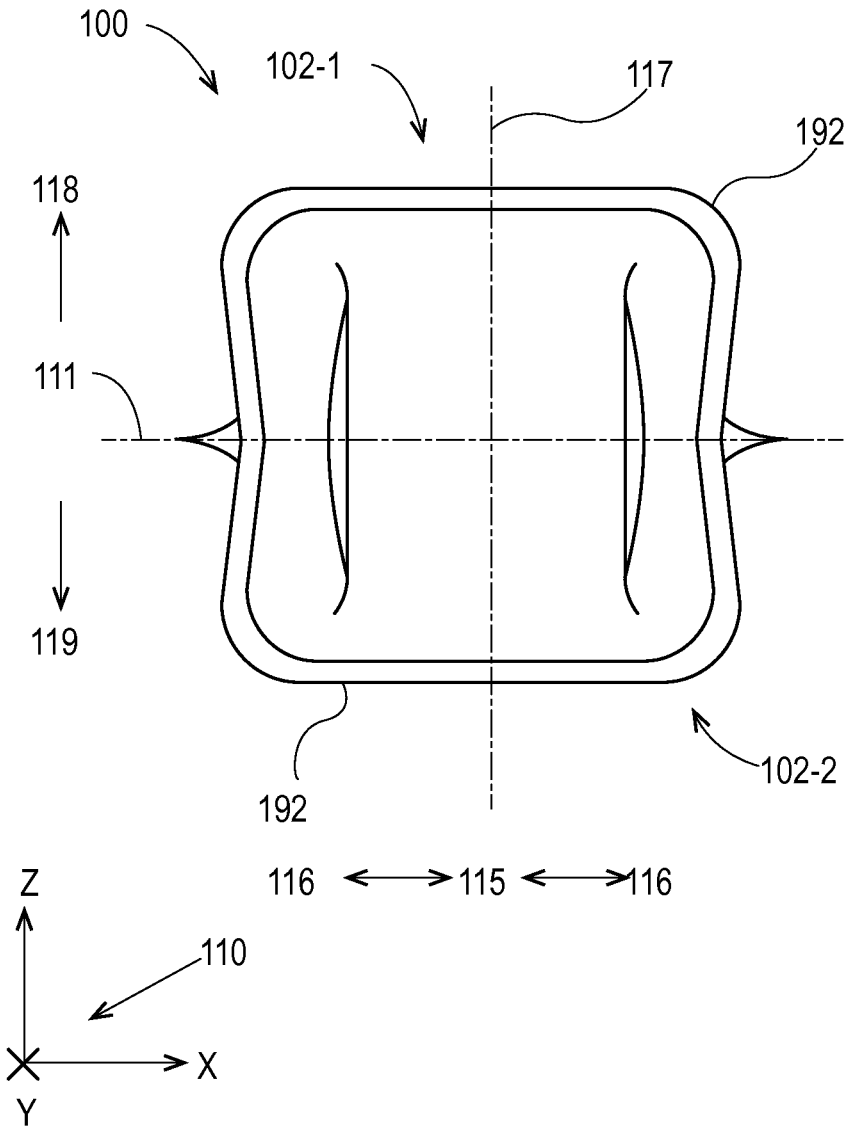
FIG. 1D illustrates a bottom view of the stand up flexible container of FIG. 1A.

FIG. 1D illustrates a bottom view of the stand up flexible container 100 of FIG. 1A.

Figure 1G:
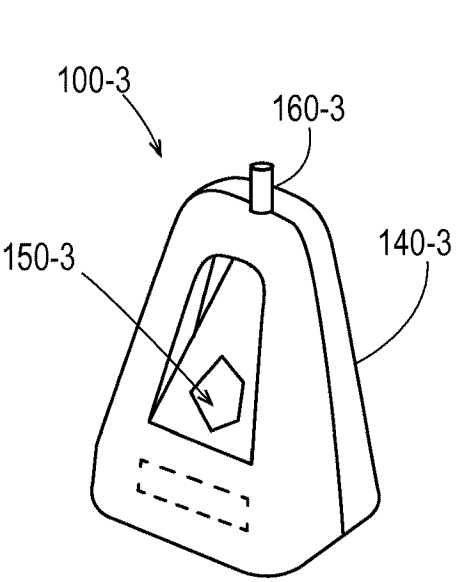
FIG. 1G illustrates a perspective view of an alternative embodiment of the stand up flexible container of FIG. 1A, including an external structural support frame.
Figure 1F:
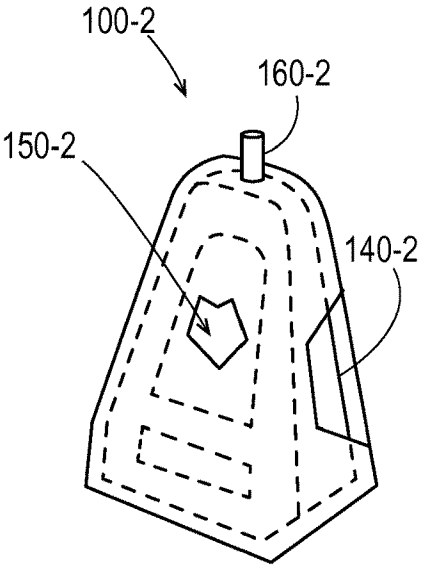
FIG. 1F illustrates a perspective view of an alternative embodiment of the stand up flexible container of FIG. 1A, including an internal structural support frame.
Figure 1E:
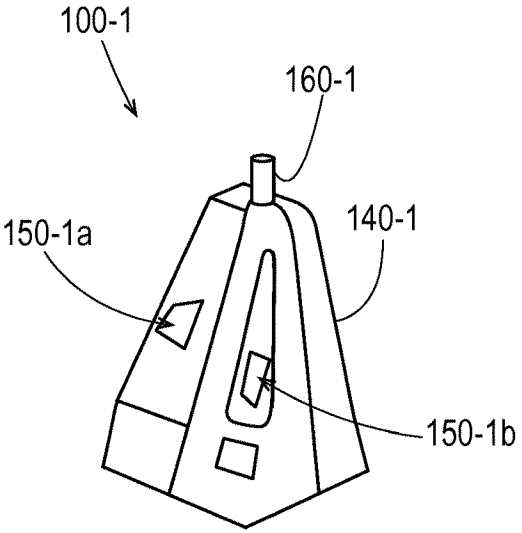
FIG. 1E illustrates a perspective view of an alternative embodiment of the stand up flexible container of FIG. 1A, including an asymmetric structural support frame.

FIG. 1E illustrates a perspective view of a container 100-1, which is an alternative embodiment of the stand up flexible container 100 of FIG. 1A, including an asymmetric structural support frame 140-1, a first portion of the product volume 150-1*b*, a second portion of the product volume 150-1*a*, and a dispenser 160-1. The embodiment of FIG. 1E is similar to the embodiment of FIG. 1A with like-numbered terms configured in the same way, except that the frame 140-1 extends around about half of the container 100-1, directly supporting a first portion of the product volume 150-1*b*, which is disposed inside of the frame 140-1, and indirectly supporting a second portion of the product volume 150-1*a*, which is disposed outside of the frame 140-1. In various embodiments, any stand-up flexible container of the present disclosure can be modified in a similar way, such that: the frame extends around only part or parts of the container, and/or the frame is asymmetric with respect to one or more centerlines of the container, and/or part or parts of one or more product volumes of the container are disposed outside of the frame, and/or part or parts of one or more product volumes of the container are indirectly supported by the frame.

FIG. 1F illustrates a perspective view of a container 100-2, which is an alternative embodiment of the stand up flexible container 100 of FIG. 1A, including an internal structural support frame 140-2, a product volume 150-2, and a dispenser 160-2. The embodiment of FIG. 1F is similar to the embodiment of FIG. 1A with like-numbered terms configured in the same way, except that the frame 140-2 is internal to the product volume 150-2. In various embodiments, any stand-up flexible container of the present disclosure can be modified in a similar way, such that: part, parts, or all of the frame (including part, parts, or all of one or more of any structural support members that form the frame) are about, approximately, substantially, nearly, or completely enclosed by one or more product volumes.

FIG. 1G illustrates a perspective view of a container 100-3, which is an alternative embodiment of the stand up flexible container 100 of FIG. 1A, including an external structural support frame 140-3, a product volume 150-3, and a dispenser 160-3. The embodiment of FIG. 1G is similar to the embodiment of FIG. 1A with like-numbered terms configured in the same way, except that the product volume 150-3 is not integrally connected to the frame 140-3 (that is, not simultaneously made from the same web of flexible materials), but rather the product volume 150-3 is separately made and then joined to the frame 140-3. The product volume 150-3 can be joined to the frame in any convenient manner disclosed herein or known in the art. In the embodiment of FIG. 1G, the product volume 150-3 is disposed within the frame 140-3, but the product volume 150-3 has a reduced size and a somewhat different shape, when compared with the product volume 150 of FIG. 1A; however, these differences are made to illustrate the relationship between the product volume 150-3 and the frame 140-3, and are not required. In various embodiments, any stand-up flexible container of the present disclosure can be modified in a similar way, such that one or more the product volumes are not integrally connected to the frame.

FIGS. 2A-8G illustrate embodiments of stand up flexible containers having various overall shapes. Any of the embodiments of FIGS. 2A-8G can be configured according to any of the embodiments disclosed herein, including the embodiments of FIGS. 1A-1G. Any of the elements (e.g. structural support frames, structural support members, panels, dispensers, etc.) of the embodiments of FIGS. 2A-8G, can be configured according to any of the embodiments disclosed herein. While each of the embodiments of FIGS. 2A-8G illustrates a container with one dispenser, in various embodiments, each container can include multiple dispensers, according to any embodiment described herein. FIGS. 2A-8G illustrate exemplary additional/alternate locations for dispenser with phantom line outlines. Part, parts, or about all, or approximately all, or substantially all, or nearly all, or all of each of the panels in the embodiments of FIGS. 2A-8G is suitable to display any kind of indicia. Each of the side panels in the embodiments of FIGS. 2A-8G is configured to be a nonstructural panel, overlaying product volume(s) disposed within the flexible container, however, in various embodiments, one or more of any kind of decorative or structural element (such as a rib, protruding from an outer surface) can be joined to part, parts, or about all, or approximately all, or substantially all, or nearly all, or all of any of these side panels. For clarity, not all structural details of these flexible containers are shown in FIGS. 2A-8G, however any of the embodiments of FIGS. 2A-8G can be configured to include any structure or feature for flexible containers, disclosed herein. For example, any of the embodiments of FIGS. 2A-8G can be configured to include any kind of base structure disclosed herein.

Figure 2A:
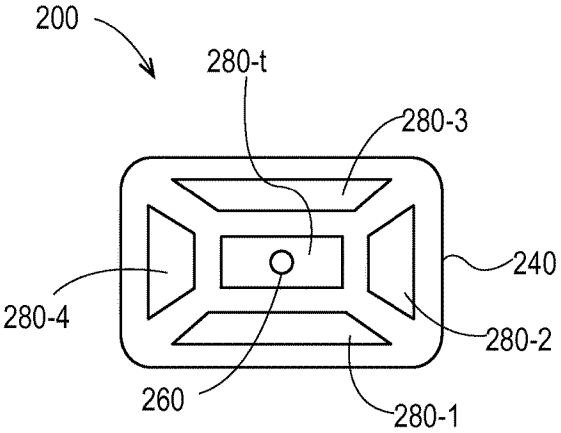
FIG. 2A illustrates a top view of a stand up flexible container having a structural support frame that has an overall shape like a frustum.
Figure 2B:
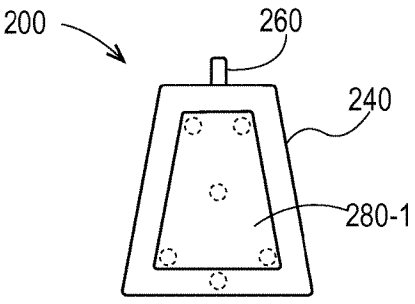
FIG. 2B illustrates a front view of the container of FIG. 2A.
Figure 2C:
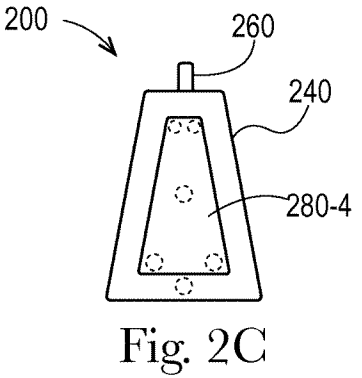
FIG. 2C illustrates a side view of the container of FIG. 2A.
Figure 2D:
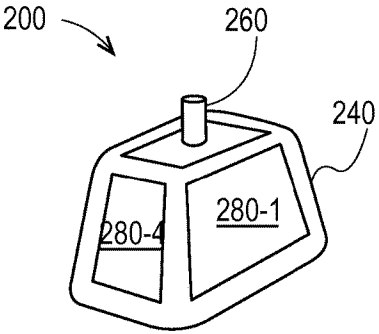
FIG. 2D illustrates an isometric view of the container of FIG. 2A.

FIG. 2A illustrates a front view of a stand up flexible container 200 having a structural support frame 240 that has an overall shape like a frustum. In the embodiment of FIG. 2A, the frustum shape is based on a four-sided pyramid, however, in various embodiments, the frustum shape can be based on a pyramid with a different number of sides, or the frustum shape can be based on a cone. The support frame 240 is formed by structural support members disposed along the edges of the frustum shape and joined together at their ends. The structural support members define a rectangular shaped top panel 280-*t*, trapezoidal shaped side panels 280-1, 280-2, 280-3, and 280-4, and a rectangular shaped bottom panel (not shown). Each of the side panels 280-1, 280-2, 280-3, and 280-4 is about flat, however in various embodiments, part, parts, or about all, or approximately all, or substantially all, or nearly all, or all of any of the side panels can be approximately flat, substantially flat, nearly flat, or completely flat. The container 200 includes a dispenser 260, which is configured to dispense one or more fluent products from one or more product volumes disposed within the container 200. In the embodiment of FIG. 2A, the dispenser 260 is disposed in the center of the top panel 280-*t*, however, in various alternate embodiments, the dispenser 260 can be disposed anywhere else on the top, sides, or bottom, of the container 200, according to any embodiment described or illustrated herein. FIG. 2B illustrates a front view of the container 200 of FIG. 2A, including exemplary additional/alternate locations for a dispenser, any of which can also apply to the back of the container. FIG. 2C illustrates a side view of the container 200 of FIG. 2A, including exemplary additional/alternate locations for a dispenser (shown as phantom lines), any of which can apply to either side of the container. FIG. 2D illustrates an isometric view of the container 200 of FIG. 2A.

Figure 2G:
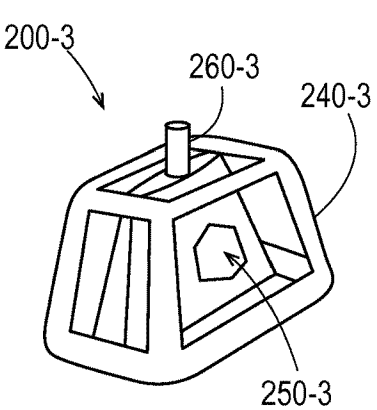
FIG. 2G illustrates a perspective view of an alternative embodiment of the stand up flexible container of FIG. 2A, including an external structural support frame.
Figure 2F:
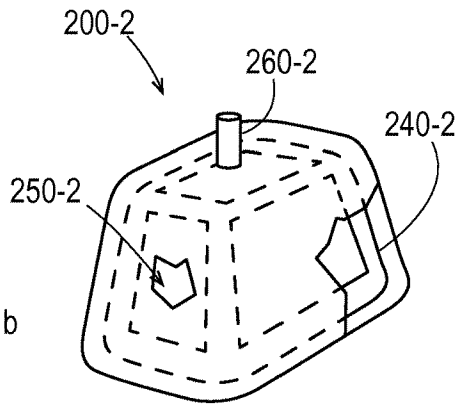
FIG. 2F illustrates a perspective view of an alternative embodiment of the stand up flexible container of FIG. 1A, including an internal structural support frame.
Figure 2E:
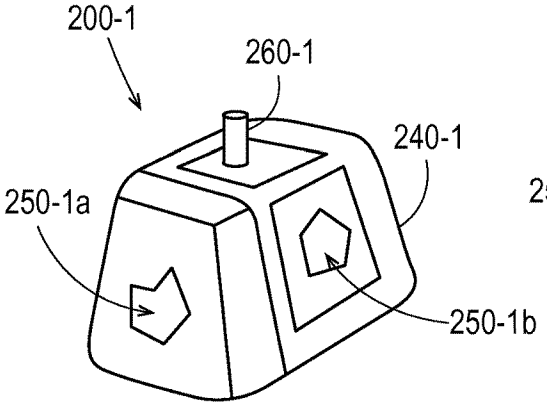
FIG. 2E illustrates a perspective view of an alternative embodiment of the stand up flexible container of FIG. 2A, including an asymmetric structural support frame.

FIG. 2E illustrates a perspective view of a container 200-1, which is an alternative embodiment of the stand up flexible container 200 of FIG. 2A, including an asymmetric structural support frame 240-1, a first portion of the product volume 250-1*b*, a second portion of the product volume 250-1*a*, and a dispenser 260-1, configured in the same manner as the embodiment of FIG. 1E, except based on the container 200. FIG. 2F illustrates a perspective view of a container 200-2, which is an alternative embodiment of the stand up flexible container 200 of FIG. 2A, including an internal structural support frame 240-2, a product volume 250-2, and a dispenser 260-2, configured in the same manner as the embodiment of FIG. 1F, except based on the container 200. FIG. 2G illustrates a perspective view of a container 200-3, which is an alternative embodiment of the stand up flexible container 200 of FIG. 2A, including an external structural support frame 240-3, a non-integral product volume 250-3 joined to and disposed within the frame 240-3, and a dispenser 260-3, configured in the same manner as the embodiment of FIG. 1G, except based on the container 200.

Figure 3A:
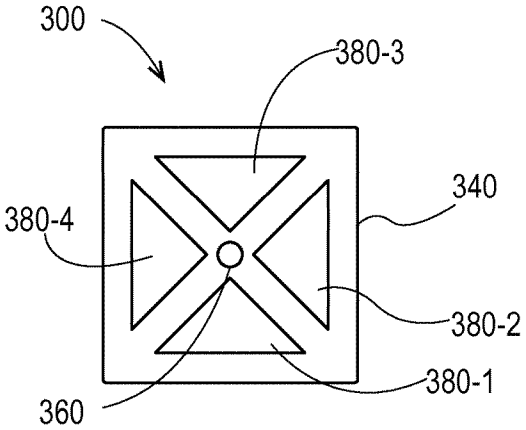
FIG. 3A illustrates a top view of a stand up flexible container having a structural support frame that has an overall shape like a pyramid.
Figure 3B:
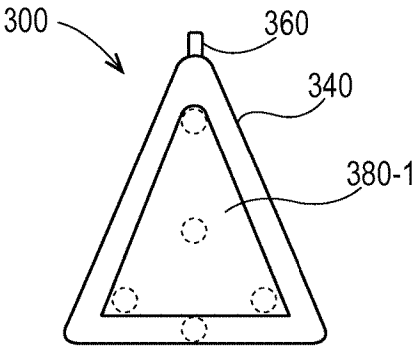
FIG. 3B illustrates a front view of the container of FIG. 3A.
Figure 3C:
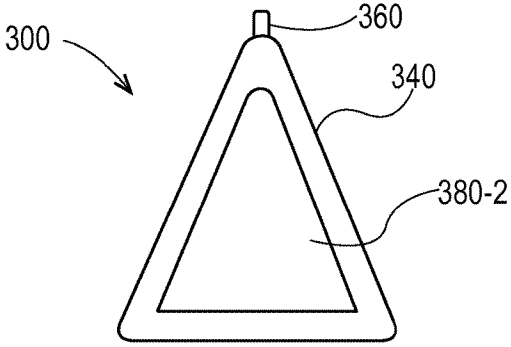
FIG. 3C illustrates a side view of the container of FIG. 3A.
Figure 3D:
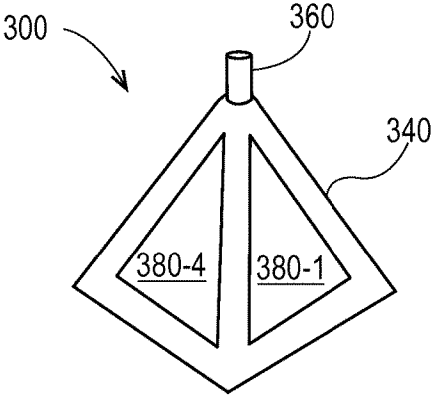
FIG. 3D illustrates an isometric view of the container of FIG. 3A.

FIG. 3A illustrates a front view of a stand up flexible container 300 having a structural support frame 340 that has an overall shape like a pyramid. In the embodiment of FIG. 3A, the pyramid shape is based on a four-sided pyramid, however, in various embodiments, the pyramid shape can be based on a pyramid with a different number of sides. The support frame 340 is formed by structural support members disposed along the edges of the pyramid shape and joined together at their ends. The structural support members define triangular shaped side panels 380-1, 380-2, 380-3, and 380-4, and a square shaped bottom panel (not shown). Each of the side panels 380-1, 380-2, 380-3, and 380-4 is about flat, however in various embodiments, part, parts, or about all, or approximately all, or substantially all, or nearly all, or all of any of the side panels can be approximately flat, substantially flat, nearly flat, or completely flat. The container 300 includes a dispenser 360, which is configured to dispense one or more fluent products from one or more product volumes disposed within the container 300. In the embodiment of FIG. 3A, the dispenser 360 is disposed at the apex of the pyramid shape, however, in various alternate embodiments, the dispenser 360 can be disposed anywhere else on the top, sides, or bottom, of the container 300. FIG. 3B illustrates a front view of the container 300 of FIG. 3A, including exemplary additional/alternate locations for a dispenser (shown as phantom lines), any of which can also apply to any side of the container. FIG. 3C illustrates a side view of the container 300 of FIG. 3A. FIG. 3D illustrates an isometric view of the container 300 of FIG. 3A.

Figure 3G:
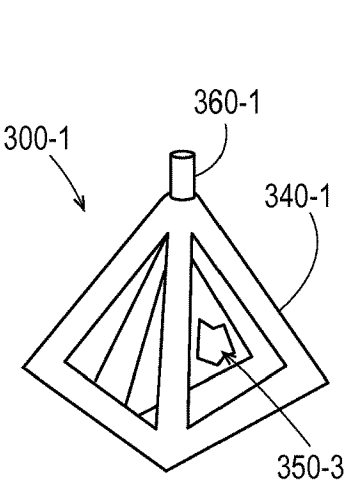
FIG. 3G illustrates a perspective view of an alternative embodiment of the stand up flexible container of FIG. 3A, including an external structural support frame.
Figure 3F:
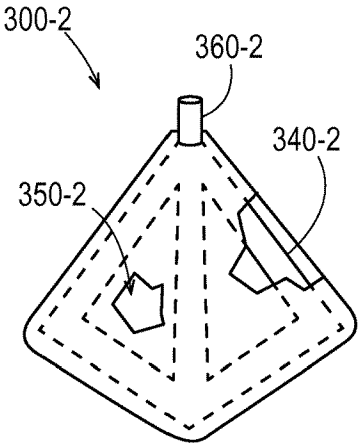
FIG. 3F illustrates a perspective view of an alternative embodiment of the stand up flexible container of FIG. 3A, including an internal structural support frame.
Figure 3E:
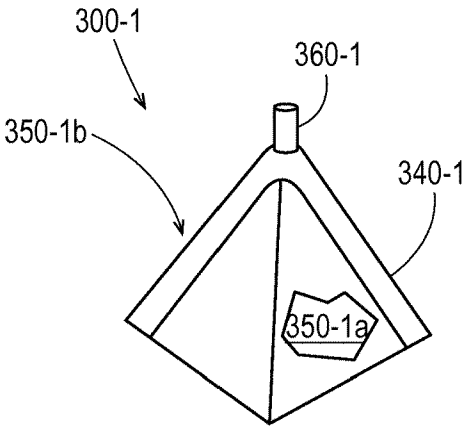
FIG. 3E illustrates a perspective view of an alternative embodiment of the stand up flexible container of FIG. 3A, including an asymmetric structural support frame.

FIG. 3E illustrates a perspective view of a container 300-1, which is an alternative embodiment of the stand up flexible container 300 of FIG. 3A, including an asymmetric structural support frame 340-1, a first portion of the product volume 350-1*b*, a second portion of the product volume 350-1*a*, and a dispenser 360-1, configured in the same manner as the embodiment of FIG. 1E, except based on the container 300. FIG. 3F illustrates a perspective view of a container 300-2, which is an alternative embodiment of the stand up flexible container 300 of FIG. 3A, including an internal structural support frame 340-2, a product volume 350-2, and a dispenser 360-2, configured in the same manner as the embodiment of FIG. 1F, except based on the container 300. FIG. 3G illustrates a perspective view of a container 300-3, which is an alternative embodiment of the stand up flexible container 300 of FIG. 3A, including an external structural support frame 340-3, a non-integral product volume 350-3 joined to and disposed within the frame 340-3, and a dispenser 360-3, configured in the same manner as the embodiment of FIG. 1G, except based on the container 300.

Figure 4B:
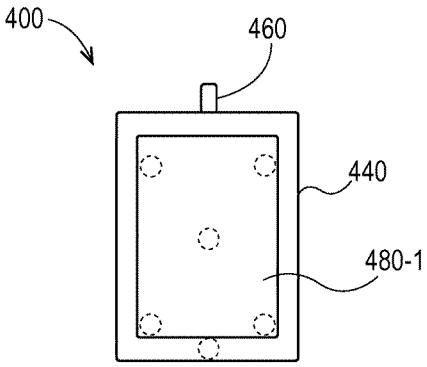
FIG. 4B illustrates a front view of the container of FIG. 4A.
Figure 4A:
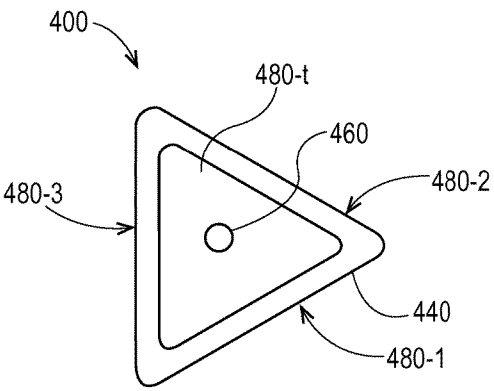
FIG. 4A illustrates a top view of a stand up flexible container having a structural support frame that has an overall shape like a trigonal prism.
Figure 4D:
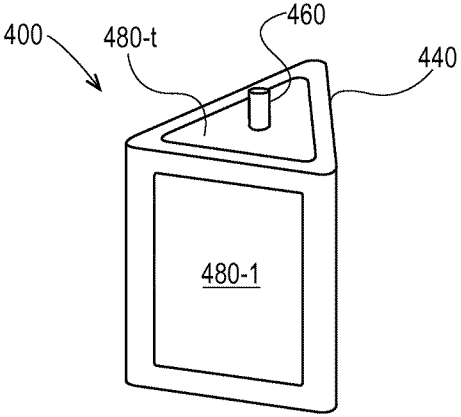
FIG. 4D illustrates an isometric view of the container of FIG. 4A.
Figure 4C:
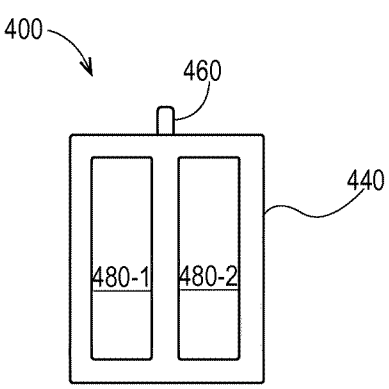
FIG. 4C illustrates a side view of the container of FIG. 4A.

FIG. 4A illustrates a front view of a stand up flexible container 400 having a structural support frame 440 that has an overall shape like a trigonal prism. In the embodiment of FIG. 4A, the prism shape is based on a triangle. The support frame 440 is formed by structural support members disposed along the edges of the prism shape and joined together at their ends. The structural support members define a triangular shaped top panel 480-*t*, rectangular shaped side panels 480-1, 480-2, and 480-3, and a triangular shaped bottom panel (not shown). Each of the side panels 480-1, 480-2, and 480-3 is about flat, however in various embodiments, part, parts, or about all, or approximately all, or substantially all, or nearly all, or all of the side panels can be approximately flat, substantially flat, nearly flat, or completely flat. The container 400 includes a dispenser 460, which is configured to dispense one or more fluent products from one or more product volumes disposed within the container 400. In the embodiment of FIG. 4A, the dispenser 460 is disposed in the center of the top panel 480-*t*, however, in various alternate embodiments, the dispenser 460 can be disposed anywhere else on the top, sides, or bottom, of the container 400. FIG. 4B illustrates a front view of the container 400 of FIG. 4A, including exemplary additional/alternate locations for a dispenser (shown as phantom lines), any of which can also apply to any side of the container 400. FIG. 4C illustrates a side view of the container 400 of FIG. 4A. FIG. 4D illustrates an isometric view of the container 400 of FIG. 4A.

Figure 4G:
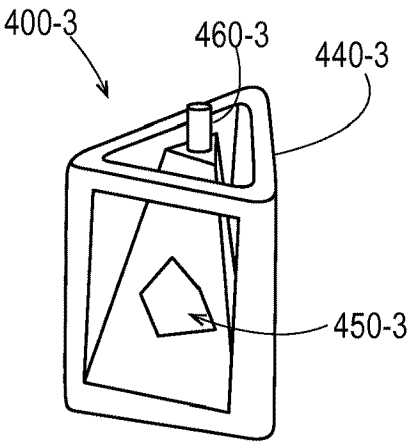
FIG. 4G illustrates a perspective view of an alternative embodiment of the stand up flexible container of FIG. 4A, including an external structural support frame.
Figure 4F:
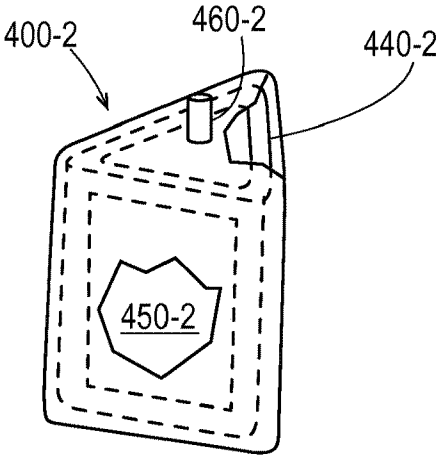
FIG. 4F illustrates a perspective view of an alternative embodiment of the stand up flexible container of FIG. 4A, including an internal structural support frame.
Figure 4E:
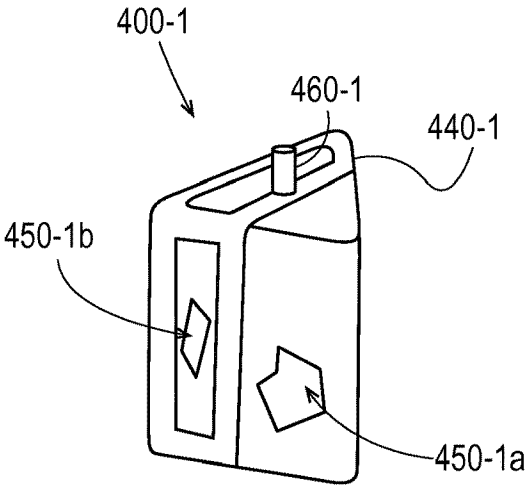
FIG. 4E illustrates a perspective view of an alternative embodiment of the stand up flexible container of FIG. 4A, including an asymmetric structural support frame.

FIG. 4E illustrates a perspective view of a container 400-1, which is an alternative embodiment of the stand up flexible container 400 of FIG. 4A, including an asymmetric structural support frame 440-1, a first portion of the product volume 450-1*b*, a second portion of the product volume 450-1*a*, and a dispenser 460-1, configured in the same manner as the embodiment of FIG. 1E, except based on the container 400. FIG. 4F illustrates a perspective view of a container 400-2, which is an alternative embodiment of the stand up flexible container 400 of FIG. 4A, including an internal structural support frame 440-2, a product volume 450-2, and a dispenser 460-2, configured in the same manner as the embodiment of FIG. 1F, except based on the container 400. FIG. 4G illustrates a perspective view of a container 400-3, which is an alternative embodiment of the stand up flexible container 400 of FIG. 4A, including an external structural support frame 440-3, a non-integral product volume 450-3 joined to and disposed within the frame 440-3, and a dispenser 460-3, configured in the same manner as the embodiment of FIG. 1G, except based on the container 400.

Figure 5B:
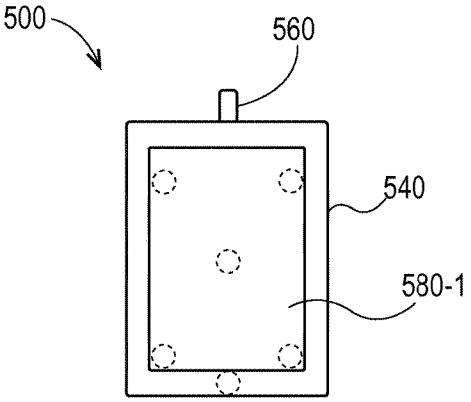
FIG. 5B illustrates a front view of the container of FIG. 5A.
Figure 5A:
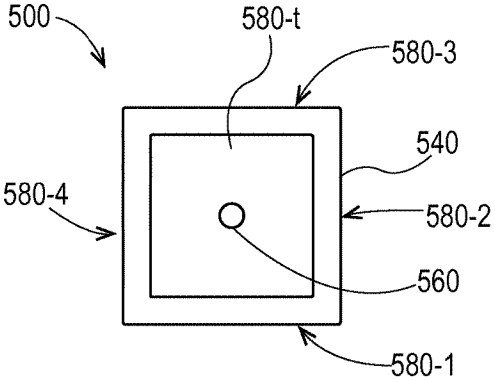
FIG. 5A illustrates a top view of a stand up flexible container having a structural support frame that has an overall shape like a tetragonal prism.
Figure 5D:
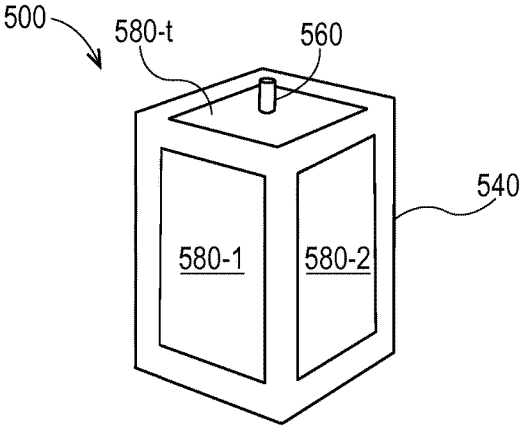
FIG. 5D illustrates an isometric view of the container of FIG. 5A.
Figure 5C:
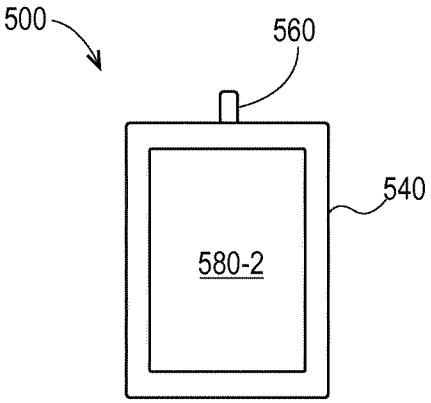
FIG. 5C illustrates a side view of the container of FIG. 5A.

FIG. 5A illustrates a front view of a stand up flexible container 500 having a structural support frame 540 that has an overall shape like a tetragonal prism. In the embodiment of FIG. 5A, the prism shape is based on a square. The support frame 540 is formed by structural support members disposed along the edges of the prism shape and joined together at their ends. The structural support members define a square shaped top panel 580-*t*, rectangular shaped side panels 580-1, 580-2, 580-3, and 580-4, and a square shaped bottom panel (not shown). Each of the side panels 580-1, 580-2, 580-3, and 580-4 is about flat, however in various embodiments, part, parts, or about all, or approximately all, or substantially all, or nearly all, or all of any of the side panels can be approximately flat, substantially flat, nearly flat, or completely flat. The container 500 includes a dispenser 560, which is configured to dispense one or more fluent products from one or more product volumes disposed within the container 500. In the embodiment of FIG. 5A, the dispenser 560 is disposed in the center of the top panel 580-*t*, however, in various alternate embodiments, the dispenser 560 can be disposed anywhere else on the top, sides, or bottom, of the container 500. FIG. 5B illustrates a front view of the container 500 of FIG. 5A, including exemplary additional/alternate locations for a dispenser (shown as phantom lines), any of which can also apply to any side of the container 500. FIG. 5C illustrates a side view of the container 500 of FIG. 5A. FIG. 5D illustrates an isometric view of the container 500 of FIG. 5A.

Figure 5G:
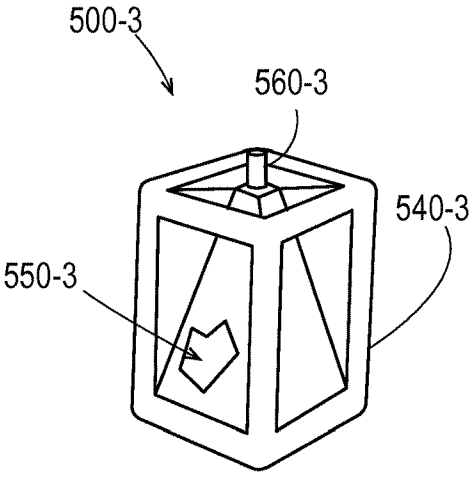
FIG. 5G illustrates a perspective view of an alternative embodiment of the stand up flexible container of FIG. 5A, including an external structural support frame.
Figure 5F:
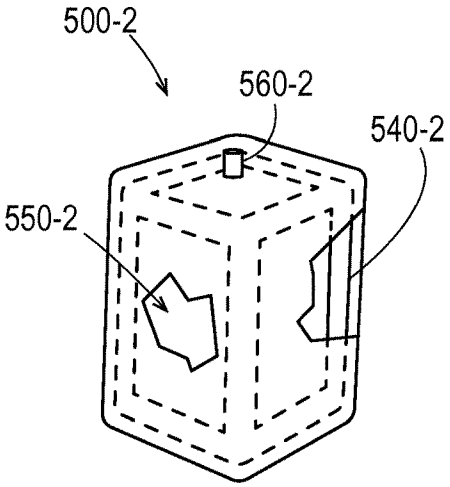
FIG. 5F illustrates a perspective view of an alternative embodiment of the stand up flexible container of FIG. 5A, including an internal structural support frame.
Figure 5E:
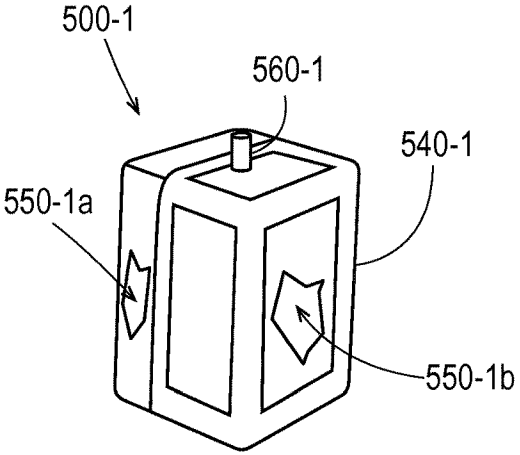
FIG. 5E illustrates a perspective view of an alternative embodiment of the stand up flexible container of FIG. 5A, including an asymmetric structural support frame.

FIG. 5E illustrates a perspective view of a container 500-1, which is an alternative embodiment of the stand up flexible container 500 of FIG. 5A, including an asymmetric structural support frame 540-1, a first portion of the product volume 550-1*b*, a second portion of the product volume 550-1*a*, and a dispenser 560-1, configured in the same manner as the embodiment of FIG. 1E, except based on the container 500. FIG. 5F illustrates a perspective view of a container 500-2, which is an alternative embodiment of the stand up flexible container 500 of FIG. 5A, including an internal structural support frame 540-2, a product volume 550-2, and a dispenser 560-2, configured in the same manner as the embodiment of FIG. 1F, except based on the container 500. FIG. 5G illustrates a perspective view of a container 500-3, which is an alternative embodiment of the stand up flexible container 500 of FIG. 5A, including an external structural support frame 540-3, a non-integral product volume 550-3 joined to and disposed within the frame 540-3, and a dispenser 560-3, configured in the same manner as the embodiment of FIG. 1G, except based on the container 500.

Figure 6B:
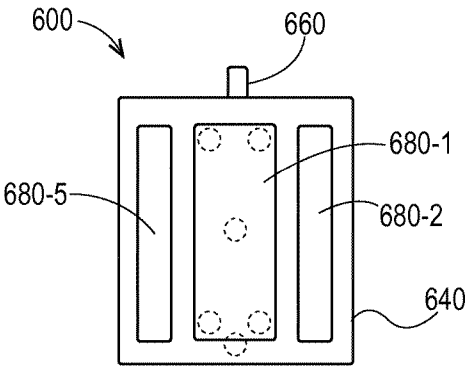
FIG. 6B illustrates a front view of the container of FIG. 6A.
Figure 6A:
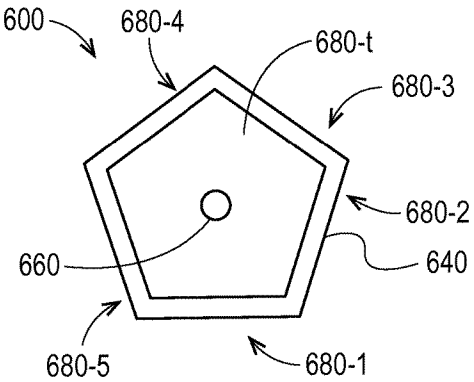
FIG. 6A illustrates a top view of a stand up flexible container having a structural support frame that has an overall shape like a pentagonal prism.
Figure 6D:
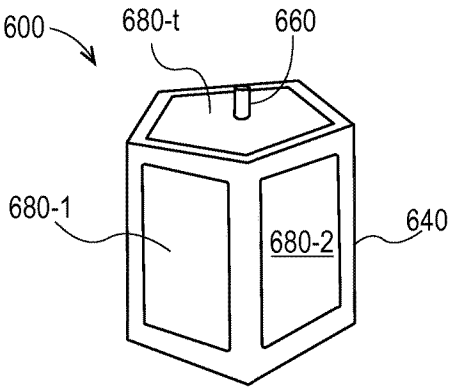
FIG. 6D illustrates an isometric view of the container of FIG. 6A.
Figure 6C:
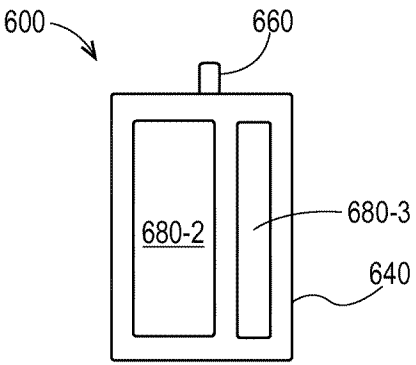
FIG. 6C illustrates a side view of the container of FIG. 6A.

FIG. 6A illustrates a front view of a stand up flexible container 600 having a structural support frame 640 that has an overall shape like a pentagonal prism. In the embodiment of FIG. 6A, the prism shape is based on a pentagon. The support frame 640 is formed by structural support members disposed along the edges of the prism shape and joined together at their ends. The structural support members define a pentagon shaped top panel 680-*t*, rectangular shaped side panels 680-1, 680-2, 680-3, 680-4, and 680-5, and a pentagon shaped bottom panel (not shown). Each of the side panels 680-1, 680-2, 680-3, 680-4, and 680-5 is about flat, however in various embodiments, part, parts, or about all, or approximately all, or substantially all, or nearly all, or all of any of the side panels can be approximately flat, substantially flat, nearly flat, or completely flat. The container 600 includes a dispenser 660, which is configured to dispense one or more fluent products from one or more product volumes disposed within the container 600. In the embodiment of FIG. 6A, the dispenser 660 is disposed in the center of the top panel 680-*t*, however, in various alternate embodiments, the dispenser 660 can be disposed anywhere else on the top, sides, or bottom, of the container 600. FIG. 6B illustrates a front view of the container 600 of FIG. 6A, including exemplary additional/alternate locations for a dispenser (shown as phantom lines), any of which can also apply to any side of the container 600. FIG. 6C illustrates a side view of the container 600 of FIG. 6A. FIG. 6D illustrates an isometric view of the container 600 of FIG. 6A.

Figure 6G:
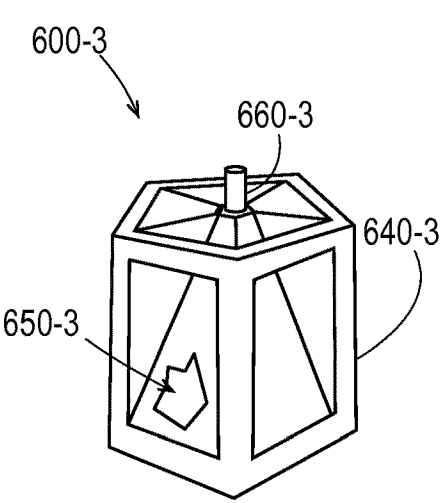
FIG. 6G illustrates a perspective view of an alternative embodiment of the stand up flexible container of FIG. 6A, including an external structural support frame.
Figure 6F:
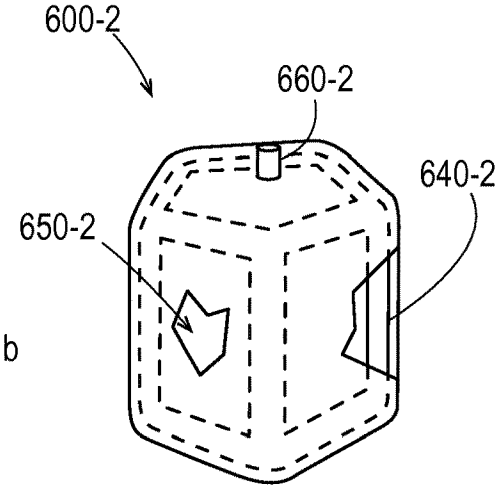
FIG. 6F illustrates a perspective view of an alternative embodiment of the stand up flexible container of FIG. 6A, including an internal structural support frame.
Figure 6E:
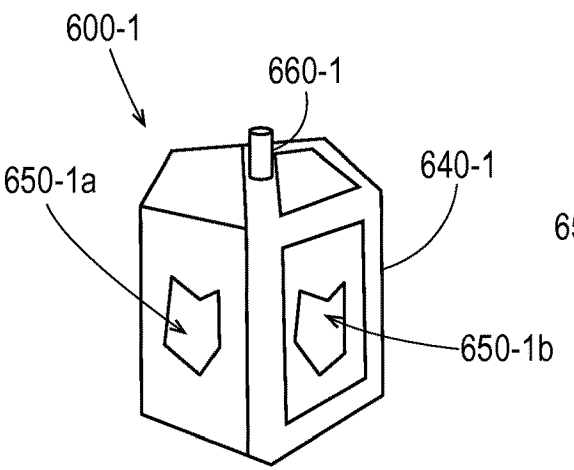
FIG. 6E illustrates a perspective view of an alternative embodiment of the stand up flexible container of FIG. 6A, including an asymmetric structural support frame.

FIG. 6E illustrates a perspective view of a container 600-1, which is an alternative embodiment of the stand up flexible container 600 of FIG. 6A, including an asymmetric structural support frame 640-1, a first portion of the product volume 650-1*b*, a second portion of the product volume 650-1*a*, and a dispenser 660-1, configured in the same manner as the embodiment of FIG. 1E, except based on the container 600. FIG. 6F illustrates a perspective view of a container 600-2, which is an alternative embodiment of the stand up flexible container 600 of FIG. 6A, including an internal structural support frame 640-2, a product volume 650-2, and a dispenser 660-2, configured in the same manner as the embodiment of FIG. 1F, except based on the container 600. FIG. 6G illustrates a perspective view of a container 600-3, which is an alternative embodiment of the stand up flexible container 600 of FIG. 6A, including an external structural support frame 640-3, a non-integral product volume 650-3 joined to and disposed within the frame 640-3, and a dispenser 660-3, configured in the same manner as the embodiment of FIG. 1G, except based on the container 600.

Figure 7B:
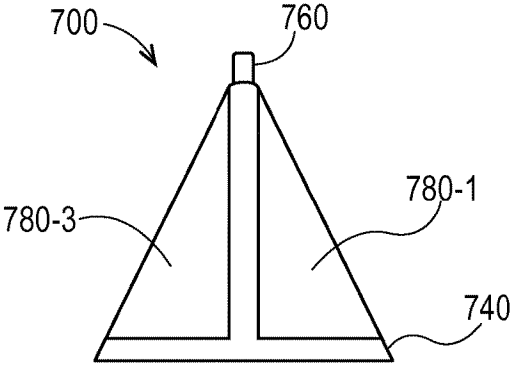
FIG. 7B illustrates a front view of the container of FIG. 7A.
Figure 7D:
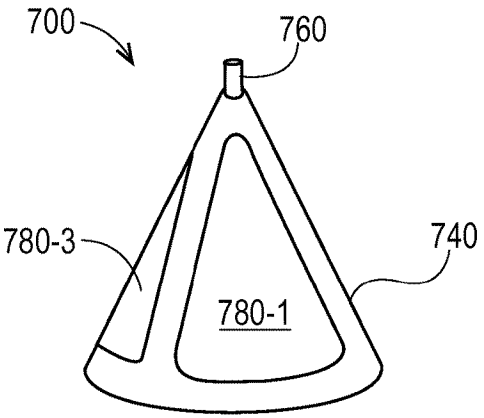
FIG. 7D illustrates an isometric view of the container of FIG. 7A.
Figure 7A:
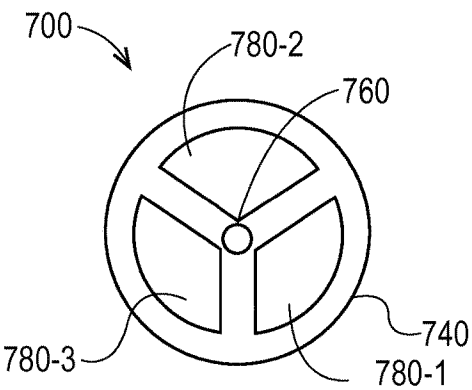
FIG. 7A illustrates a top view of a stand up flexible container having a structural support frame that has an overall shape like a cone.
Figure 7C:
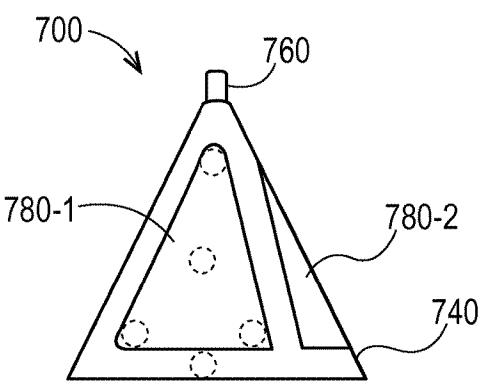
FIG. 7C illustrates a side view of the container of FIG. 7A.

FIG. 7A illustrates a front view of a stand up flexible container 700 having a structural support frame 740 that has an overall shape like a cone. The support frame 740 is formed by curved structural support members disposed around the base of the cone and by straight structural support members extending linearly from the base to the apex, wherein the structural support members are joined together at their ends. The structural support members define curved somewhat triangular shaped side panels 780-1, 780-2, and 780-3, and a circular shaped bottom panel (not shown). Each of the side panels 780-1, 780-2, and 780-3, is curved, however in various embodiments, part, parts, or about all, or approximately all, or substantially all, or nearly all, or all of any of the side panels can be approximately flat, substantially flat, nearly flat, or completely flat. The container 700 includes a dispenser 760, which is configured to dispense one or more fluent products from one or more product volumes disposed within the container 700. In the embodiment of FIG. 7A, the dispenser 760 is disposed at the apex of the conical shape, however, in various alternate embodiments, the dispenser 760 can be disposed anywhere else on the top, sides, or bottom, of the container 700. FIG. 7B illustrates a front view of the container 700 of FIG. 7A. FIG. 7C illustrates a side view of the container 700 of FIG. 7A, including exemplary additional/alternate locations for a dispenser (shown as phantom lines), any of which can also apply to any side panel of the container 700. FIG. 7D illustrates an isometric view of the container 700 of FIG. 7A.

Figure 7G:
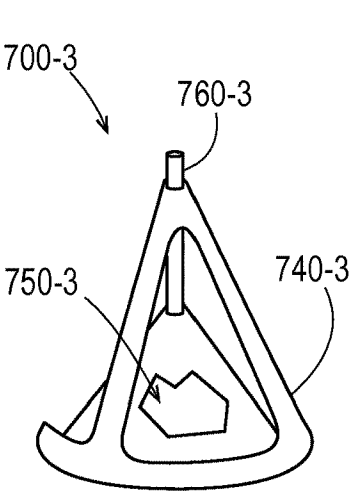
FIG. 7G illustrates a perspective view of an alternative embodiment of the stand up flexible container of FIG. 7A, including an external structural support frame.
Figure 7F:
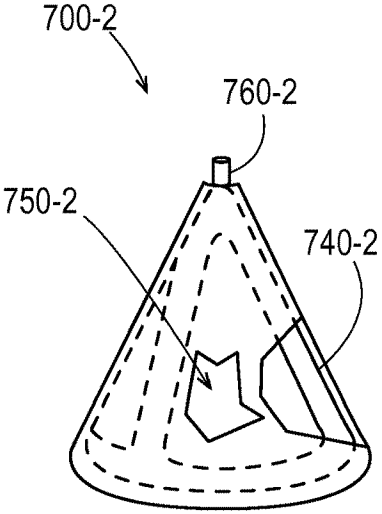
FIG. 7F illustrates a perspective view of an alternative embodiment of the stand up flexible container of FIG. 7A, including an internal structural support frame.
Figure 7E:
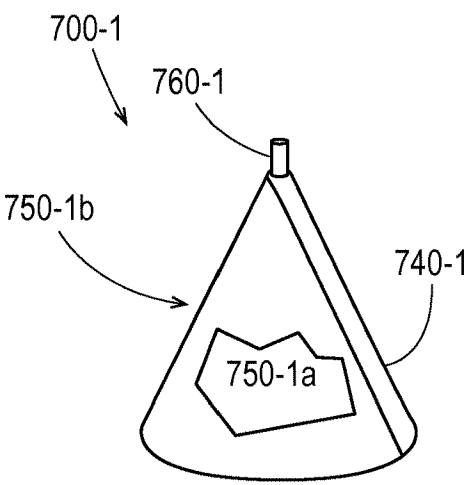
FIG. 7E illustrates a perspective view of an alternative embodiment of the stand up flexible container of FIG. 7A, including an asymmetric structural support frame.

FIG. 7E illustrates a perspective view of a container 700-1, which is an alternative embodiment of the stand up flexible container 700 of FIG. 7A, including an asymmetric structural support frame 740-1, a first portion of the product volume 750-1*b*, a second portion of the product volume 750-1*a*, and a dispenser 760-1, configured in the same manner as the embodiment of FIG. 1E, except based on the container 700. FIG. 7F illustrates a perspective view of a container 700-2, which is an alternative embodiment of the stand up flexible container 700 of FIG. 7A, including an internal structural support frame 740-2, a product volume 750-2, and a dispenser 760-2, configured in the same manner as the embodiment of FIG. 1F, except based on the container 700. FIG. 7G illustrates a perspective view of a container 700-3, which is an alternative embodiment of the stand up flexible container 700 of FIG. 7A, including an external structural support frame 740-3, a non-integral product volume 750-3 joined to and disposed within the frame 740-3, and a dispenser 760-3, configured in the same manner as the embodiment of FIG. 1G, except based on the container 700.

Figure 8B:
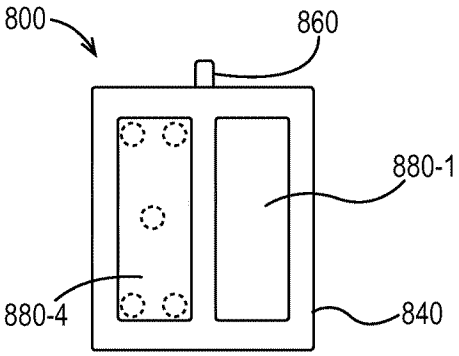
FIG. 8B illustrates a front view of the container of FIG. 8A.
Figure 8D:
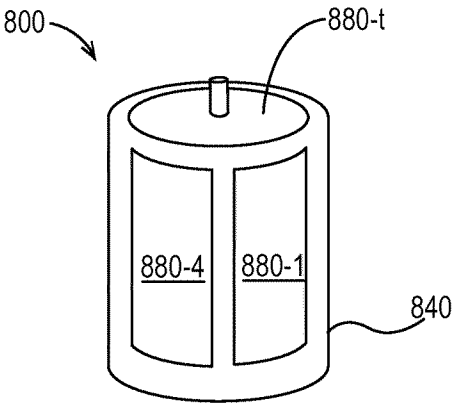
FIG. 8D illustrates an isometric view of the container of FIG. 8A.
Figure 8A:
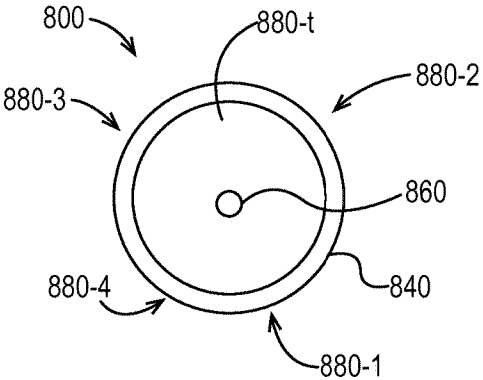
FIG. 8A illustrates a top view of a stand up flexible container having a structural support frame that has an overall shape like a cylinder.
Figure 8C:
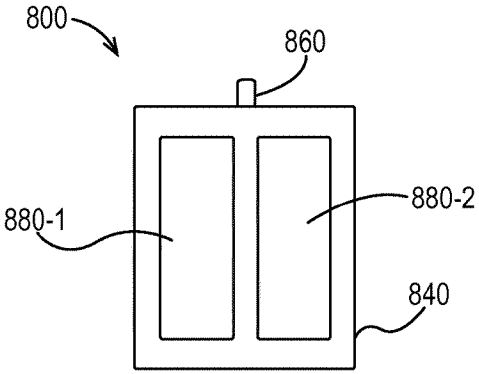
FIG. 8C illustrates a side view of the container of FIG. 8A.

FIG. 8A illustrates a front view of a stand up flexible container 800 having a structural support frame 840 that has an overall shape like a cylinder. The support frame 840 is formed by curved structural support members disposed around the top and bottom of the cylinder and by straight structural support members extending linearly from the top to the bottom, wherein the structural support members are joined together at their ends. The structural support members define a circular shaped top panel 880-*t*, curved somewhat rectangular shaped side panels 880-1, 880-2, 880-3, and 880-4, and a circular shaped bottom panel (not shown). Each of the side panels 880-1, 880-2, 880-3, and 880-4, is curved, however in various embodiments, part, parts, or about all, or approximately all, or substantially all, or nearly all, or all of any of the side panels can be approximately flat, substantially flat, nearly flat, or completely flat. The container 800 includes a dispenser 860, which is configured to dispense one or more fluent products from one or more product volumes disposed within the container 800. In the embodiment of FIG. 8A, the dispenser 860 is disposed in the center of the top panel 880-*t*, however, in various alternate embodiments, the dispenser 860 can be disposed anywhere else on the top, sides, or bottom, of the container 800. FIG. 8B illustrates a front view of the container 800 of FIG. 8A, including exemplary additional/alternate locations for a dispenser (shown as phantom lines), any of which can also apply to any side panel of the container 800. FIG. 8C illustrates a side view of the container 800 of FIG. 8A. FIG. 8D illustrates an isometric view of the container 800 of FIG. 8A.

Figure 8G:
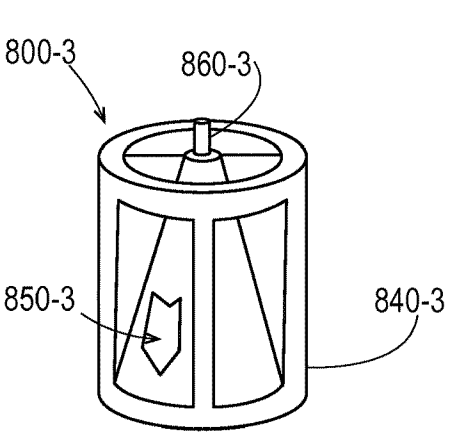
FIG. 8G illustrates a perspective view of an alternative embodiment of the stand up flexible container of FIG. 8A, including an external structural support frame.
Figure 8F:
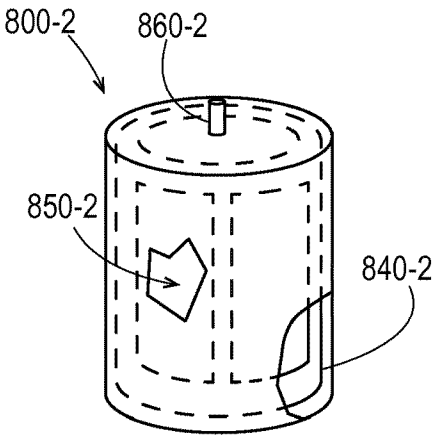
FIG. 8F illustrates a perspective view of an alternative embodiment of the stand up flexible container of FIG. 8A, including an internal structural support frame.
Figure 8E:
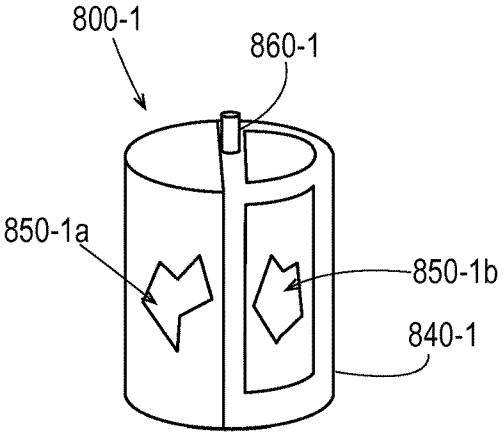
FIG. 8E illustrates a perspective view of an alternative embodiment of the stand up flexible container of FIG. 8A, including an asymmetric structural support frame.

FIG. 8E illustrates a perspective view of a container 800-1, which is an alternative embodiment of the stand up flexible container 800 of FIG. 8A, including an asymmetric structural support frame 840-1, a first portion of the product volume 850-1*b*, a second portion of the product volume 850-1*a*, and a dispenser 860-1, configured in the same manner as the embodiment of FIG. 1E, except based on the container 800. FIG. 8F illustrates a perspective view of a container 800-2, which is an alternative embodiment of the stand up flexible container 800 of FIG. 8A, including an internal structural support frame 840-2, a product volume 850-2, and a dispenser 860-2, configured in the same manner as the embodiment of FIG. 1F, except based on the container 800. FIG. 8G illustrates a perspective view of a container 800-3, which is an alternative embodiment of the stand up flexible container 800 of FIG. 8A, including an external structural support frame 840-3, a non-integral product volume 850-3 joined to and disposed within the frame 840-3, and a dispenser 860-3, configured in the same manner as the embodiment of FIG. 1G, except based on the container 800.

In additional embodiments, any stand up flexible container with a structural support frame, as disclosed herein, can be configured to have an overall shape that corresponds with any other known three-dimensional shape, including any kind of polyhedron, any kind of prismatoid, and any kind of prism (including right prisms and uniform prisms).

Figure 9B:
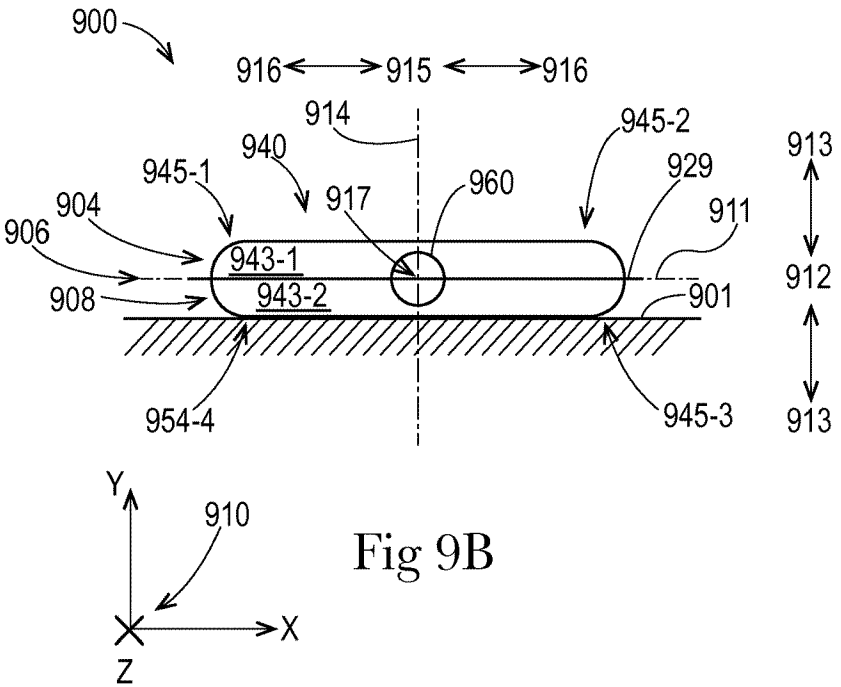
FIG. 9B illustrates an end view of the flexible container of FIG. 9A.
Figure 9A:
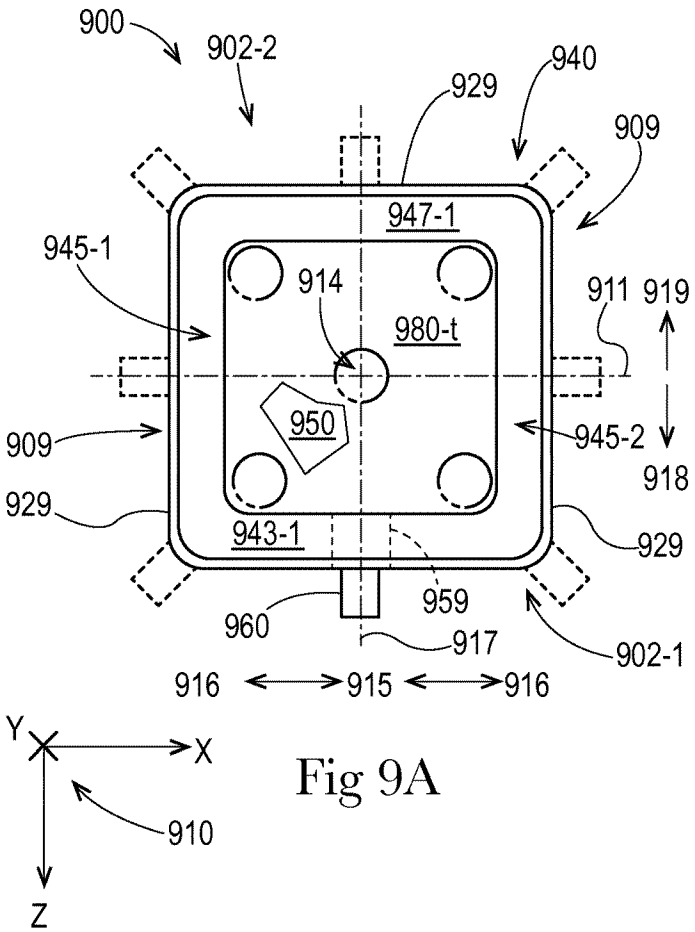
FIG. 9A illustrates a top view of an embodiment of a self-supporting flexible container, having an overall shape like a square.

FIG. 9A illustrates a top view of an embodiment of a self-supporting flexible container 900, having an overall shape like a square. FIG. 9B illustrates an end view of the flexible container 900 of FIG. 9A. The container 900 is resting on a horizontal support surface 901.

In FIG. 9B, a coordinate system 910, provides lines of reference for referring to directions in the figure. The coordinate system 910 is a three-dimensional Cartesian coordinate system, with an X-axis, a Y-axis, and a Z-axis. The X-axis and the Z-axis are parallel with the horizontal support surface 901 and the Y-axis is perpendicular to the horizontal support surface 901.

FIG. 9A also includes other lines of reference, for referring to directions and locations with respect to the container 100. A lateral centerline 911 runs parallel to the X-axis. An XY plane at the lateral centerline 911 separates the container 100 into a front half and a back half. An XZ plane at the lateral centerline 911 separates the container 100 into an upper half and a lower half. A longitudinal centerline 914 runs parallel to the Y-axis. A YZ plane at the longitudinal centerline 914 separates the container 900 into a left half and a right half. A third centerline 917 runs parallel to the Z-axis. The lateral centerline 911, the longitudinal centerline 914, and the third centerline 917 all intersect at a center of the container 900. These terms for direction, orientation, measurement, and disposition, in the embodiment of FIGS. 9A-9B are the same as the like-numbered terms in the embodiment of FIGS. 1A-1D.

The container 900 includes a top 904, a middle 906, and a bottom 908, the front 902-1, the back 902-2, and left and right sides 909. In the embodiment of FIGS. 9A-9B, the upper half and the lower half of the container are joined together at a seal 929, which extends around the outer periphery of the container 900. The bottom of the container 900 is configured in the same way as the top of the container 900.

The container 900 includes a structural support frame 940, a product volume 950, a dispenser 960, a top panel 980-*t* and a bottom panel (not shown). A portion of the top panel 980-*t* is illustrated as broken away, in order to show the product volume 950. The product volume 950 is configured to contain one or more fluent products. The dispenser 960 allows the container 900 to dispense these fluent product(s) from the product volume 950 through a flow channel 959 then through the dispenser 960, to the environment outside of the container 900. The structural support frame 940 supports the mass of fluent product(s) in the product volume 950. The top panel 980-*t* and the bottom panel are relatively flat surfaces, overlaying the product volume 950, and are suitable for displaying any kind of indicia.

The structural support frame 940 is formed by a plurality of structural support members. The structural support frame 940 includes front structural support members 943-1 and 943-2, intermediate structural support members 945-1, 945-2, 945-3, and 945-4, as well as back structural support members 947-1 and 947-2. Overall, each of the structural support members in the container 900 is oriented horizontally. And, each of the structural support members in the container 900 has a cross-sectional area that is substantially uniform along its length, although in various embodiments, this cross-sectional area can vary.

Upper structural support members 943-1, 945-1, 945-2, and 947-1 are disposed in an upper part of the middle 906 and in the top 904, while lower structural support members 943-2, 945-4, 945-3, and 947-2 are disposed in a lower part of the middle 906 and in the bottom 908. The upper structural support members 943-1, 945-1, 945-2, and 947-1 are disposed above and adjacent to the lower structural support members 943-2, 945-4, 945-3, and 947-2, respectively.

In various embodiments, adjacent upper and lower structural support members can be in contact with each other at one or more relatively smaller locations and/or at one or more relatively larger locations, along part, or parts, or about all, or approximately all, or substantially all, or nearly all, or all of their overall lengths, so long as there is a gap in the contact for the flow channel 959, between the structural support members 943-1 and 943-2. In the embodiment of FIGS. 9A-9B, the upper and lower structural support members are not directly connected to each other. However, in various alternate embodiments, adjacent upper and lower structural support members can be directly connected and/or joined together along part, or parts, or about all, or approximately all, or substantially all, or nearly all, or all of their overall lengths.

The ends of structural support members 943-1, 945-2, 947-1, and 945-1 are joined together to form a top square that is outward from and surrounding the product volume 950, and the ends of structural support members 943-2, 945-3, 947-2, and 945-4 are also joined together to form a bottom square that is outward from and surrounding the product volume 950. In the structural support frame 940, the ends of the structural support members, which are joined together, are directly connected, all around the periphery of their walls. However, in various alternative embodiments, any of the structural support members of the embodiment of FIGS. 9A-9B can be joined together in any way described herein or known in the art.

In alternative embodiments of the structural support frame 940, adjacent structural support members can be combined into a single structural support member, wherein the combined structural support member can effectively substitute for the adjacent structural support members, as their functions and connections are described herein. In other alternative embodiments of the structural support frame 940, one or more additional structural support members can be added to the structural support members in the structural support frame 940, wherein the expanded structural support frame can effectively substitute for the structural support frame 940, as its functions and connections are described herein.

Figure 9E:
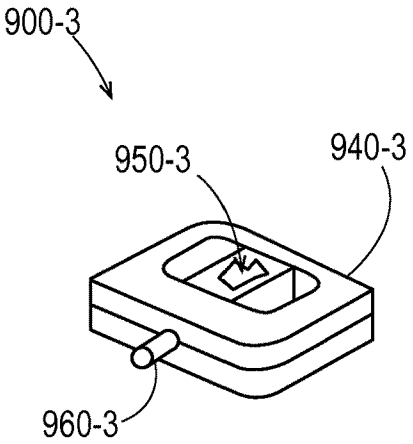
FIG. 9E illustrates a perspective view of an alternative embodiment of the self-supporting flexible container of FIG. 9A, including an external structural support frame.
Figure 9D:
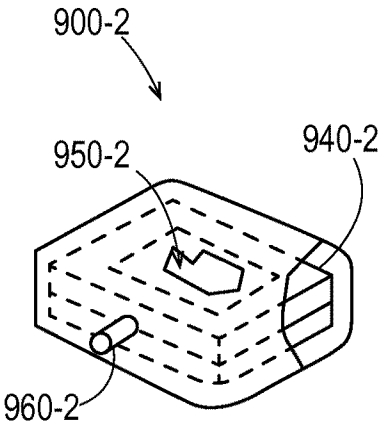
FIG. 9D illustrates a perspective view of an alternative embodiment of the self-supporting flexible container of FIG. 9A, including an internal structural support frame.
Figure 9C:
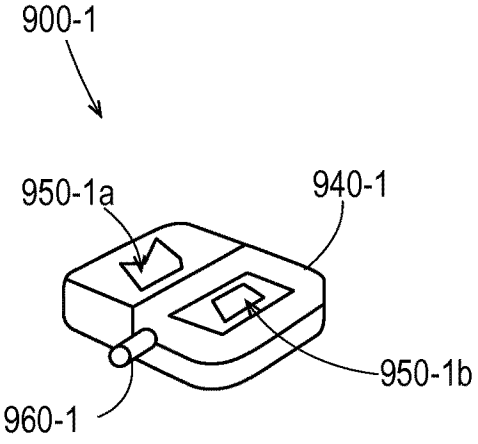
FIG. 9C illustrates a perspective view of an alternative embodiment of the self-supporting flexible container of FIG. 9A, including an asymmetric structural support frame.

FIG. 9C illustrates a perspective view of a container 900-1, which is an alternative embodiment of the self-supporting flexible container 900 of FIG. 1A, including an asymmetric structural support frame 940-1, a first portion of the product volume 950-1*b*, a second portion of the product volume 950-1*a*, and a dispenser 960-1. The embodiment of FIG. 9C is similar to the embodiment of FIG. 9A with like-numbered terms configured in the same way, except that the frame 940-1 extends around about half of the container 900-1, directly supporting a first portion of the product volume 950-1*b*, which is disposed inside of the frame 940-1, and indirectly supporting a second portion of the product volume 950-1*a*, which is disposed outside of the frame 940-1. In various embodiments, any self-supporting flexible container of the present disclosure can be modified in a similar way, such that: the frame extends around only part or parts of the container, and/or the frame is asymmetric with respect to one or more centerlines of the container, and/or part or parts of one or more product volumes of the container are disposed outside of the frame, and/or part or parts of one or more product volumes of the container are indirectly supported by the frame.

FIG. 9D illustrates a perspective view of a container 900-2, which is an alternative embodiment of the self-supporting flexible container 900 of FIG. 9A, including an internal structural support frame 940-2, a product volume 950-2, and a dispenser 960-2. The embodiment of FIG. 9D is similar to the embodiment of FIG. 9A with like-numbered terms configured in the same way, except that the frame 940-2 is internal to the product volume 950-2. In various embodiments, any self-supporting flexible container of the present disclosure can be modified in a similar way, such that: part, parts, or all of the frame (including part, parts, or all of one or more of any structural support members that form the frame) are about, approximately, substantially, nearly, or completely enclosed by one or more product volumes.

FIG. 9E illustrates a perspective view of a container 900-3, which is an alternative embodiment of the stand up flexible container 900 of FIG. 9A, including an external structural support frame 940-3, a product volume 950-3, and a dispenser 960-3. The embodiment of FIG. 9E is similar to the embodiment of FIG. 9A with like-numbered terms configured in the same way, except that the product volume 950-3 is not integrally connected to the frame 940-3 (that is, not simultaneously made from the same web of flexible materials), but rather the product volume 950-3 is separately made and then joined to the frame 940-3. The product volume 950-3 can be joined to the frame in any convenient manner disclosed herein or known in the art. In the embodiment of FIG. 9E, the product volume 950-3 is disposed within the frame 940-3, but the product volume 950-3 has a reduced size and a somewhat different shape, when compared with the product volume 950 of FIG. 9A; however, these differences are made to illustrate the relationship between the product volume 950-3 and the frame 940-3, and are not required. In various embodiments, any self-supporting flexible container of the present disclosure can be modified in a similar way, such that one or more the product volumes are not integrally connected to the frame.

FIGS. 10A-11E illustrate embodiments of self-supporting flexible containers (that are not stand up containers) having various overall shapes. Any of the embodiments of FIGS. 10A-11E can be configured according to any of the embodiments disclosed herein, including the embodiments of FIGS. 9A-9E. Any of the elements (e.g. structural support frames, structural support members, panels, dispensers, etc.) of the embodiments of FIGS. 10A-11E, can be configured according to any of the embodiments disclosed herein. While each of the embodiments of FIGS. 10A-11E illustrates a container with one dispenser, in various embodiments, each container can include multiple dispensers, according to any embodiment described herein. Part, parts, or about all, or approximately all, or substantially all, or nearly all, or all of each of the panels in the embodiments of FIGS. 10A-11E is suitable to display any kind of indicia. Each of the top and bottom panels in the embodiments of FIGS. 10A-11E is configured to be a nonstructural panel, overlaying product volume(s) disposed within the flexible container, however, in various embodiments, one or more of any kind of decorative or structural element (such as a rib, protruding from an outer surface) can be joined to part, parts, or about all, or approximately all, or substantially all, or nearly all, or all of any of these panels. For clarity, not all structural details of these flexible containers are shown in FIGS. 10A-11E, however any of the embodiments of FIGS. 10A-11E can be configured to include any structure or feature for flexible containers, disclosed herein.

Figure 10B:
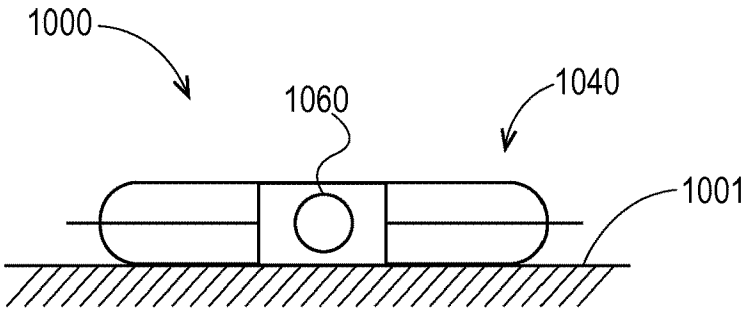
FIG. 10B illustrates an end view of the flexible container of FIG. 10A.
Figure 10A:
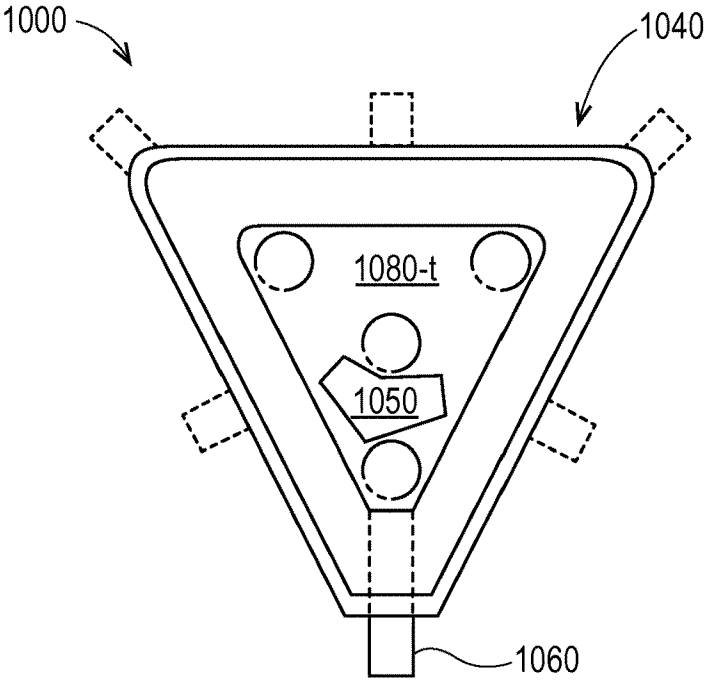
FIG. 10A illustrates a top view of an embodiment of a self-supporting flexible container, having an overall shape like a triangle.

FIG. 10A illustrates a top view of an embodiment of a self-supporting flexible container 1000 (that is not a stand up flexible container) having a product volume 1050 and an overall shape like a triangle. However, in various embodiments, a self-supporting flexible container can have an overall shape like a polygon having any number of sides. The support frame 1040 is formed by structural support members disposed along the edges of the triangular shape and joined together at their ends. The structural support members define a triangular shaped top panel 1080-*t*, and a triangular shaped bottom panel (not shown). The top panel 1080-*t* and the bottom panel are about flat, however in various embodiments, part, parts, or about all, or approximately all, or substantially all, or nearly all, or all of any of the side panels can be approximately flat, substantially flat, nearly flat, or completely flat. The container 1000 includes a dispenser 1060, which is configured to dispense one or more fluent products from one or more product volumes disposed within the container 1000. In the embodiment of FIG. 10A, the dispenser 1060 is disposed in the center of the front, however, in various alternate embodiments, the dispenser 1060 can be disposed anywhere else on the top, sides, or bottom, of the container 1000. FIG. 10A includes exemplary additional/alternate locations for a dispenser (shown as phantom lines). FIG. 10B illustrates an end view of the flexible container 1000 of FIG. 10B, resting on a horizontal support surface 1001.

Figure 10E:
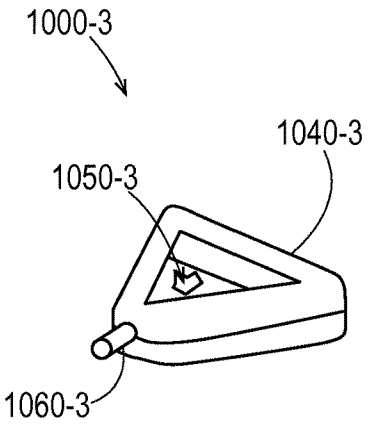
FIG. 10E illustrates a perspective view of an alternative embodiment of the self-supporting flexible container of FIG. 10A, including an external structural support frame.
Figure 10D:
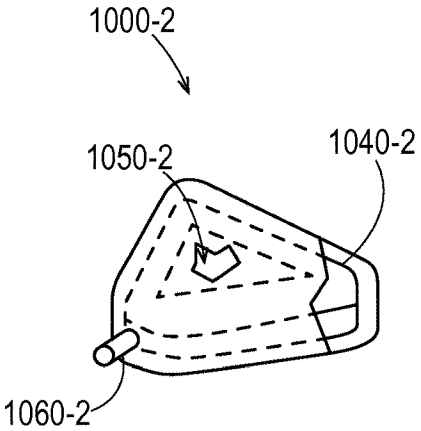
FIG. 10D illustrates a perspective view of an alternative embodiment of the self-supporting flexible container of FIG. 10A, including an internal structural support frame.
Figure 10C:
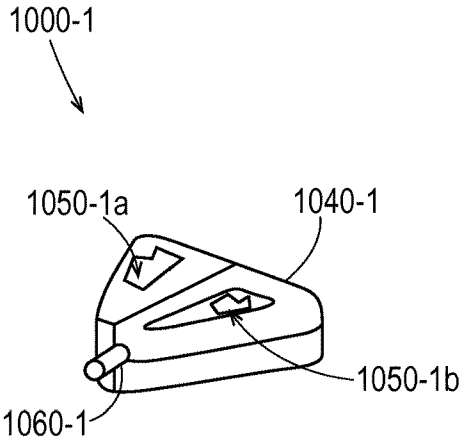
FIG. 10C illustrates a perspective view of an alternative embodiment of the self-supporting flexible container of FIG. 10A, including an asymmetric structural support frame.

FIG. 10C illustrates a perspective view of a container 1000-1, which is an alternative embodiment of the self-supporting flexible container 1000 of FIG. 10A, including an asymmetric structural support frame 1040-1, a first portion of the product volume 1050-1*b*, a second portion of the product volume 1050-1*a*, and a dispenser 1060-1, configured in the same manner as the embodiment of FIG. 9C, except based on the container 1000. FIG. 10D illustrates a perspective view of a container 1000-2, which is an alternative embodiment of the self-supporting flexible container 1000 of FIG. 10A, including an internal structural support frame 1040-2, a product volume 1050-2, and a dispenser 1060-2, configured in the same manner as the embodiment of FIG. 9D, except based on the container 1000. FIG. 10E illustrates a perspective view of a container 1000-3, which is an alternative embodiment of the self-supporting flexible container 1000 of FIG. 10A, including an external structural support frame 1040-3, a non-integral product volume 1050-3 joined to and disposed within the frame 1040-3, and a dispenser 1060-3, configured in the same manner as the embodiment of FIG. 9E, except based on the container 1000.

Figure 11B:
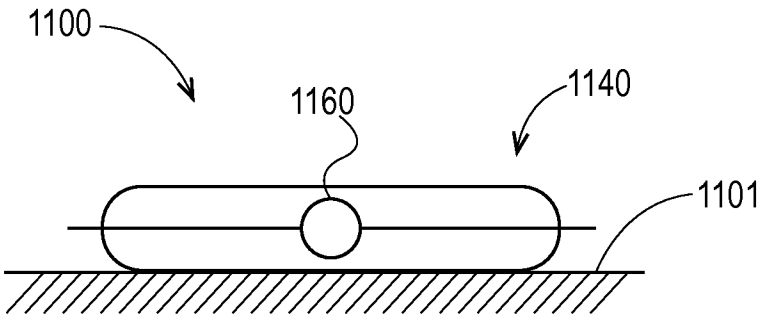
FIG. 11B illustrates an end view of the flexible container of FIG. 11A.
Figure 11A:
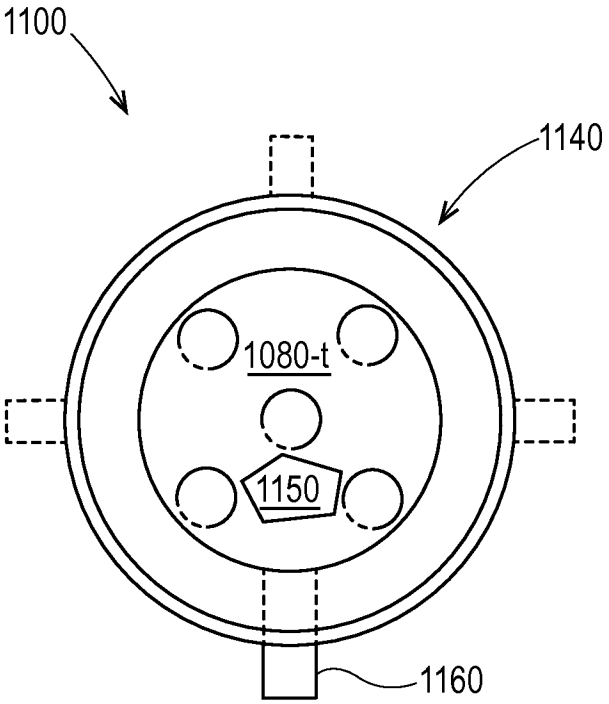
FIG. 11A illustrates a top view of an embodiment of a self-supporting flexible container, having an overall shape like a circle.

FIG. 11A illustrates a top view of an embodiment of a self-supporting flexible container 1100 (that is not a stand up flexible container) having a product volume 1150 and an overall shape like a circle. The support frame 1140 is formed by structural support members disposed around the circumference of the circular shape and joined together at their ends. The structural support members define a circular shaped top panel 1180-*t*, and a circular shaped bottom panel (not shown). The top panel 1180-*t* and the bottom panel are about flat, however in various embodiments, part, parts, or about all, or approximately all, or substantially all, or nearly all, or all of any of the side panels can be approximately flat, substantially flat, nearly flat, or completely flat. The container 1100 includes a dispenser 1160, which is configured to dispense one or more fluent products from one or more product volumes disposed within the container 1100. In the embodiment of FIG. 11A, the dispenser 1160 is disposed in the center of the front, however, in various alternate embodiments, the dispenser 1160 can be disposed anywhere else on the top, sides, or bottom, of the container 1100. FIG. 11A includes exemplary additional/alternate locations for a dispenser (shown as phantom lines). FIG. 11B illustrates an end view of the flexible container 1100 of FIG. 10B, resting on a horizontal support surface 1101.

Figure 11E:
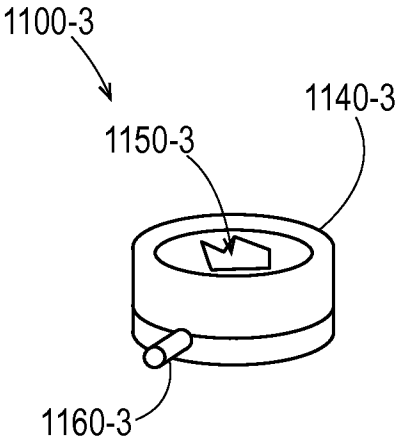
FIG. 11E illustrates a perspective view of an alternative embodiment of the self-supporting flexible container of FIG. 11A, including an external structural support frame.
Figure 11D:
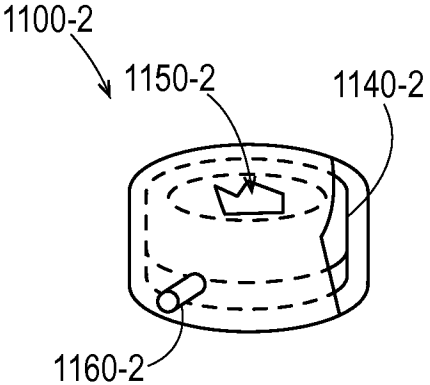
FIG. 11D illustrates a perspective view of an alternative embodiment of the self-supporting flexible container of FIG. 11A, including an internal structural support frame.
Figure 11C:
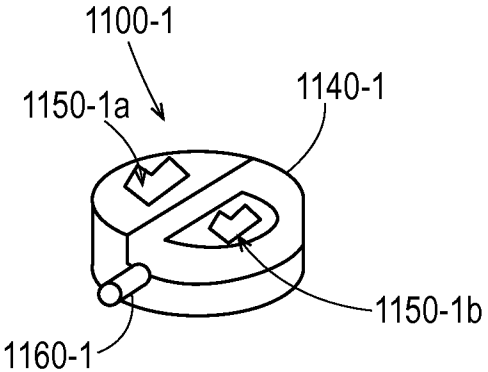
FIG. 11C illustrates a perspective view of an alternative embodiment of the self-supporting flexible container of FIG. 11A, including an asymmetric structural support frame.

FIG. 11C illustrates a perspective view of a container 1100-1, which is an alternative embodiment of the self-supporting flexible container 1100 of FIG. 11A, including an asymmetric structural support frame 1140-1, a first portion of the product volume 1150-1*b*, a second portion of the product volume 1150-1*a*, and a dispenser 1160-1, configured in the same manner as the embodiment of FIG. 9C, except based on the container 1100. FIG. 11D illustrates a perspective view of a container 1100-2, which is an alternative embodiment of the self-supporting flexible container 1100 of FIG. 11A, including an internal structural support frame 1140-2, a product volume 1150-2, and a dispenser 1160-2, configured in the same manner as the embodiment of FIG. 9D, except based on the container 1100. FIG. 11E illustrates a perspective view of a container 1100-3, which is an alternative embodiment of the self-supporting flexible container 1100 of FIG. 11A, including an external structural support frame 1140-3, a non-integral product volume 1150-3 joined to and disposed within the frame 1140-3, and a dispenser 1160-3, configured in the same manner as the embodiment of FIG. 9E, except based on the container 1100.

In additional embodiments, any self-supporting container with a structural support frame, as disclosed herein, can be configured to have an overall shape that corresponds with any other known three-dimensional shape. For example, any self-supporting container with a structural support frame, as disclosed herein, can be configured to have an overall shape (when observed from a top view) that corresponds with a rectangle, a polygon (having any number of sides), an oval, an ellipse, a star, or any other shape, or combinations of any of these.

Figure 12A:
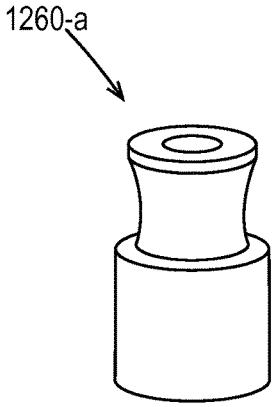
FIG. 12A illustrates an isometric view of push-pull type dispenser.
Figure 12B:
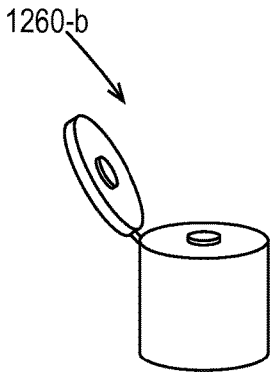
FIG. 12B illustrates an isometric view of dispenser with a flip-top cap.
Figure 12C:
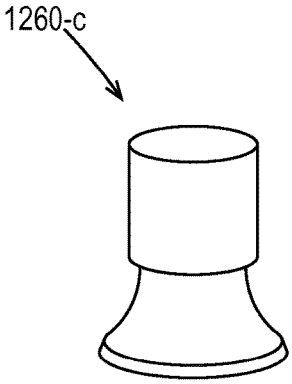
FIG. 12C illustrates an isometric view of dispenser with a screw-on cap.
Figure 12D:
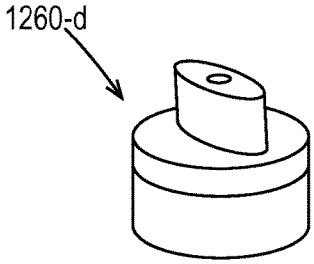
FIG. 12D illustrates an isometric view of rotatable type dispenser.
Figure 12E:
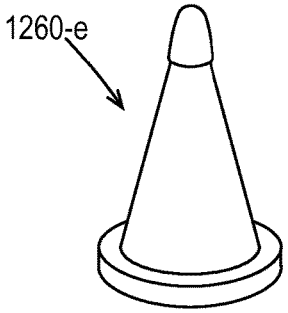
FIG. 12E illustrates an isometric view of nozzle type dispenser with a cap.
Figures 13A, 13B, 13C, 13D:
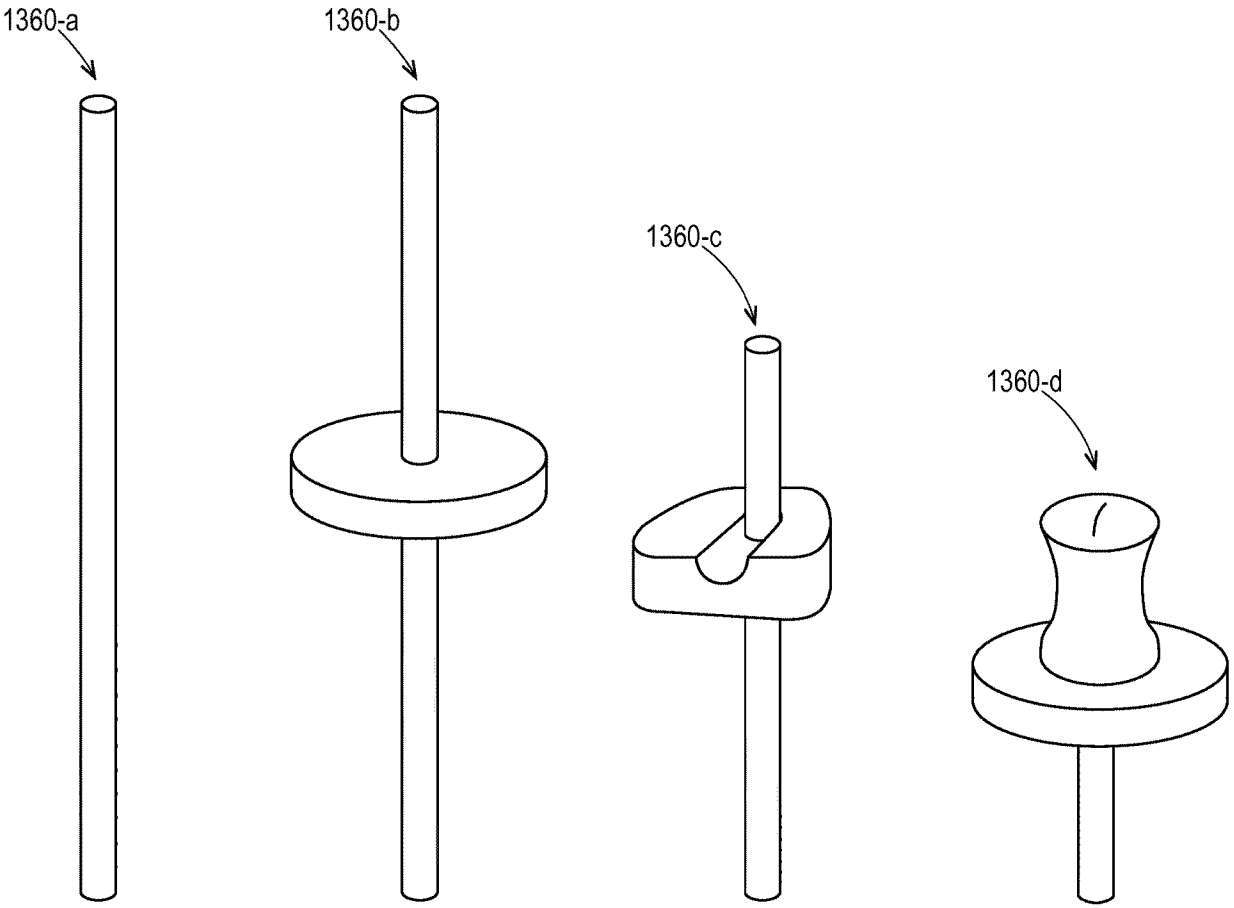
FIG. 13A illustrates an isometric view of straw dispenser.
FIG. 13B illustrates an isometric view of straw dispenser with a lid.
FIG. 13C illustrates an isometric view of flip up straw dispenser.
FIG. 13D illustrates an isometric view of straw dispenser with bite valve.
Figure 14A:
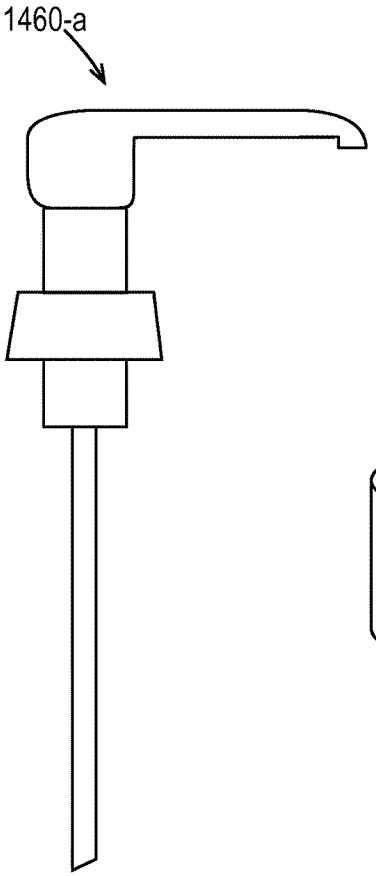
FIG. 14A illustrates an isometric view of pump type dispenser.
Figure 14B:
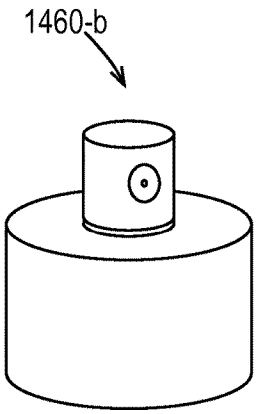
FIG. 14B illustrates an isometric view of pump spray type dispenser.
Figure 14C:
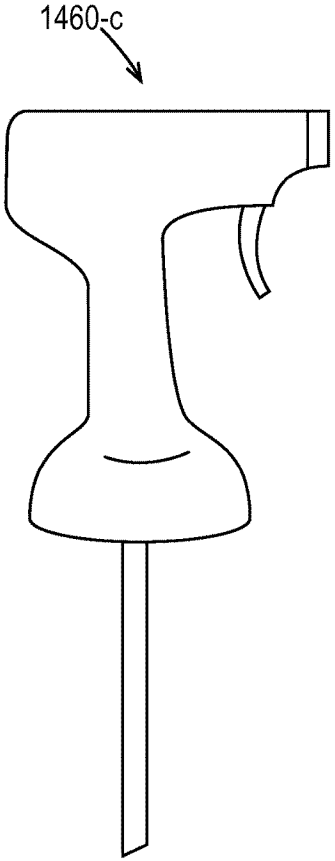
FIG. 14C illustrates an isometric view of trigger spray type dispenser.

FIGS. 12A-14C illustrate various exemplary dispensers, which can be used with the flexible containers disclosed herein. FIG. 12A illustrates an isometric view of push-pull type dispenser 1260-*a*. FIG. 12B illustrates an isometric view of dispenser with a flip-top cap 1260-*b*. FIG. 12C illustrates an isometric view of dispenser with a screw-on cap 1260-*c*. FIG. 12D illustrates an isometric view of rotatable type dispenser 1260-*d*. FIG. 12E illustrates an isometric view of nozzle type dispenser with a cap 1260-*d*. FIG. 13A illustrates an isometric view of straw dispenser 1360-*a*. FIG. 13B illustrates an isometric view of straw dispenser with a lid 1360-*b*. FIG. 13C illustrates an isometric view of flip up straw dispenser 1360-*c*. FIG. 13D illustrates an isometric view of straw dispenser with bite valve 1360-*d*. FIG. 14A illustrates an isometric view of pump type dispenser 1460-*a*, which can, in various embodiments be a foaming pump type dispenser. FIG. 14B illustrates an isometric view of pump spray type dispenser 1460-*b*. FIG. 14C illustrates an isometric view of trigger spray type dispenser 1460-*c*.

A flexible container in accordance with embodiments of the disclosure can be formed by folding one or more webs or sheets of flexible material to define one or more gussets, one or more product dispensing openings, one or more product filling ports, and/or one or more structural support volume expansion ports. For example, in various embodiments, a flexible container can be formed from one web or sheet or two webs or sheets. Prior to folding, one or more seals can be formed in the two webs or sheets to join the webs and define at least a portion of an inner boundary of the structural support volume of the flexible package. One or more seals can also be formed in the two webs or sheets to join the webs and define at least a portion of the boundary of one or more a structural support volume expansion port. In an embodiment, one or more boundaries, including for example, opposed boundaries, of the structural support volume expansion port can be defined in the web or sheet prior to folding. In other embodiments, one or more of the boundaries of the expansion port can be defined during the folding process. For example, the boundaries of the one or more expansion ports can be defined during the folding process when defining the boundaries of the product filling port (if present). The boundaries of the product filling port and the boundaries of the expansion port can overlap. For example, the expansion port and the product filling port can share a common boundary. The expansion port can alternatively have boundaries disposed within the boundaries of the product filling port. The structural support volume and correspondingly the expansion port is defined between the two web or sheets, while the product volume and correspondingly the filling port is defined between facing portions of the inner web or sheet resulting from folding the web or sheet.

It should be understood herein that while reference in the following description is to "a web or sheet" one or more webs or sheets can be present during the process. One or more of the web(s) or sheet(s) may be comprised by a multi-layer film. The multi-layer film may comprise about 2, 3, 4, 5, or up to about 1000 film layers. Adjacent film layers within the multi-layer film may be in partial co-facial arrangement where one film overlies in part the adjacent film, or a completely co-facial arrangement where one film overlies in part the adjacent film.

FIGS. 15A through 21 illustrate various steps in forming webs into flexible containers, with each figure illustrating a side view of a cross-section of a web (i.e. from a viewpoint that is parallel to the machine direction for the web).

In the embodiments of FIGS. 15A through 21, the lengths, widths, and thicknesses of the webs can be chosen to be convenient and suitable values, to form flexible containers of various sizes, shapes, and proportions, as will be understood by one skilled in the art.

It is noted that in the following embodiments of FIGS. 15A through 15I, the forming (folding, joining) of the flexible container is oriented in the illustrations as being formed more in a horizontal orientation with the bottom being formed on the left side of the diagram, and the top being formed on the right side.

Referring to FIGS. 15A-15I, in an embodiment, a flexible container can be formed from a web or sheet such that the container includes a gusset in a bottom of the container and an interrupted gusset in the top of the container.

Figure 15A:
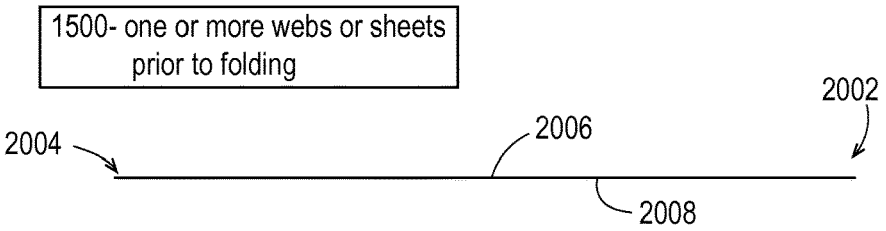
FIG. 15A illustrates one or more webs or sheets to be used in a method of forming a flexible container in accordance with an embodiment of the disclosure.

As illustrated in FIG. 15A, step 1500, the web or sheet includes a first edge 2002 and a second edge 2004 as well as a first surface 2006 *a* and second surface 2008, which are opposed to each other and extending between the first edge 2002 and the second edge 2004.

Figure 15B:
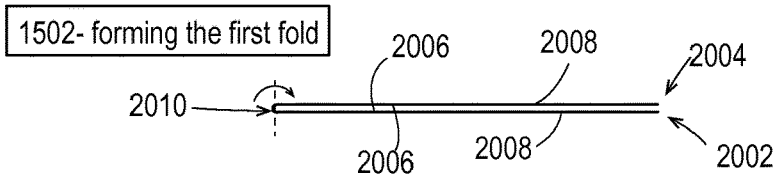
FIG. 15B illustrates the one or more webs or sheets of FIG. 15A, at a later point in time, in a step of forming a first fold, in the method of forming a flexible container in accordance with an embodiment of the disclosure.

As illustrated in FIG. 15B, at step 1502, a first fold 2010 can be formed in the web or sheet by folding the second edge 2004 towards the first edge 2002 such that portions of the first surface 2006 are in facing relationship and the second edge 2004 extends in the same direction as the first edge 2002.

Figure 15C:
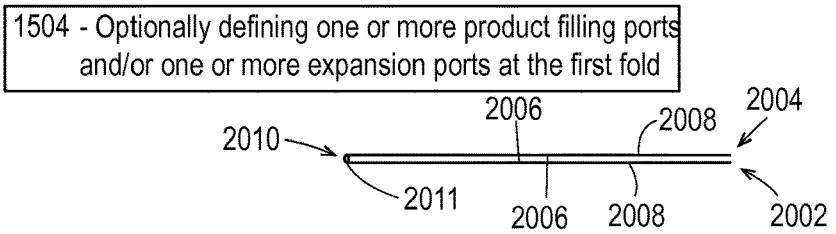
FIG. 15C illustrates the one or more webs or sheets of FIG. 15B, at a later point in time, in a step of defining one or more filling ports and/or expansion ports, in the method of forming a flexible container in accordance with an embodiment of the disclosure.

As illustrated in FIG. 15C at step 1504, one or more product filling ports and/or one or more structural support volume expansion ports 2011 can be formed in the web or sheet at or adjacent to the first fold 2010. Reference number 2011 generally illustrates one or more filling ports and/or one or more expansion ports. The product filling port and/or structural support volume expansion port 2011 can be defined at or adjacent to the first fold 2010 any time after forming the first fold 2011. FIG. 15 illustrates an embodiment in which the product filling port and/or the structural support volume expansion port 2011 is defined after the first fold 2010 is formed and before the second fold 2012 is formed.

Figure 15D:
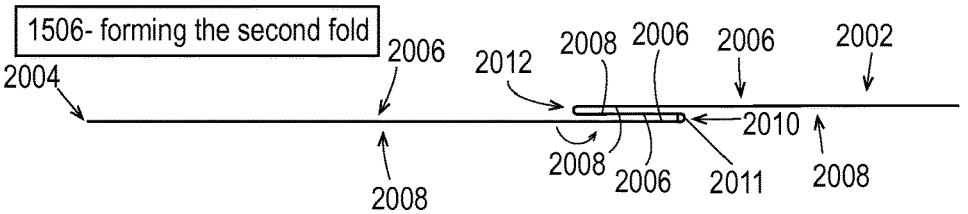
FIG. 15D illustrates the one or more webs or sheets of FIG. 15C, at a later point in time, in a step of forming a second fold, in the method of forming a flexible container in accordance with an embodiment of the disclosure.

As illustrated in FIG. 15D, at step 1506, a second fold 2012 can then be formed in the web or sheet by folding the first fold 2010 towards the first edge 2002 such that portions of the second surface 2008 disposed between the first fold 2010 and the second fold 2012 are in facing relationship and the second edge 2004 extends in an opposite direction from the first edge 2002.

Figure 15E:
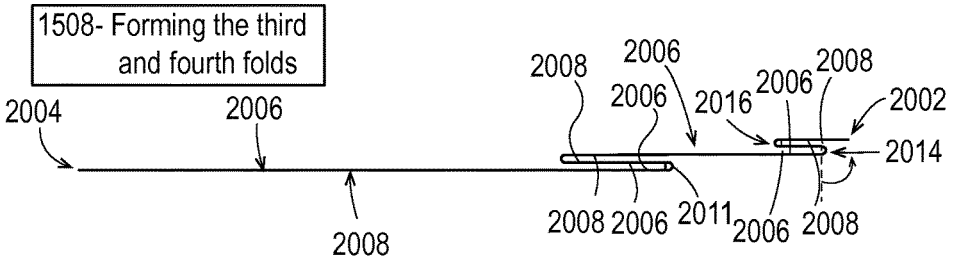
FIG. 15E illustrates the one or more webs or sheets of FIG. 15D, at a later point in time, in a step of forming a third fold and a fourth fold, in the method of forming a flexible container in accordance with an embodiment of the disclosure.

As illustrated in FIG. 15E at step 1508, third fold 2014 and the fourth fold 2016 can be formed at the first edge 2002 of the web or sheet. The third fold 2014 and the fourth fold 2016 are spaced from the first fold 2010 and the second fold 2012. The third fold 2014 is formed by folding the first edge 2002 towards the second edge 2004 and the fourth fold is formed by folding the first edge 2002 back towards the third fold 2014.

Figure 15F:
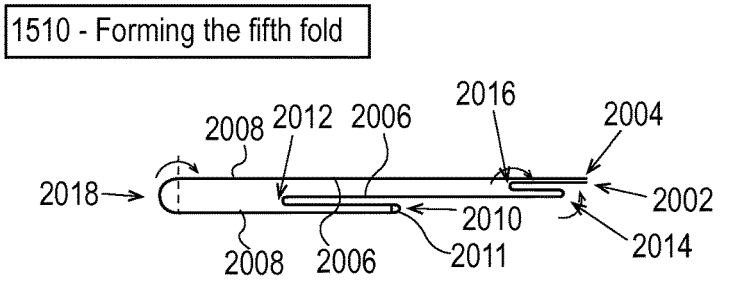
FIG. 15F illustrates the one or more webs or sheets of FIG. 15E, at a later point in time, in a step of forming a fifth fold, in the method of forming a flexible container in accordance with an embodiment of the disclosure.

As illustrated in FIG. 15F at step 1510, a fifth fold 2018 is formed by folding the second edge 2004 towards the first edge 2002 such that facing portions of the first surface 2006 disposed between the second fold 2012 and the fourth fold 2016 are in facing relationship and define interior walls of the product volume. The third fold 2014 and the fourth fold 2016 and the first edge 2002 and the second edge 2004 define an interrupted gusset in a top of the container.

Figure 15G:
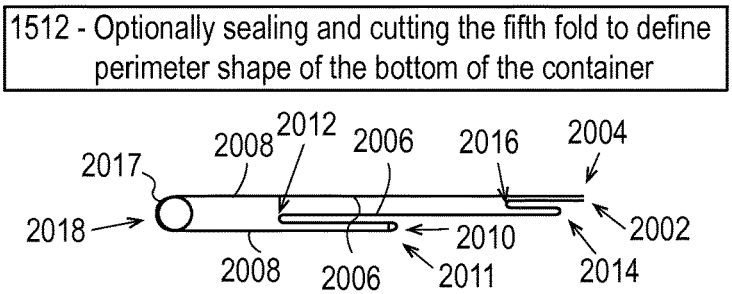
FIG. 15G illustrates the one or more webs or sheets of FIG. 15F, at a later point in time, in a step of sealing and cutting the fifth fold, in the method of forming a flexible container in accordance with an embodiment of the disclosure.

As illustrated in FIG. 15G at step 1512, the web or sheet can be optionally sealed and cut 2017 after forming the fifth fold to define a perimeter shape of the bottom of the flexible container.

Figure 15H:
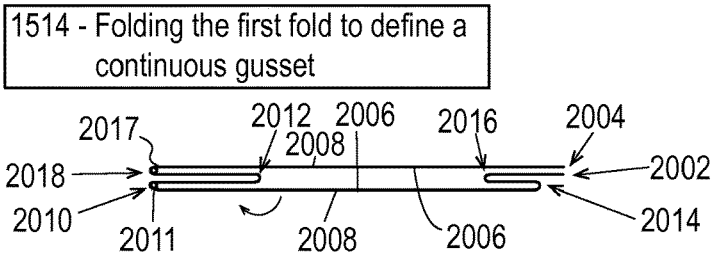
FIG. 15H illustrates the one or more webs or sheets of FIG. 15G, at a later point in time, in a step of folding the first fold to define a continuous gusset, in the method of forming a flexible container in accordance with an embodiment of the disclosure.

As illustrated in FIG. 15H at step 1514, the first fold 2010 can then be folded towards the fifth fold 2018 to form a gusset in a bottom of the container. If the cutting and sealing operations are performed in step 1512, the gusset in the bottom of the container would be an interrupted gusset including two seals.

Figure 15I:
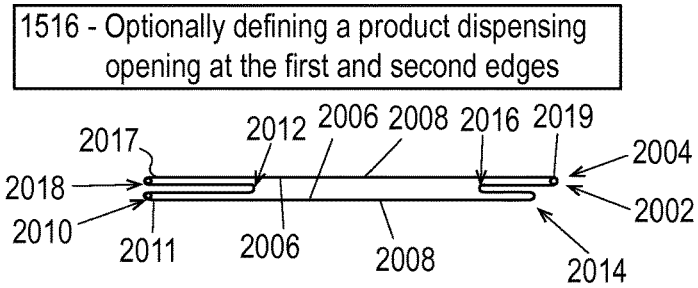
FIG. 15I illustrates the one or more webs or sheets of FIG. 15H, at a later point in time, in a step of defining a product dispensing opening, in the method of forming a flexible container in accordance with an embodiment of the disclosure.

As illustrated in FIG. 15I at step 1516, a product dispensing opening 2019 can be defined at the first edge 2002 and the second edge 2004 after forming the fifth fold 2018 such that the product dispensing opening is disposed in the top of the container. In various embodiments, a product dispensing opening can be defined by forming one or more seals that join facing portions of the web or sheet at or adjacent to its edges, or by forming (e.g. by cutting) one or more openings in a fold, to define one or more boundaries of a product dispensing opening, through which a fluent product can be dispensed.

Referring to FIGS. 16A-16G, in an embodiment, a flexible container can be formed from a web or sheet such that the flexible container includes an interrupted gusset in a bottom of the container.

Figure 16A:
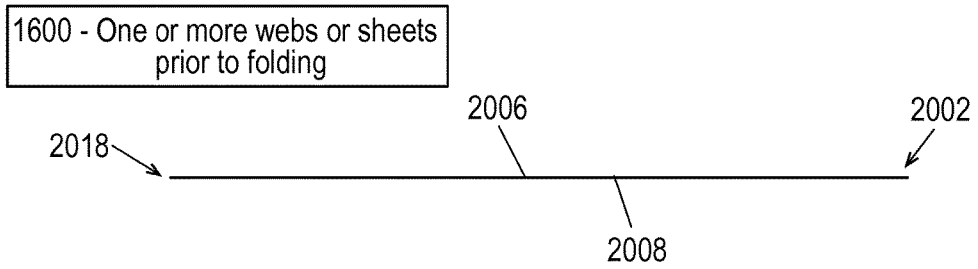
FIG. 16A illustrates one or more webs or sheets to be used in a method of forming a flexible container in accordance with an embodiment of the disclosure.

As illustrated in FIG. 16A, step 1600, the web or sheet includes a first edge 2002 and a second edge 2004 as well as a first surface 2006 *a* and second surface 2008, which are opposed to each other and extending between the first edge 2002 and the second edge 2004.

Figure 16B:
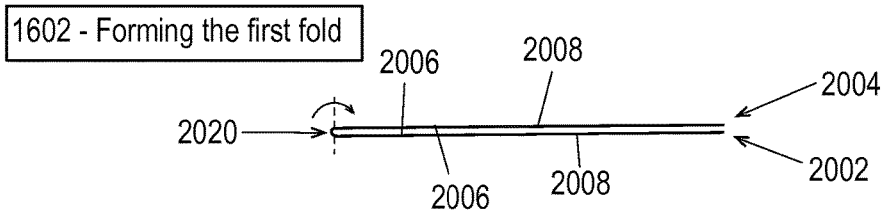
FIG. 16B illustrates the one or more webs or sheets of FIG. 16A, at a later point in time, in a step of forming a first fold, in the method of forming a flexible container in accordance with an embodiment of the disclosure.

As illustrated in FIG. 16B at step 1602, a first fold 2020 can be formed in the web or sheet by folding the second edge 2004 towards the first edge 2002 such that portions of the first surface 2006 are in facing relationship and the second edge 2004 extends in the same direction as the first edge 2002.

Figure 16C:
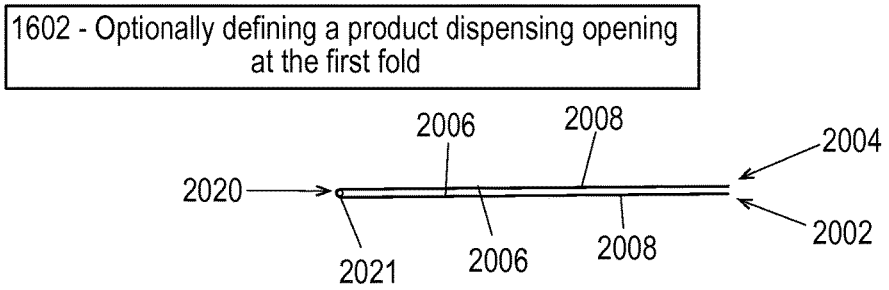
FIG. 16C illustrates the one or more webs or sheets of FIG. 16B, at a later point in time, in a step of defining a product dispensing opening, in the method of forming a flexible container in accordance with an embodiment of the disclosure.

In an alternative embodiment, as illustrated in FIG. 16C at step 1604, a product dispensing opening 2021 can be formed at the first fold 2020 at any time during the folding process after the first fold 2020 is formed. For example, the product dispensing opening 2021 can be formed in the first fold 2020 before forming a second fold.

Figure 16D:
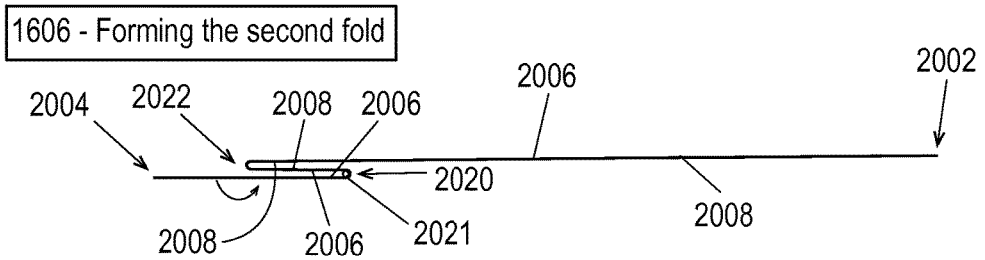
FIG. 16D illustrates the one or more webs or sheets of FIG. 16C, at a later point in time, in a step of forming a second fold, in the method of forming a flexible container in accordance with an embodiment of the disclosure.

As illustrated in FIG. 16D at step 1606, a second fold 2022 can then be formed in the web or sheet by folding the first fold 2020 towards the first edge 2002 such that portions of the second surface 2008 disposed between the first fold 2020 and the second fold 2022 are in facing relationship and the second edge 2004 extends in an opposite direction from the first edge 2002.

Figure 16E:
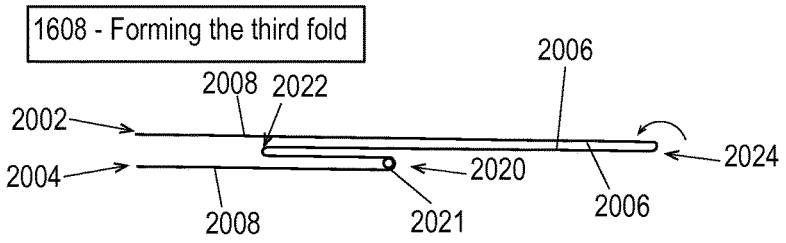
FIG. 16E illustrates the one or more webs or sheets of FIG. 16D at a later point in time, in a step of forming a third fold, in the method of forming a flexible container in accordance with an embodiment of the disclosure.

As illustrated in FIG. 16E at step 1608, a third fold 2024 can be formed in the web or sheet by folding the first edge 2002 towards the second edge 2004 such that portions of the first surface 2006 disposed between the first edge 2002 and the second edge 2004 and the second fold 2022 are in facing relationship.

Figure 16F:
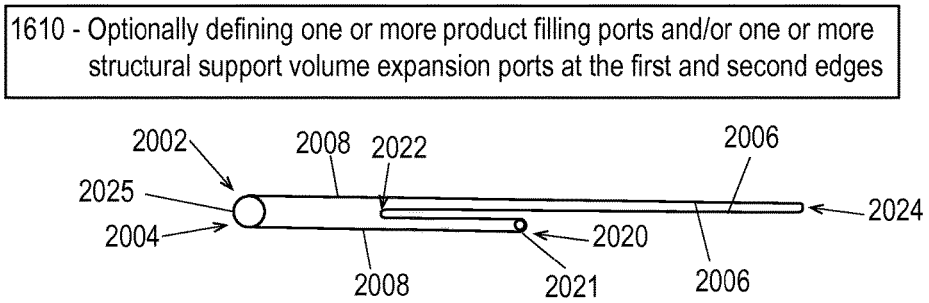
FIG. 16F illustrates the one or more webs or sheets of FIG. 16E, at a later point in time, in a step of defining one or more filling ports and/or expansion ports, in the method of forming a flexible container in accordance with an embodiment of the disclosure.

As illustrated in FIG. 16F at step 1610, after forming the third fold 2024, the method can also include forming one or more product filling ports and/or one or more structural support volume expansion ports 2025 at the first and second edges 2002, 2004 or at the first fold 2020 depending on where the product dispensing opening is formed. Reference number 2025 generally illustrates one or more filling ports and/or one or more expansion ports. In various embodiments, a product dispensing opening can also be formed at the first and second edges 2002, 2004 after forming the third fold; in such embodiments, the product dispensing opening can be formed in the top of the container.

Figure 16G:
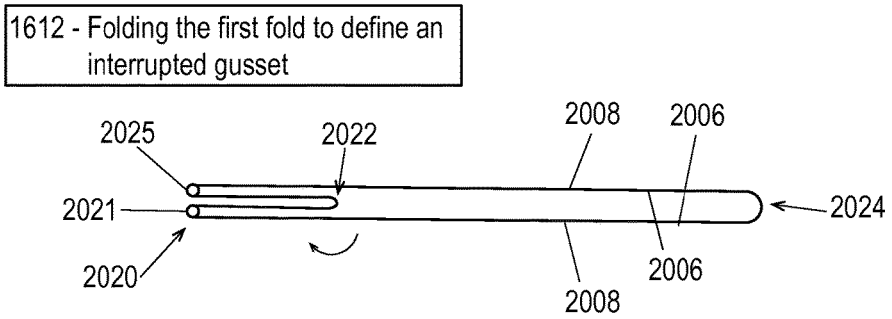
FIG. 16G illustrates the one or more webs or sheets of FIG. 16F, at a later point in time, in a step of folding the first fold to define an interrupted gusset, in the method of forming a flexible container in accordance with an embodiment of the disclosure.

As illustrated in FIG. 16G at step 1612, the first fold 2020 can then be folded towards the second edge 2004, thereby forming an interrupted gusset in a bottom of the container. Facing portions of the first surface 2006 disposed between the second fold 2022 and the third fold 2024 define opposed interior walls of the product volume of the container. The folds can be configured such that the first fold 2020 and the first edge 2002 and the second edge 2004, once sealed have terminal ends disposed in the same plane.

Referring to FIGS. 17A-17G, in an embodiment, a flexible container can be formed from a web or sheet to have an interrupted gusset in the top of the container and a gusset having at least one structural support volume in a bottom of the container.

Figure 17A:
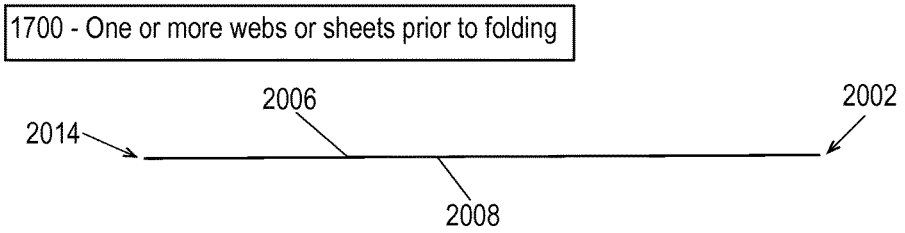
FIG. 17A illustrates one or more webs or sheets to be used in a method of forming a flexible container in accordance with an embodiment of the disclosure.

As illustrated in FIG. 17A, step 1700, the web or sheet includes a first edge 2002 and a second edge 2004 as well as a first surface 2006 *a* and second surface 2008, which are opposed to each other and extending between the first edge 2002 and the second edge 2004.

Figure 17B:
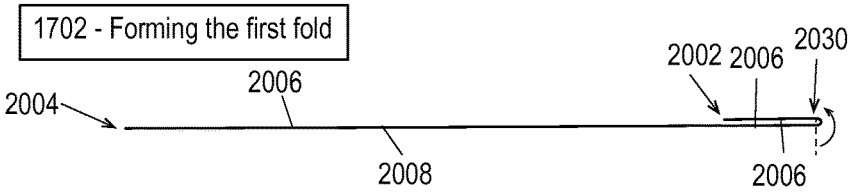
FIG. 17B illustrates the one or more webs or sheets of FIG. 17A, at a later point in time, in a step of forming a first fold, in the method of forming a flexible container in accordance with an embodiment of the disclosure.

As illustrated in FIG. 17B at step 1702, a first fold 2030 can be formed in the web or sheet by folding the first edges 2002 towards the second edge 2004 such that portions of the first surface 2006 are in facing relationship and the first edges 2002 extends in the same direction as the second edge 2004.

Figure 17C:
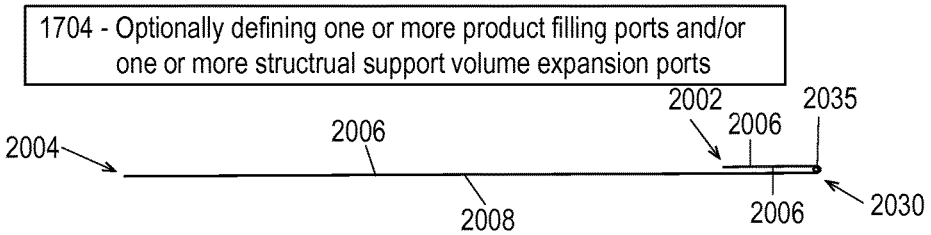
FIG. 17C illustrates the one or more webs or sheets of FIG. 17B, at a later point in time, in a step of defining one or more filling ports and/or expansion ports, in the method of forming a flexible container in accordance with an embodiment of the disclosure.

As illustrated in FIG. 17C at step 1704, the method can include defining one or more product filling port and/or one or more structural support volume expansion ports 2035 in the first fold 2030. Reference number 2035 generally illustrates one or more filling ports and/or one or more expansion ports.

Figure 17D:
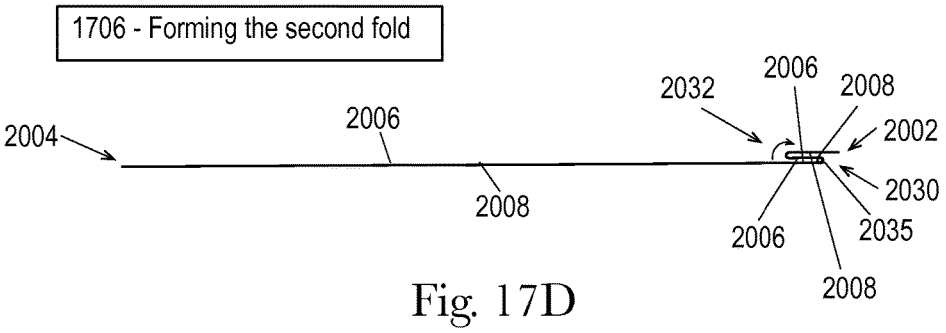
FIG. 17D illustrates the one or more webs or sheets of FIG. 17C, at a later point in time, in a step of forming a second fold, in the method of forming a flexible container in accordance with an embodiment of the disclosure.

As illustrated in FIG. 17D at step 1706, a second fold 2032 can be formed by folding the first edge 2002 towards the first fold 2030 such that portions of the second surface 2008 disposed between the first fold 2030 and the second fold 2032 are in facing relationship and the first edge 2002 extends in an opposite direction from the second edge 2004.

Figure 17E:
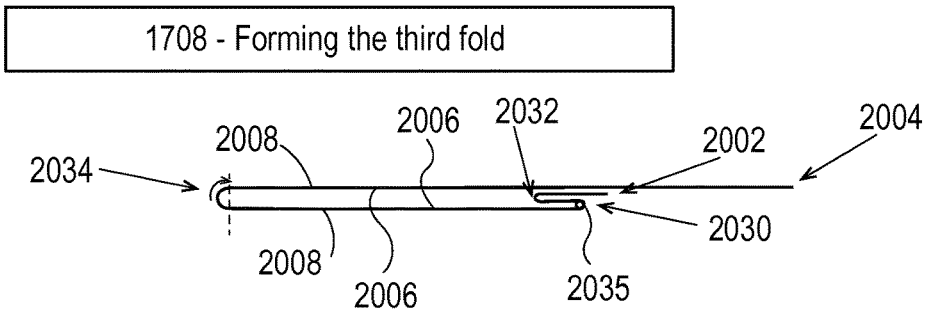
FIG. 17E illustrates the one or more webs or sheets of FIG. 17D, at a later point in time, in a step of forming a third fold, in the method of forming a flexible container in accordance with an embodiment of the disclosure.

As illustrated in FIG. 17E at step 1708, a third fold 2034 can be formed by folding the second edge 2004 towards the first edge 2002 such that portions of the first surface disposed between the third fold 2034 and the second fold 2032 are in facing relationship. The first edge 2002 and the second edge 2004 and the first fold 2030 define an interrupted gusset in a top of the container.

Figure 17F:
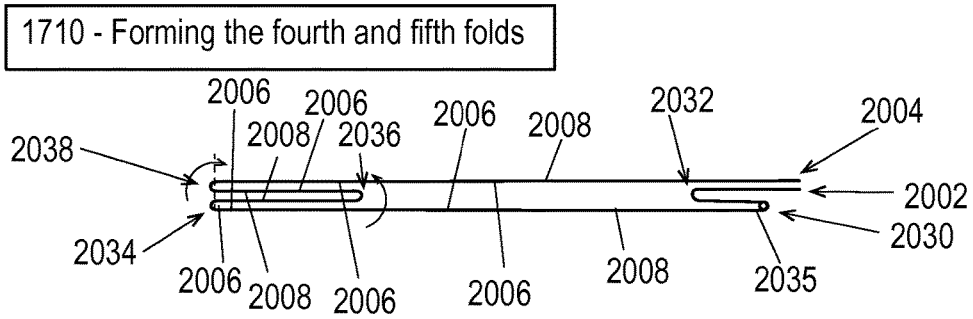
FIG. 17F illustrates the one or more webs or sheets of FIG. 17E, at a later point in time, in a step of forming a fourth fold and a fifth fold, in the method of forming a flexible container in accordance with an embodiment of the disclosure.

As illustrated in FIG. 17F at step 1710, a fourth fold 2036 and a fifth fold 2038 can then be formed such that the fourth fold 2036 is disposed between the third fold 2034 and the fifth fold 2038 and portions of the second surface 2008 disposed between the third fold 2034 and the fifth fold 2038 are in facing relationship and portions of the first surface 2006 disposed between the third fold 2034 and the fifth fold 2038 are in facing relationship, thereby forming a continuous gusset in a bottom of the container. In various embodiments, a continuous gusset can be changed into an interrupted gusset by performing cutting and sealing operations along the continuous gusset, such as those used to define a product dispensing opening. The terminal edges of the third fold 2034 and the fifth fold 2038 can be aligned in a single plane.

The fourth fold 2036 can be formed, for example, by folding the second edge 2004 towards the third fold 2034 such that portions of the second surface 2008 disposed between the third fold 2034 and the fourth fold 2036 are in facing relationship. The fifth fold 2038 can then be formed by folding the second edges 2004 towards the first edge 2002 such that portions of the first surface 2006 disposed between the fourth fold 2036 and the fifth fold 2038 are in facing relationship.

Alternatively, the fourth and fifth folds 2036, 2038 can be formed by shifting the second edge 2004 towards the third fold 2034 while applying a force to the web or sheet in the region in which the fourth fold 2036 is to be formed. The shifting motion thereby defines the fourth fold 2036 where the force is applied and the fifth fold 2038 at substantially the same time as the fourth fold 2036.

Figure 17G:
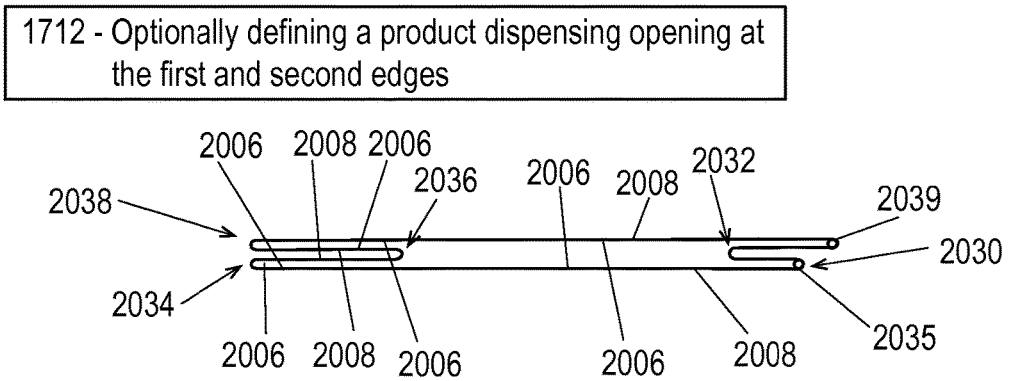
FIG. 17G illustrates the one or more webs or sheets of FIG. 17F, at a later point in time, in a step of defining a product dispensing opening, in the method of forming a flexible container in accordance with an embodiment of the disclosure.

As illustrated in FIG. 17G at step 1712, a product dispensing opening 2039 can be formed at the first edge 2002 and the second edge 2004 after forming the fourth fold 2036 and the fifth fold 2038. The product dispensing opening can be formed by forming one or more seals that join the facing portions of the first surface 2006 at or adjacent to the first edge 2002 and the second edge 2004 to define one or more boundaries of the product dispensing opening.

Referring to FIGS. 18A-18G, in an embodiment, a flexible container can be formed from a web or sheet to have an interrupted gusset having at least one structural support volume disposed in the bottom of the container.

Figure 18A:
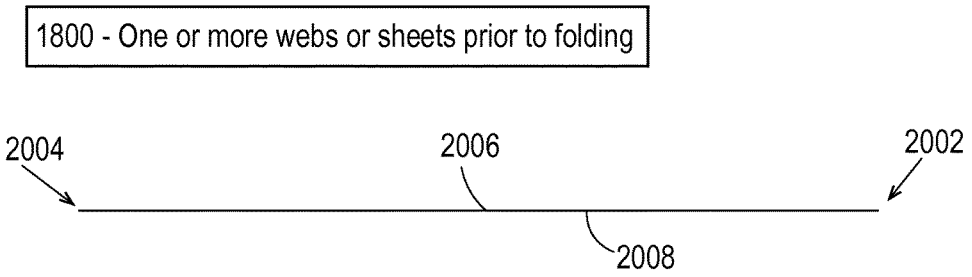
FIG. 18A illustrates one or more webs or sheets to be used in a method of forming a flexible container in accordance with an embodiment of the disclosure.

As illustrated in FIG. 18A, step 1800, the web or sheet includes a first edge 2002 and a second edge 2004 as well as a first surface 2006 *a* and second surface 2008, which are opposed to each other and extending between the first edge 2002 and the second edge 2004.

Figure 18B:
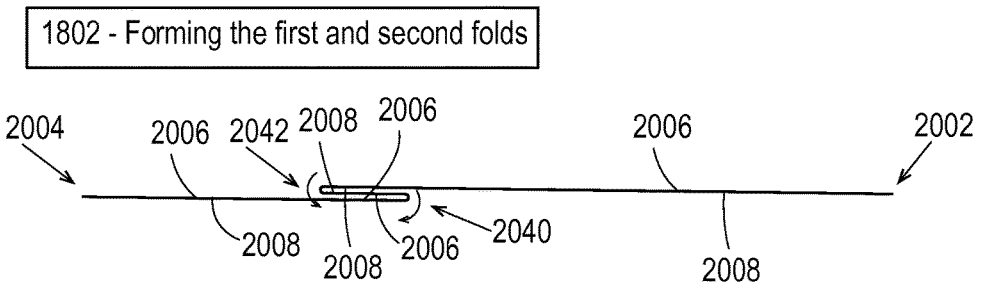
FIG. 18B illustrates the one or more webs or sheets of FIG. 18A, at a later point in time, in a step of forming a first fold and second fold, in the method of forming a flexible container in accordance with an embodiment of the disclosure.

As illustrated in FIG. 18B at step 1802, a first fold 2040 and a second fold 2042 can be formed in the web or sheet such that portions of the second surface 2008 are in facing relationship and portions of the first surface 2006 are in facing relationship, between the first fold 2040 and the second fold 2042. The first fold 2040 and the second fold 2042 can be formed in any order. The first edge 2002 and the second edge 2004 are on opposite sides after forming the first fold 2040 and the second fold 2042.

For example, moving the first edge 2002 towards the second edge 2004 can form the first fold 2040 and then moving the first edge 2002 back over the first fold 2040 can form the second fold 2042. As an alternative example, the first fold 2040 and the second fold 2042 can be formed by moving the second edge 2004 instead of the first edge 2002. As another alternative example, the first fold 2040 and the second fold 2042 can be formed by shifting the first edge 2002 towards the second edge 2004 while applying a force to the web in the region in which the first fold 2040 is to be formed. Upon shifting of the web or sheet, the first fold forms 2040 where the force is applied and the second fold 2042 forms by the same shifting motion of the web or sheet.

Figure 18C:
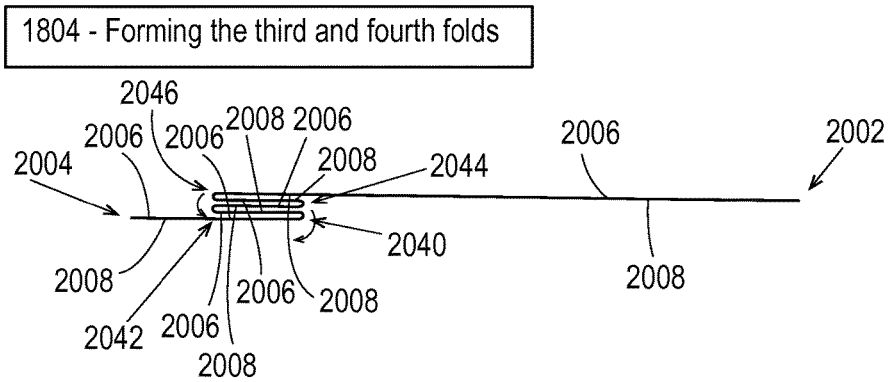
FIG. 18C illustrates the one or more webs or sheets of FIG. 18B, at a later point in time, in a step of forming a third fold and fourth fold, in the method of forming a flexible container in accordance with an embodiment of the disclosure.

As illustrated in FIG. 18C at step 1804, a third fold 2044 and a fourth fold 2046 can be formed such that portions of the second surface 2008 are in facing relationship and portions of the first surface 2006 at the fourth fold 2046 are in facing relationship between the third fold 2044 and the fourth fold 2046. The third fold 2044 is disposed above the first fold 2040 and the fourth fold 2046 is disposed above the second fold 2042. The first edge 2002 and the second edge 2004 are on opposite sides after forming the third fold 2044 and the fourth fold 2046. The third fold 2044 and the fourth fold 2046 can be formed in any of the ways that the first fold 2040 and the second fold 2044 can be formed, as described above.

Figure 18D:
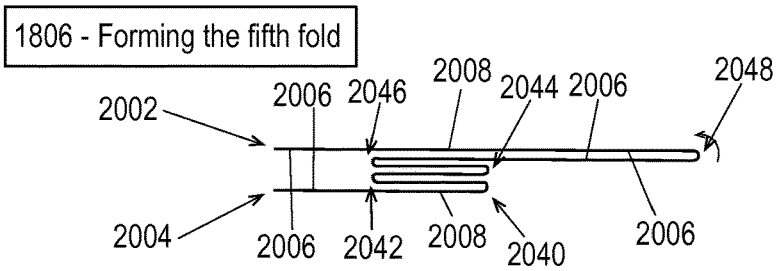
FIG. 18D illustrates the one or more webs or sheets of FIG. 18C, at a later point in time, in a step of forming a fifth fold, in the method of forming a flexible container in accordance with an embodiment of the disclosure.

As illustrated in FIG. 18D at step 1806, a fifth fold 2048 can be formed by folding the first edge 2002 towards the second edge 2004 such that the second fold 2042 and the fourth fold 2046 are disposed between facing portions of the first surface 2006 that extend from the first edge 2002 and the second edge 2004 to the first fold 2040.

Figure 18E:
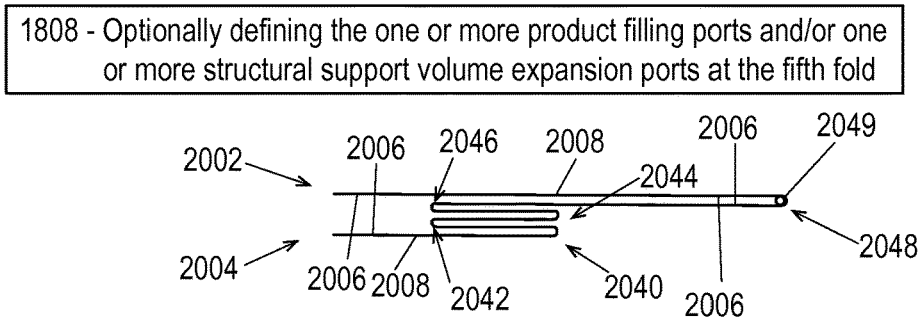
FIG. 18E illustrates the one or more webs or sheets of FIG. 18D, at a later point in time, in a step of defining one or more filling ports and/or expansion ports, in the method of forming a flexible container in accordance with an embodiment of the disclosure.

As illustrated in FIG. 18E at step 1808, the method can also further include defining one or more product filling ports and/or one or more structural support volume expansion ports 2049 at or adjacent to the fifth fold 2048. Reference number 2049 generally illustrates the one or more filling ports and/or one or more expansion ports. The process of defining the product filling port 2049 can include cutting the fifth fold 2048 between the boundaries of the product filling port 2049 to provide an opening through which the product can flow.

Figure 18F:
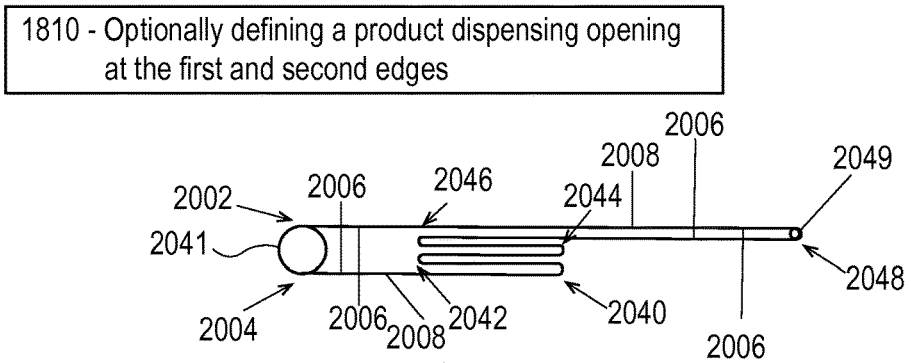
FIG. 18F illustrates the one or more webs or sheets of FIG. 18E, at a later point in time, in a step of defining a product dispensing opening, in the method of forming a flexible container in accordance with an embodiment of the disclosure.

As illustrated in FIG. 18F at step 1810, after forming the fifth fold 2048, the method can further include defining a product dispensing opening 2041 at the first edge 2002 and the second edge 2004 thereby defining the product dispensing opening 2041 in the bottom of the container. The product dispensing opening 2041 can be defined by joining the facing portions of the first surface 2006 at or adjacent to the first edge 2002 and the second edge 2004 to define one or more boundaries of the product dispensing opening.

Figure 18G:
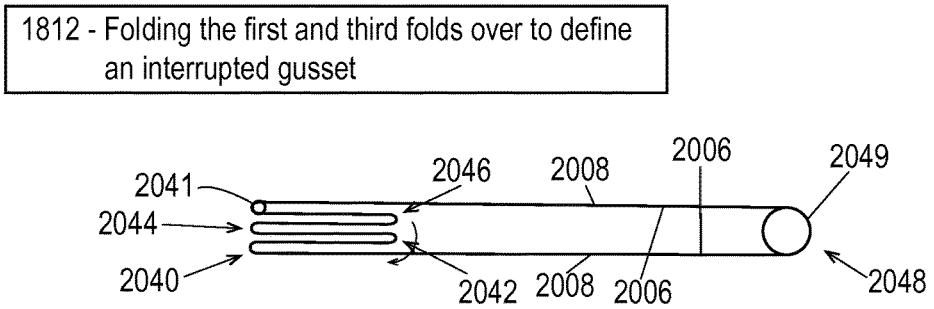
FIG. 18G illustrates the one or more webs or sheets of FIG. 18F, at a later point in time, in a step of folding the first fold and the third fold to define an interrupted gusset, in the method of forming a flexible container in accordance with an embodiment of the disclosure.

As illustrated in FIG. 18G at step 1812 in the method, the first fold 2040 and the third fold 2042 can then be folded towards the first edge 2002 and the second edge 2004 to form an interrupted gusset in the bottom of the container.

In any of the foregoing embodiments, the product dispensing opening can be, for example, a product dispensing valve that is formed from the flexible material or provided as a separate unit that is attached to the flexible material at the product dispensing opening. In any of the foregoing embodiments, the product dispensing opening can be used for one or both of dispensing product from the product volume and filling the product volume.

In any of the foregoing embodiments, a product dispensing opening, a product filling port, bottom perimeter of the container, and/or a structural support volume expansion port can be defined in a designated region by forming one or more seals to define the boundary. In embodiments in which two or more webs or sheets are used, the sealing can join each of the layers of flexible material present in the sealing region to each other, including the facing portions of the first surface, as described above. For example, in an embodiment in which first and second flexible materials are folded together in the process of making the flexible container, the sealing to define a boundary of the product dispensing opening, product filling port, and/or structural support volume expansion port can include joining the first and second flexible materials to each other as well as joining facing portions of the first flexible material.

The process can further include cutting the seals to define a perimeter shape of the bottom of the container, product dispensing opening, the product filling port, and/or structural support volume expansion port. The process can include sealing and cutting in a single unit operation or in serial operations. Sealing techniques including, but not limited to, heat sealing, impulse sealing, induction sealing, laser sealing, hot wire sealing, and ultrasonic sealing can be used to seal and optionally cut the seal region. Cutting can alternatively be completed using a cutting die that is separate from the sealing surface.

In any of the foregoing embodiments, the method can include forming multiple product filling ports and/or multiple structural support volume expansion ports. For example, a flexible container can include multiple product volumes, each being filled through a separate product filling port. For example, a flexible container can include multiple structural support volumes that are not in fluid communication and, therefore, require separate expansion ports for expanding the structural support volumes.

In any of the foregoing embodiments, the product filling port and the expansion port (if each are formed) can at least partially overlap. The product filling port can be defined, for example, between facing portions of the web or sheet resulting from folding. In embodiments in which the flexible container is formed from two or more webs, the expansion port is defined between two webs or sheets. The expansion port can be defined by forming one or more seals joining the two webs or sheets prior to folding the webs or sheets into the flexible container. Overlapping the product filling port with the expansion port can aid in ensuring that the expansion port is not sealed during a sealing process. Additionally, the overlap can simplify the forming process by providing only one region of the web or sheet that needs to remain unsealed during the sealing process for forming the product filling port and the expansion port.

In any of the foregoing embodiments, the first and second edges can be parallel to each other after forming any of the folds. In other embodiments, the first and second edges can be angled relative to each other after forming any of the folds. The processes of forming the flexible container can also include forming one or more folds such that the first and second edges are parallel and forming one or more fold such that the first and second edges are angled relative to each other.

In any of the foregoing embodiments, the process for forming the flexible container can be a continuous process using a continuous web which is folded in the machine direction.

Figure 19A:
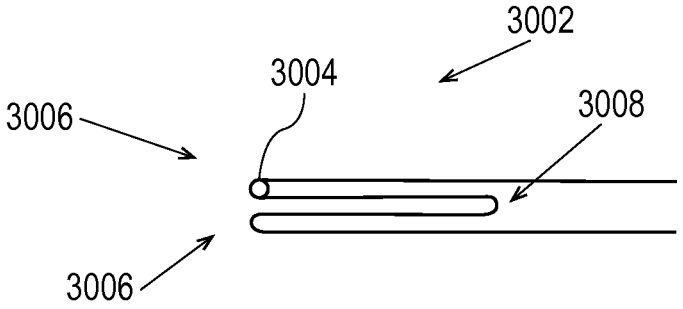
FIG. 19A is a schematic illustration of a gusset region of a flexible container having an interrupted gusset in accordance with an embodiment of the disclosure.
Figure 19B:
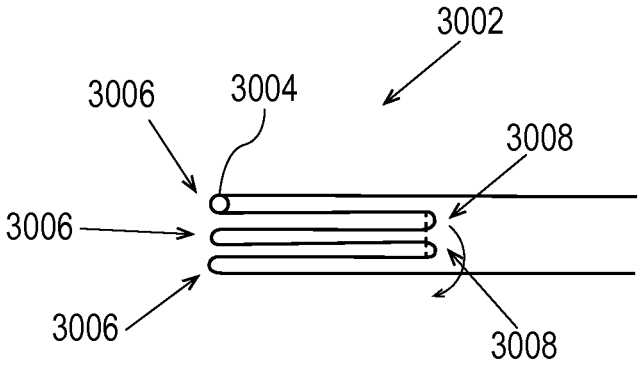
FIG. 19B is another schematic illustration of a gusset region of a flexible container having an interrupted gusset in accordance with an embodiment of the disclosure.
Figure 20:
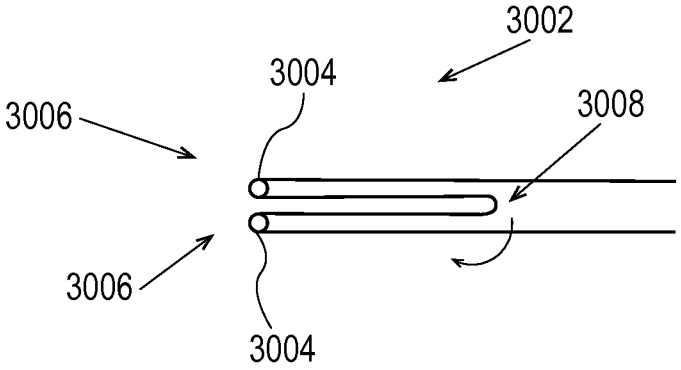
FIG. 20 is a schematic illustration of a gusset region of flexible container having an interrupted gusset in accordance with another embodiment of the disclosure.

In accordance with an embodiment, a flexible container can include an interrupted gusset at the top and/or bottom of the container. Referring to FIG. 19A, an interrupted gusset 3002 for a flexible container includes two outward extensions 3006 an inward extension 3008, with a seal 2004 disposed at one of the outward extensions 3006 of the gusset 3002. Referring to FIG. 19B, an interrupted gusset for a flexible container includes three outward extensions 3006 and two inward extensions 3008, with a seal 3004 disposed at one of the outward extensions 3006 of the gusset 3002. The seal can be any one of a fin seal, or a non-final seal, including a cut seal, a bead seal or a lap seal (also known as an overlap seal). Referring to FIG. 20, an interrupted gusset 3002 for a flexible container can be configured in the same way as in FIG. 19A, except that the interrupted gusset can have two seals 3004 disposed in each of the two outward extensions 3006 of the gusset 3002.

A gusset can include any suitable number of outward extensions and inward extensions. In general, the total number of outward extensions will exceed the total number of inward extensions by one. The distance between each adjacent pair of inward and outward extensions of gusset may be equivalent to each or one or more of those distances may vary with one or all of the distances between each adjacent pair of inward and outward extensions.

The flexible material that comprises a gusset material may be comprised of, or include, the flexible material of one or both of the portion of flexible material adjacent to and up to including the terminal end of the first side, and/or the portion of flexible material adjacent to and up to including the terminal end of the second side.

Optionally any seals disposed in a gusset between one of the outward extensions and the inward extension, including that one of the at least two seals is disposed at the inward extension.

Figure 21:
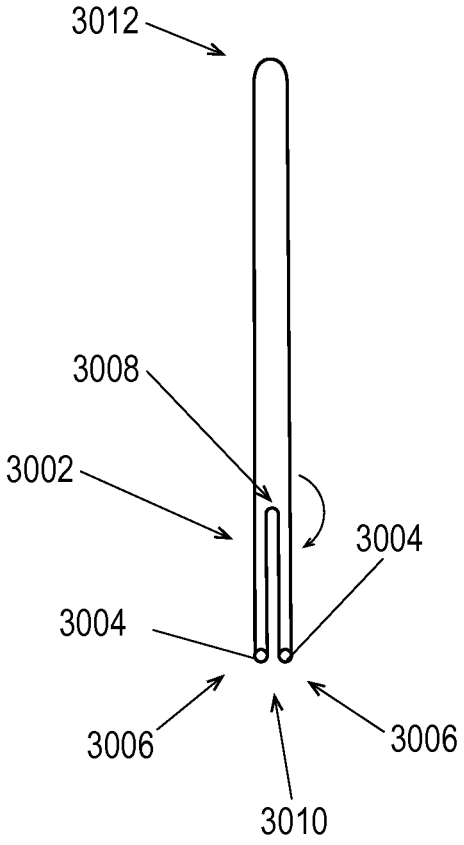
FIG. 21 is a schematic illustration of a stand-up flexible container having an interrupted gusset in accordance with an embodiment of the disclosure.

Referring to FIG. 21, a formed stand up flexible container in accordance with an embodiment can include an interrupted gusset at the bottom 3010 of the container and no gusset at the top 3012 of the container. The interrupted gusset can include any suitable number of outward extensions 3006 and any suitable number of inward extensions 3008. The interrupted gusset includes at least one seal 3002 disposed in at least one of the outward extensions 3006.

Part, parts, or all of any of the embodiments disclosed herein can be combined with part, parts, or all of other embodiments known in the art of flexible containers, including those described below.

Embodiments of the present disclosure can use any and all embodiments of materials, structures, and/or features for flexible containers, as well as any and all methods of making and/or using such flexible containers, as disclosed in the following patent applications: U.S. non-provisional patent application Ser. No. 13/888,679 filed May 7, 2013, entitled "Flexible Containers"; U.S. non-provisional patent application Ser. No. 13/888,721 filed May 7, 2013, entitled "Flexible Containers"; U.S. non-provisional patent application Ser. No. 13/888,963 filed May 7, 2013, entitled "Flexible Containers"; U.S. non-provisional patent application Ser. No. 13/888,756 filed May 7, 2013, entitled "Flexible Containers Having a Decoration Panel"; U.S. non-provisional patent application Ser. No. 13/957,158 filed Aug. 1, 2013, entitled "Methods of Making Flexible Containers"; U.S. non-provisional patent application Ser. No. 13/957,187 filed Aug. 1, 2013, entitled "Containers Made from Flexible Material"; U.S. non-provisional patent application Ser. No. 13/889,000 filed May 7, 2013, entitled "Flexible Containers with Multiple Product Volumes"; U.S. non-provisional patent application Ser. No. 13/889,061 filed May 7, 2013, entitled "Flexible Materials for Flexible Containers"; U.S. non-provisional patent application Ser. No. 13/889,090 filed May 7, 2013, entitled "Flexible Materials for Flexible Containers"; U.S. provisional patent application 61/861,100 filed Aug. 1, 2013, entitled "Disposable Flexible Containers having Surface Elements"; U.S. provisional patent application 61/861,106 filed Aug. 1, 2013, entitled "Flexible Containers having Improved Seam and Methods of Making the Same"; U.S. provisional patent application 61/861,118 filed Aug. 1, 2013, entitled "Method of Forming a Flexible Container"; U.S. provisional patent application 61/861,129 filed Aug. 1, 2013, entitled "Enhancements to Tactile Interaction with Film Walled Packaging Having Air Filled Structural Support Volumes"; PCT international patent application CN2013/085045 filed Oct. 11, 2013, entitled "Flexible Containers Having a Squeeze Panel"; PCT international patent application CN2013/085065 filed Oct. 11, 2013, entitled "Stable Flexible Containers"; each of which is hereby incorporated by reference.

Embodiments of the present disclosure can use any and all embodiments of materials, structures, and/or features for flexible containers, as well as any and all methods of making and/or using such flexible containers, as disclosed in the following patent documents: U.S. Pat. No. 5,137,154, filed Oct. 29, 1991, entitled "Food bag structure having pressurized compartments" in the name of Cohen, granted Aug. 11, 1992; PCT international patent application WO 96/01775 filed Jul. 5, 1995, published Jan. 26, 1995, entitled "Packaging Pouch with Stiffening Air Channels" in the name of Prats (applicant Danapak Holding A/S); PCT international patent application WO 98/01354 filed Jul. 8, 1997, published Jan. 15, 1998, entitled "A Packaging Container and a Method of its Manufacture" in the name of Naslund; U.S. Pat. No. 5,960,975 filed Mar. 19, 1997, entitled "Packaging material web for a self-supporting packaging container wall, and packaging containers made from the web" in the name of Lennartsson (applicant Tetra Laval), granted Oct. 5, 1999; U.S. Pat. No. 6,244,466 filed Jul. 8, 1997, entitled "Packaging Container and a Method of its Manufacture" in the name of Naslund, granted Jun. 12, 2001; PCT international patent application WO 02/085729 filed Apr. 19, 2002, published Oct. 31, 2002, entitled "Container" in the name of Rosen (applicant Eco Lean Research and Development A/S); Japanese patent JP4736364 filed Jul. 20, 2004, published Jul. 27, 2011, entitled "Independent Sack" in the name of Masaki (applicant Toppan Printing); PCT international patent application WO2005/063589 filed Nov. 3, 2004, published 14 Jul. 2005, entitled "Container of Flexible Material" in the name of Figols Gamiz (applicant Volpak, S. A.); German patent application DE202005016704 U1 filed Jan. 17, 2005, entitled "Closed bag for receiving liquids, bulk material or objects comprises a bag wall with taut filled cushions or bulges which reinforce the wall to stabilize it"

in the name of Heukamp (applicant Menshen), laid open as publication DE102005002301; Japanese patent application 2008JP-0024845 filed Feb. 5, 2008, entitled "Self-standing Bag" in the name of Shinya (applicant Toppan Printing), laid open as publication JP2009184690; U.S. patent application Ser. No. 10/312,176 filed Apr. 19, 2002, entitled "Container" in the name of Rosen, published as US20040035865; U.S. Pat. No. 7,585,528 filed Dec. 16, 2002, entitled "Package having an inflated frame" in the name of Ferri, et al., granted on Sep. 8, 2009; U.S. patent application Ser. No. 12/794,286 filed Jun. 4, 2010, entitled "Flexible to Rigid Packaging Article and Method of Use and Manufacture" in the name of Helou (applicant, published as US20100308062; U.S. Pat. No. 8,540,094 filed Jun. 21, 2010, entitled "Collapsible Bottle, Method Of Manufacturing a Blank For Such Bottle and Beverage-Filled Bottle Dispensing System" in the name of Reidl, granted on Sep. 24, 2013; and PCT international patent application WO 2013/124201 filed Feb. 14, 2013, published Aug. 29, 2013, entitled "Pouch and Method of Manufacturing the Same" in the name of Rizzi (applicant Cryovac, Inc.); each of which is hereby incorporated by reference.

Part, parts, or all of any of the embodiments disclosed herein also can be combined with part, parts, or all of other embodiments known in the art of containers for fluent products, so long as those embodiments can be applied to flexible containers, as disclosed herein. For example, in various embodiments, a flexible container can include a vertically oriented transparent strip, disposed on a portion of the container that overlays the product volume, and configured to show the level of the fluent product in the product volume.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or patent publication, is hereby incorporated herein by reference in its entirety unless expressly excluded or otherwise limited. The citation of any document is not an admission that it is prior art with respect to any document disclosed or claimed herein or that it alone, or in any combination with any other reference or references, teaches, suggests or discloses any such embodiment. Further, to the extent that any meaning or definition of a term in this document conflicts with any meaning or definition of the same term in a document incorporated by reference, the meaning or definition assigned to that term in this document shall govern.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method of forming a flexible container from at least two webs, a first web having opposed first and second surfaces and a second web having opposed third and fourth surfaces, the first web and the second web each having a first edge and a second edge, a container first side edge region and a container second side edge region, the flexible container comprising a product volume, at least one expandable structural support volume, and at least two gussets, including a top gusset and a bottom gusset, the method comprising:

providing the first surface of the first web in a facing relationship to the third surface of the second web;

joining at least a portion of the first surface of the first web to at least a portion of the third surface of the second web to form the at least one expandable structural support volume;

folding the joined sheets, wherein two gussets z-folds are formed between the first edge and the second edge of the first and second webs, a first z-fold adjacent the first edge of the first and second webs and a second z-fold spaced apart from the first z-fold toward the second edge;

folding the joined first and second webs to dispose the first edge of the first and second webs adjacent the second edge of the first and second webs, wherein the second surface of the first web is folded upon itself; and joining the container first side edge region and the container second side edge region of the folded first and second webs to form the top gusset from the first z-fold, the bottom gusset from the second z-fold, and a perimeter of the flexible container, wherein the product volume is formed by the unjoined area between of the second surface of the first web that is folded upon itself and wherein the product volume is separate from the structural support volume formed between the first web and the second webs.

2. The method of claim 1, further including forming a product dispensing opening at the adjacent first and second edges.

3. The method of claim 2, wherein the product dispensing opening is defined by forming one or more seals that join facing portions of first and second webs at the first and second edges to define one or more boundaries of the product dispensing opening.

4. The method of claim 3, wherein the container first side edge region and the container second side edge region are joined by one or more side edge seals and the method further comprises cutting the one or more side edge seals to define a perimeter shape of the flexible container.

5. The method of claim 4, wherein the one or more side seals are formed and cut in a single unit operation.

6. The method of claim 1, further comprising defining a product dispensing opening in the sheet at the first fold, wherein the product dispensing opening is disposed in the bottom of the container.

7. The method of claim 6, wherein the product dispensing opening is defined at the first fold before forming the second fold.

8. The method of claim 7, wherein the product dispensing opening is defined by forming one or more seals that join the facing portions of the first surface at the first fold to define one or more boundaries of the product dispensing opening, and cutting a portion of the first fold between the boundaries of the product dispensing opening to provide an opening through which product can flow.

9. The method of claim 1, comprising defining a product filling port at the first and second edges after forming the third fold.

10. The method of claim 9, wherein defining the product filling port comprises forming at least one seal that joins the facing portions of the first surface at the first and second edges, the at least one seal defining at least a portion of a boundary of the product filling port.

11. The method of claim 1, comprising defining a structural support volume expansion port at the first and second edges.

12. The method of claim 1, wherein the flexible container has a top and a bottom and the method further comprises forming a product dispensing opening in the top of said flexible container.

13. The method of claim 1, wherein the structural support volume is a fillable space configured to be at least partially filled with one or more expansion materials to form an expanded structural support volume.

14. The method of claim 13, further comprising filling said structural support volume with one or more expansion materials to form an expanded structural support volume.

15. The method of claim 14, wherein said expansion materials are selected from the group consisting of: liquids, gases, fluent products, foams, co-reactive materials that produce gas, phase change materials that can be added in solid or liquid form, but which turn into a gas, and combinations of any of these.

* * * * *